US006321964B1

(12) United States Patent
Yamaguchi et al.

(10) Patent No.: US 6,321,964 B1
(45) Date of Patent: Nov. 27, 2001

(54) CONTINUOUS PAPER CUTTING UNIT

(75) Inventors: Naoto Yamaguchi; Takumi Sato, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/536,318

(22) Filed: Mar. 27, 2000

Related U.S. Application Data

(62) Division of application No. 08/919,782, filed on Aug. 29, 1997, now Pat. No. 6,068,170.

(30) Foreign Application Priority Data

| | | |
|---|---|---|
| Aug. 29, 1996 | (JP) | 8-247165 |
| Aug. 30, 1996 | (JP) | 8-248706 |
| Aug. 30, 1996 | (JP) | 8-248707 |
| Sep. 11, 1996 | (JP) | 8-262520 |
| Apr. 21, 1997 | (JP) | 9-117509 |
| Apr. 21, 1997 | (JP) | 9-117510 |
| Apr. 21, 1997 | (JP) | 9-117511 |
| Apr. 21, 1997 | (JP) | 9-117512 |
| Apr. 21, 1997 | (JP) | 9-117513 |
| Apr. 21, 1997 | (JP) | 9-117514 |
| Jul. 30, 1997 | (JP) | 9-219204 |

(51) Int. Cl.[7] ..... B26F 3/02

(52) U.S. Cl. ..... 225/96; 225/101; 225/104; 225/105

(58) Field of Search ..... 225/2, 4, 100, 225/101, 104, 105, 106, 93, 96

(56) References Cited

U.S. PATENT DOCUMENTS

| | | | |
|---|---|---|---|
| 2,331,351 | 10/1943 | Seeley | 164/84.5 |
| 2,570,873 | 10/1951 | Seybold . | |
| 2,629,440 | 2/1953 | Shaw et al. . | |
| 3,794,228 | 2/1974 | Colwill et al. . | |
| 3,863,821 | 2/1975 | Van Benekom | 225/93 |
| 3,975,976 | 8/1976 | Prentice . | |
| 4,488,466 | 12/1984 | Jones . | |
| 4,529,114 | 7/1985 | Casper et al. | 225/100 |
| 4,589,784 | 5/1986 | Valle et al. | 400/56 |
| 4,623,081 | 11/1986 | Hain et al. . | |
| 5,255,008 | 10/1993 | Yoshida . | |
| 5,375,751 | 12/1994 | Mäkinen . | |
| 5,622,302 | 4/1997 | Ring | 225/4 |

FOREIGN PATENT DOCUMENTS

| | | | |
|---|---|---|---|
| 24 04 840 A1 | 8/1975 | (DE) . | |
| 28 39 236 A1 | 3/1979 | (DE) . | |
| 38 22 551 A1 | 1/1989 | (DE) . | |
| 0 105 748 A1 | 4/1984 | (EP) . | |
| 0 416 795 | 3/1991 | (EP) . | |
| 566522 | 1/1945 | (GB) . | |
| 06 091588 | 4/1994 | (JP) . | |
| 6-91588 | 4/1994 | (JP) | B26D/1/06 |
| 8-248706 | 9/1975 | (JP) | G03G/15/00 |
| 50-96136 | 7/1975 | (JP) | G06K/15/16 |
| WO 93/14937 A | 8/1993 | (WO) . | |

OTHER PUBLICATIONS

L.L. Amundson, et al., IBM Technical Disclosure Bulletin, "Document Burster", vol. 16, No. 6, Nov. 1973, pp. 1753–1754.

Patent Abstracts Of Japan, vol. 18, No. 354 (M–1632), Jul. 5, 1994 (abstract).

*Primary Examiner*—M. Rachuba
(74) *Attorney, Agent, or Firm*—Sughrue, Mion, Zinn, Macpeak & Seas, PLLC

(57) ABSTRACT

A continuous paper cutting unit including a press mechanism for pressing and holding both sides of the perforations of continuous paper by a press means link mechanism, and a cutting mechanism like a blunt instrument using a cutting means link mechanism. With the appropriate placement of the paper guides, the transport of the continuous paper is smooth and the cutting of the continuous paper along the perforations thereof is preformed reliably using a small drive force.

3 Claims, 53 Drawing Sheets

32
35a
43(W2)
41b
37
43
33
50
C
33b
65
43(W1)
36
41a
33a
34a
66
31
35
61
80(81)
34
80

(STANDBY STATE)

(DURING CUTTING)

(ROTATION END STATE)

(STANDBY STATE)

(JUST BEFORE CUTTING)

(AFTER CUTTING)

FIG.30(a) (STANDBY STATE) FIG.30(b)
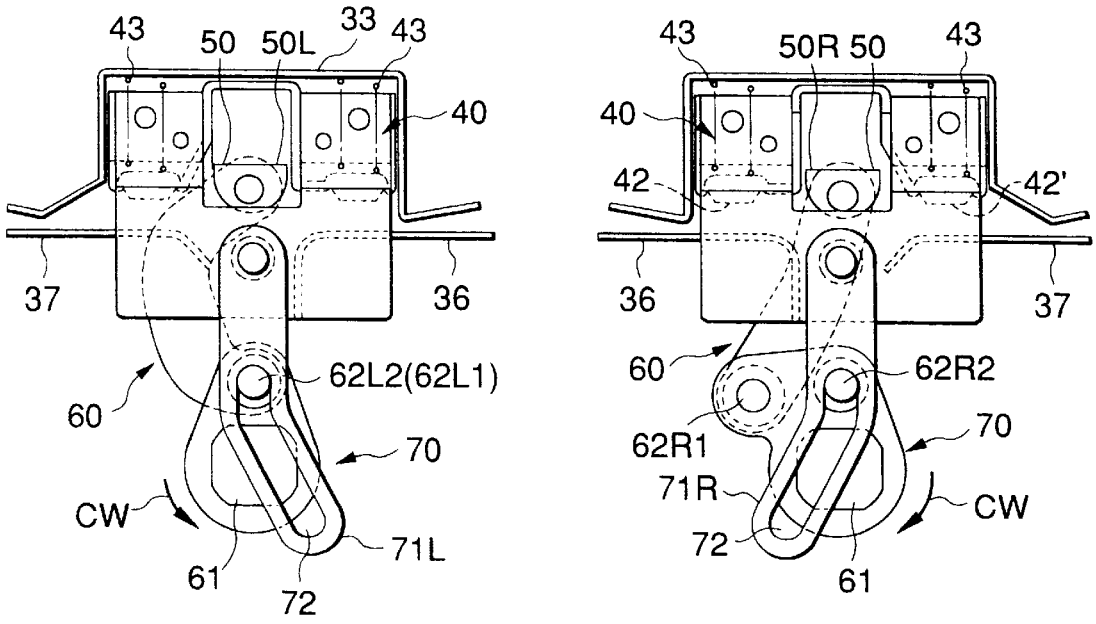
FIG.30(c)
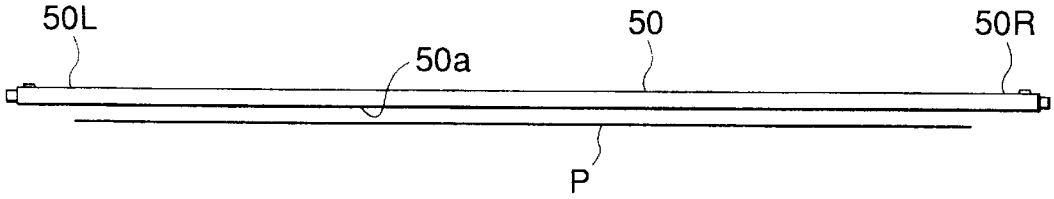

CONTINUOUS PAPER CUTTING UNIT

This is a divisional of application Ser. No. 08/919,782 filed Aug. 29, 1997, now U.S. Pat. No. 6,468,170, the disclosure of which is incorporated herein by reference.

BACKGROUND OF THE INVENTION

1. Field of the Invention

This invention relates to a continuous paper cutting unit for cutting perforated continuous paper along the line of perforations.

2. Related Art

A conventional continuous paper cutting unit is shown in FIG. 56 as described in Japanese Patent Laid-Open No. Hei 6-91588.

FIG. 56(*a*) depicts a continuous paper cutting unit 1. Continuous paper 2 having perforations engages a pin tractor 3 and is taken into the continuous paper cutting unit 1. The continuous paper 2 fed from the pin tractor 3 is transported by means of a paper feed roller 4 and a pinch roller 5 and is further transported past paper cutting boards 6 and 7, which also function as paper reception beds, by means of a paper discharge roller 8 and a pinch roller 9. The continuous paper 2 is transported so that its perforations are positioned in a gap between the boards 6 and 7, and the paper 2 is cut at the perforation position. The cut paper is transported one sheet at a time from the paper reception beds 6, 7 by the paper discharge roller 8 and the pinch roller 9 and stored in a stacker 10.

In the paper cutting portion of FIG. 56(*b*), shafts 11 each having a flange 18 penetrate paper pressers 12 and 12' and are fixedly secured to a cutter blade attachment member 13. A crank 15 attached to a drive shaft 14 transmits motion produced by rotation of the drive shaft 14 via a connecting rod 16 to the cutter blade attachment member 13. The motion produced by rotation of the drive shaft 14 is reciprocating motion in the vertical direction because a shaft 17 fixedly secured to a cabinet (see FIG. 56 (*e*)) penetrates a hole of the cutter blade attachment member 13.

The paper pressers 12, 12' are supported by the flanges 18 of the shafts 11, and the cutter blade 19 and the paper pressers 12, 12' are at a sufficient distance from the paper reception beds 6, 7. At this point in time, the paper perforations are transported to the center of the gap between the paper reception beds 6 and 7 (see FIG. 56(*c*)). As the drive shaft 14 is rotated, the crank 15 rotates, thereby rotating the connecting rod 16 for lowering the cutter blade 19 which is fixedly secured to the cutter blade attachment member 13. As the cutter blade 19 falls, the shafts 11 also fall, so that the lower face of the paper pressers 12, 12' soon reach the paper reception beds 6, 7.

Although the paper pressers 12 and 12' abut the paper reception beds 6 and 7 and stop falling, the cutter blade 19 falls further while compressing springs 20, and the cutter blade 19 soon abuts the perforations of the paper 2, and tears the paper 2 along the perforations (see FIG. 56(*d*)). A large force acts on the paper 2 as the cutter blade 19 abuts the perforations, but the paper pressers 12 and 12' press the paper due to the repulsion of the spring 20. Thus, the paper 2 is not brought into the gap between the paper reception beds 6 and 7 and the cutter blade 19.

As the drive shaft 14 rotates, the cutter blade 19 rises and soon the paper pressers 12 and 12' are pulled up. Then, the paper feed roller 4 and the paper discharge roller 8 rotate to feed the cut paper 2 into the stacker 10 and transport the subsequent portion of continuous paper 2 forward to a predetermined position. The operational sequence is then repeated.

Japanese Patent Laid-Open No. Sho 50-96136 is an example of another conventional continuous paper cutting unit, and is shown in FIG. 57. In FIG. 57 (*a*), paper reception beds 21, 22 are placed on a paper discharge passage of a line printer, and continuous paper 2 is discharged from the line printer and guided to the reception beds 21, 22.

Up and down movable paper retainers 23, 24 which act as paper pressers, each having a flat friction face, are pressed down, as required, such that perforations 2*a* of the continuous paper 2 are positioned at a substantial center of a gap between the paper reception beds 21 and 22. The retainers 23, 24 press both sides of the perforations 2*a* of the continuous paper 2 against their respective reception bed faces 21, 22 throughout the paper width. The retainers 23 and 24 have rubberpieces 23*a* and 24*a* for providing a flat friction face at the tip of the retainers 23, 24.

To cut the paper 2 along the perforations 2*a*, the paper may be struck at the center throughout the paper width with an up and down movable plate-like blunt instrument 25, which is rounded at the tip 25*a*, such that both sides of the perforations 2*a* of the continuous paper 2 are sandwiched between the retainers 23 and 24 and the reception beds 21 and 22.

As shown in FIG. 57(*b*), a device having a rounded tip 25*a* shaped like a slope is used as the blunt instrument 25. Since such a blunt instrument would start to press the paper at a lowermost end part 25*a*', the act of cutting the paper is started at one end of the perforations 2*a* by using the lowermost end part 25*a*' of the blunt instrument 25, as shown in FIG. 57(*d*), to strike against the perforations 2*a*. Therefore, the paper cutting proceeds from one end of the perforations to the other end as the paper is torn off along the perforations, so that the paper can be cut smoothly.

In Japanese Patent Laid-Open No. Sho 50-96136, a rod 26 pivoting about one point 26*c* as it is swung downward is also disclosed as a blunt instrument, as shown in FIG. 57(*c*).

Problem 1

In the conventional continuous paper cutting unit shown in FIG. 56, after the paper pressers 12 and 12' abut the paper reception beds 6 and 7 and stop dropping, the cutter blade 19 must have fallen to the cutting position while the spring 20 is being compressed. Thus, a large drive force is required to lower the cutter blade 19. That is, a large drive force is required at cutting time.

Problem 2

In the conventional continuous paper cutting unit shown in FIG. 56, when the continuous paper 2 is fed or transported to the cutting unit, the edge of the continuous paper 2 easily strikes against the side face of the paper presser 12 or 12', thus a paper jam easily occurs.

Likewise, also in the conventional continuous paper cutting unit shown in FIG. 57, when the continuous paper 2 is fed or transported to the cutting unit, the edge of the continuous paper 2 easily strikes against the side face of the paper retainers 23 or 24, and a paper jam easily occurs.

That is, in both the conventional cutting units, it is hard to produce a smooth feed or transport state of continuous paper.

Problem 3

In both the conventional continuous paper cutting units, when continuous paper 2 is transported, the gap between the paper reception beds 6 and 7 (see FIG. 56(*b*)) or the gap between the reception beds 21 and 22 (see FIG. 57(*a*)) is open.

Thus, when continuous paper 2 is transported, it enters the gap, easily causing a paper jam to occur.

Problem 4

In the conventional continuous paper cutting unit shown in FIG. 56, when the continuous paper 2 is transported, a lower end 19*a* of the cutter blade 19 is positioned somewhat above the lower face (12'*a*) of the paper presser 12, 12', as seen in FIG. 56(*b*).

Therefore, when the continuous paper 2 is supplied to the cutting unit, the edge of the continuous paper 2 easily enters the gap between the paper pressers 12 and 12' (below the cutter blade 19), thus a paper jam easily occurs.

In the conventional cutting unit shown in FIG. 57, the opposed face 25*a* of the blunt instrument 25 to the continuous paper 2 is inclined as seen in FIG. 57(*b*), thus when the continuous paper 2 is transported, a part of the blunt instrument (at least the lowermost end part 25*a*') projects downward below the lower faces of the retainers 23 and 24, and other parts (at least the uppermost end part) are positioned somewhat above the lower faces of the retainers 23 and 24 as seen in FIG. 57(*a*). Alternatively, assuming that a part of the blunt instrument 25 does not project downward below the lower faces of the retainers 23 and 24, the opposed face 25*a* of the blunt instrument 25 to the continuous paper 2 is positioned in most portions somewhat above the lower faces of the retainers 23 and 24. The same goes for the blunt instrument 26 shown in FIG. 57(*c*).

Therefore, in the conventional cutting unit shown in FIG. 57, when the continuous paper 2 is supplied to the cutting unit, one side of the edge of the continuous paper 2 easily strikes against the portion of the blunt instrument 25 positioned below the lower faces of the retainers 23 and 24 (for example, near the lowermost end part 25*a*'). Alternatively, the other side of the edge of the continuous paper 2 easily enters the gap between the retainers 23 and 24 (below the blunt instrument). Thus, a paper jam easily occurs.

That is, in both the conventional cutting units, it is hard to produce a smooth feed state of continuous paper.

Problem 5

In the conventional continuous paper cutting unit shown in FIG. 56, the edge of the continuous paper 2 after being cut comes in contact with the rising cutter blade 19, curls upward, and easily strikes against the side face of the paper presser 12' placed downstream.

Likewise, also in the conventional continuous paper cutting unit shown in FIG. 57, the edge of the continuous paper 2 after being cut, comes in contact with the rising blunt instrument 25 (or 26), curls upward, and easily strikes against the side face of the retainer 24 placed downstream. Particularly, the opposed face 25*a* of the blunt instrument 25 to the continuous paper is inclined and the upper end part is positioned somewhat above the lower faces of the retainers 23 and 24, thus in the gap portion, the edge of the continuous paper curls up, for example, and easily strikes against the side face of the retainer 24 placed downstream.

That is, in both the conventional cutting units, it is hard to produce a smooth feed or transport state of continuous paper after cutting.

Problem 6

According to the conventional continuous paper cutting unit shown in FIG. 57, cutting of continuous paper 2 is started at one end of the perforations 2*a* (the left end in FIG. 57(*c*), namely, the cutting start part) and proceeds toward the other end (the right end in FIG. 57(*c*), namely, the cutting end part). Thus, unless the paper is pressed reliably from the cutting start part to the cutting end part, a smooth cutting operation is not achieved. Particularly, a large press force is required at the cutting start time, namely, at the cutting start part.

Further, the continuous paper 2 may have perforations 2*a* made to a side end margin 2*b* of the paper 2 as shown in FIG. 58(*a*) or may have perforations 2*a* that do not reach the side end margin 2*b* of the paper 2 as shown in FIG. 58(*b*). Accordingly, in order to cut the continuous paper 2 having perforations that do not reach the side end margin 2*b* as shown in FIG. 58(*b*), a still larger press force is required at paper cutting time.

No solutions to this problem are disclosed in Japanese Patent Laid-Open No. Sho 50-96136.

Problem 7

According to the conventional continuous paper cutting unit shown in FIG. 57, the continuous paper 2 is cut starting at one end of the perforations 2*a* (the left end in FIG. 57(*c*), namely, the cutting start part) and proceeds toward the other end (the right end in FIG. 57(*c*), namely, the cutting end part). Thus, the paper 2 is comparatively hard to cut at the cutting start part for the reasons stated above. However, once the cutting is started, comparatively smooth cutting proceeds.

On the other hand, as described above, the continuous paper 2 may have perforations 2*a* made to the side end margin 2*b* of the paper as shown in FIG. 58(*a*) or may have perforations 2*a* that do not reach the side end margin 2*b* as shown in FIG. 58(*b*). Therefore, the continuous paper 2 having the perforations that do not reach the side end margin 2*b* as shown in FIG. 58(*b*), is hard to cut, particularly in the cutting start part. The continuous paper 2 having perforations 2*a* made to the side end margin 2*b* of the paper as shown in FIG. 58 (*a*) is easy to cut in the cutting start part as compared with the continuous paper having perforations that do not reach the side end margin 2*b* as shown in FIG. 58(*b*), but remains hard to cut in the cutting start part as compared with the subsequent cutting.

No solutions to the problem are disclosed in Japanese Patent Laid-Open No. Sho 50-96136.

Problem 8

To cut continuous paper reliably in this kind of continuous paper cutting unit 1, the continuous paper 2 must be held reliably.

Problem 9

Usually, continuous paper having perforations is often folded in zigzags (side view) at the perforations (see FIG. 56(*a*)).

Thus, the folds may remain impressed in the paper 2 after the continuous paper 2 is transported to the inside of the cutting unit 1, and the continuous paper 2 may become deformed and have a convex or concave appearance at the perforations.

Under these circumstances, if the continuous paper 2 is simply pressed and held on both sides of the perforations 2*a*, the paper 2 still remains deformed. Therefore, at cutting time, the continuous paper 2 is loose due to deformation and becomes hard to cut.

Problem 10

When the continuous paper 2 is cut as shown in FIG. 57(*d*) in the conventional continuous paper cutting unit as shown in FIG. 57, a fold 2*c* may be left impressed in the continuous paper 2. Such a fold easily remains impressed in the paper 2 particularly when the perforations 2*a* shift largely from the center as indicated by 2*a*' in FIG. 57(*a*).

If an attempt is made to transport the continuous paper 2 to the right after cutting as shown in FIG. 57(*d*), for example, with the fold 2*c* remaining in the paper 2, the edge of the continuous paper 2 at the perforation 2*a* strikes against a side face 22*a* of the paper reception bed 22 located downstream in the paper transport direction, so that a paper jam may occur.

OBJECTS OF THE INVENTION

Accordingly, it is a first object of the invention to provide a continuous paper cutting unit which solves Problem 1 and requires only a small drive force to lower the cutter blade at cutting time.

It is a second object of the invention to provide a continuous paper cutting unit which solves Problem 2 and which prevents the edge of the continuous paper from striking against the side face of the paper presser and causing a paper jam, so that a smooth feed or transport state of continuous paper can be achieved.

It is a third object of the invention to provide a continuous paper cutting unit which solves Problem 3 and prevents continuous paper from entering the gap between the paper reception beds, such that a smooth transport state of continuous paper can be achieved without a paper jam occurring.

It is a fourth object of the invention to provide a continuous paper cutting unit which solves Problem 4 and prevents paper from entering the gap between the paper pressers and prevents one side of the edge of the paper from striking against the blunt instrument positioned below the lower faces of the retainers while another side of the edge of the paper enters the gap between the paper retainers. Thus, a smooth feed state of continuous paper can be achieved.

It is a fifth object of the invention to provide a continuous paper cutting unit which solves Problem 5 and prevents the edge of the continuous paper from curling up and contacting the rising cutter blade and striking the side face of the paper presser placed downstream, such that a smooth feed or transport state of continuous paper can be achieved.

It is a sixth object of the invention to provide a continuous paper cutting unit which solves Problem 6 and does not require a large press force to cut the paper smoothly from the cutting start part to the cutting end part.

It is a seventh object of the invention to provide a continuous paper cutting unit which solves Problem 7 and allows the continuous paper to be cut as smoothly at the cutting start part as at the cutting end part.

It is an eighth object of the invention to provide a continuous paper cutting unit which solves Problem 8 and which allows the paper to be held reliably so that it is cut reliably.

It is a ninth object of the invention to provide a continuous paper cutting unit which solves Problem 9 and prevents folds in the paper so that the paper can be cut smoothly.

Finally, it is a tenth object of the invention to provide a continuous paper cutting unit which solves Problem 10, and prevents folds in the paper from striking the edge of the paper at the perforation and against a side face of the paper reception bed, such that a paper jam is prevented.

SUMMARY OF THE INVENTION

To accomplish the first object of the invention, there is provided a continuous paper cutting unit for cutting continuous perforated paper along the perforations, the cutting unit comprising means for supporting continuous paper to be cut on both sides of the perforations of the paper, press means capable of pressing the continuous paper on both sides of the perforations between the press means and the support means, means for always energizing the press means toward the support means, cutting means extending in the same direction as the perforations of the continuous paper to be cut and being longer than the perforations, a cutting means link mechanism for holding the cutting means at a standby position, moving the cutting means toward the perforations at cutting operation time, and returning the cutting means to the standby position after the perforations are cut, and a press means link mechanism for holding the press means at a standby position against an energization force of the energization means, allowing the energization force to move the press means to the support means at cutting operation time, the press means link mechanism being freed from support of the press means after the press means is pressed against, the support means via the continuous paper, and returning the press means to the standby position after the continuous paper is cut by the cutting means.

Preferably, the cutting means link mechanism and the press means link mechanism are driven by a single common drive shaft. Preferably, the cutting means has an abutment part against the continuous paper, shaped like a circular arc when viewed from a perforation direction. Further, preferably the cutting means link mechanism comprises an arm pivoting with the drive shaft and a connecting rod connected pivotably to the arm and the cutting means and wherein the press means link mechanism comprises an arm pivoting with the drive shaft and a connecting rod connected pivotably to the arm and the press means, and the connecting rod and the arm or the press means are connected slidably via a long hole. Preferably, the drive shaft is reversely rotated and is returned to the standby position after the continuous paper is cut by the cutting means.

To accomplish the second object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for guiding one face of the continuous paper when the continuous paper is transported and supporting the continuous paper on the face on both sides of the perforations when the continuous paper is once stopped, press means having a pair of press parts placed so as to be able to advance and retract with respect to the pair of support means and capable of pressing the continuous paper on both sides of the perforations between the press parts and the support means when the continuous paper is once stopped, cutting means being placed between the paired press parts for cutting the continuous paper along the perforations, and guide means being placed facing the upstream support means in a continuous paper transport direction, of the pair of support means, for forming a continuous paper supply port between the guide means and the support means and guiding an opposite face of the continuous paper passing through the supply port, wherein a spacing between an opposed face of at least the upstream press part in the continuous paper transport direction of the pair of press parts to the continuous paper and a continuous paper support face of the upstream support means when the continuous paper is transported, is made larger than a spacing between the guide means at the supply port and the continuous paper support face of the upstream support means.

Further, the guide means is also placed facing the downstream support means in a continuous paper transport direction of the pair of support means for forming a continuous paper discharge port between the guide means and the support means, and the guide means has an inclined paper guide face for guiding an opposite face of the continuous paper directed for the discharge port, wherein a spacing between an upstream end of the inclined paper guide face and a continuous paper support face of the downstream support means is made large and a spacing between the guide means at the discharge port and the continuous paper support face of the downstream support means is made small as compared with a spacing between an opposed face of the downstream press part in the continuous paper transport direction of the pair of press parts to the continuous paper and a continuous paper support face of the downstream support means when the continuous paper is transported.

Further, means is provided for guiding the advancing and retracting of the press means, and a cutting means is placed between the paired press parts for cutting the continuous paper along the perforations, wherein a part of the guiding means is placed facing the upstream support means in a continuous paper transport direction, of the pair of support means, for forming a continuous paper supply port between the part of the guiding means and the support means and a guide for guiding an opposite face of the continuous paper passing through the supply port.

Further, a part of the guiding means is also placed facing the downstream support means in a continuous paper transport direction, of the pair of support means, for forming a continuous paper discharge port between the part of the guiding means and the support means and a guide for guiding an opposite face of the continuous paper directed for the discharge port.

Further, the cutting means is placed between the paired press parts for cutting the continuous paper along the perforations, wherein the press part has a continuous paper press face parallel with the continuous paper support face of the support means and a slope contiguous with the continuous paper press face on an upstream side in a continuous paper transport direction and inclined so as go away from the support face toward the upstream side.

Preferably, the press means is formed with a gentle projection covering an end margin of the slope when viewed from the upstream side in the continuous paper transport direction. Preferably, the cutting means has an abutment part which abuts against the continuous paper to be cut, which is shaped like a circular arc when viewed from a perforation direction, which extends in the same direction as the perforations of the paper, and which is longer than the perforations, and the cutting unit further includes a cutting means link mechanism for holding the cutting means so that the abutment part becomes substantially parallel with the continuous paper support face of the support means at a distance substantially equal to a distance between the press part and the support face when the continuous paper is transported, and moving the cutting means to the perforations with the cutting means inclined to the continuous paper when the continuous paper is cut. Preferably, a part of the press means forms a guide face for guiding the continuous paper between the press part positioned downstream in the continuous paper transport direction from the cutting means and the downstream support means of the pair of support means between the downstream press part and the cutting means at the continuous paper transport time. Preferably, the cutting means link mechanism holds the cutting means when the continuous paper is transported so that the abutment part becomes substantially parallel with the support face at a distance a little longer than the distance between the support face and the press part. Preferably, the cutting means link mechanism comprises a drive shaft, a pair of arms being disposed at both ends of the drive shaft for pivoting with the drive shaft, and a pair of connecting rods being connected to the arms and both ends of the cutting means, wherein a connection part of one arm and one connection rod and a connection part of the other arm and the other connection rod are placed out of phase with respect to a portion around the drive shaft.

To accomplish the third object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for guiding the continuous paper when the continuous paper is transported and supporting the continuous paper on both sides of the perforations when the continuous paper is once stopped, a slit-like cutting space formed between the paired support means, press means having a pair of press parts capable of pressing the continuous paper on both sides of the perforations between the press parts and the support means when the continuous paper is once stopped, cutting means passing through the cutting space from one face of the continuous paper to an opposite face when the continuous paper is once stopped, thereby cutting the continuous paper along the perforations, and moving guide means facing the cutting space and guiding the continuous paper when the continuous paper is transported and retracting from the cutting space when the cutting means cuts the continuous paper.

The moving guide means can retract in a direction orthogonal to a length direction of the slit-like cutting space. In this case, preferably the cutting means is moved by rotation of a drive shaft placed in parallel with the slit-like cutting space and wherein the moving guide means is attached to the drive shaft and rotating with the drive shaft. Preferably, the pair of support means is formed with notches like comb teeth in end margins facing the cutting space and wherein the moving guide means is formed with ribs entering the notches, the ribs forming a guide face of the continuous paper.

Further, the moving guide means also face the cutting space and guide the continuous paper when the continuous paper is transported and retract the cutting space along a direction of movement of the cutting means when the cutting means cuts the continuous paper. In this case, preferably the pair of support means is disposed on an opposed side of the pair of support means to a side where the press means is placed, the pair of support parts being disposed along the direction of movement of the cutting means for forming a guide part of the moving guide means. Preferably, the moving guide means abuts the cutting means when it retracts, whereby the moving guide means moves with the cutting means.

To accomplish the fourth object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for supporting continuous paper on both sides of the perforations of the paper when the continuous paper is once stopped, press means having a pair of press parts capable of pressing the continuous paper on both sides of the perforations between the press parts and the support means, cutting means being placed between the paired press parts and having an abutment part which abuts against the continuous paper to be cut, shaped like a circular arc when viewed from a perforation direction, extending in the same direction as the perforations of the paper, and being longer than the perforations, and a cutting means link mechanism for holding the cutting means so that the abutment part becomes substantially parallel with the continuous paper support face of the support means at a distance substantially equal to a distance between the press part and the support face when the continuous paper is transported, and moving the cutting means to the perforations with the cutting means inclined to the continuous paper when the continuous paper is cut.

Preferably, a part of the press means forms a guide face for guiding the continuous paper between the press part positioned downstream in the continuous paper transport direction from the cutting means and the downstream support means of the pair of support means between the downstream press part and the cutting means at the continuous paper transport time. Preferably, the cutting means link mechanism holds the cutting means when the continuous paper is transported so that the abutment part becomes substantially parallel with the support face at a distance a little longer than the distance between the support face and the press part. Preferably, the cutting means link mechanism comprises a drive shaft, a pair of arms being disposed at both ends of the drive shaft for pivoting with the drive shaft, and a pair of connecting rods being connected to the arms and both ends of the cutting means, wherein a connection part of one arm and one connection rod and a connection part of the other arm and the other connection rod are placed out of phase with respect to a portion around the drive shaft.

To accomplish the fifth object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for guiding one face of the continuous paper when the continuous paper is transported and supporting the continuous paper on the face on both sides of the perforations when the continuous paper is once stopped, press means having a pair of press parts placed so as to be able to advance and retract with respect to the pair of support means and capable of pressing the continuous paper on both sides of the perforations between the press parts and the support means when the continuous paper is once stopped, and cutting means being placed between the paired press parts for cutting the continuous paper along the perforations, wherein the cutting means has an abutment part against the continuous paper to be cut, shaped like a circular arc when viewed from a perforation direction, extending in the same direction as the perforations of the paper, and being longer than the perforations and wherein a lower face of the abutment part becomes parallel with a continuous paper support face of the downstream support means at a small distance as compared with a distance of a spacing between an opposed face of at least the downstream press part in a continuous paper transport direction, of the pair of press parts, to the continuous paper and the continuous paper support face of the downstream support means when the continuous paper is transported. Preferably, the continuous paper cutting unit further includes guide means being placed facing the upstream support means in a continuous paper transport direction, of the pair of support means, for forming a continuous paper supply port between the guide means and the support means and guiding an opposite face of the continuous paper passing through the supply port, wherein a spacing between an opposed face of at least the upstream press part in the continuous paper transport direction of the pair of press parts to the continuous paper and a continuous paper support face of the upstream support means when the continuous paper is transported is made larger than a spacing between the guide means at the supply port and the continuous paper support face of the upstream support means. Preferably, the continuous paper cutting unit further includes guide means being placed facing the downstream support means in a continuous paper transport direction, of the pair of support means, for forming a continuous paper discharge port between the guide means and the support means and having an inclined paper guide face for guiding an opposite face of the continuous paper directed for the discharge port, wherein a spacing between an upstream end of the inclined paper guide face and a continuous paper support face of the downstream support means is made large and a spacing between the guide means at the discharge port and the continuous paper support face of the downstream support means is made small as compared with a spacing between an opposed face of the downstream press part in the continuous paper transport direction of the pair of press parts to the continuous paper and a continuous paper support face of the downstream support means when the continuous paper is transported. Preferably, the continuous paper cutting unit further includes means for guiding, advancing and retracting of the press means, a part of the guiding means being placed facing the upstream support means in a continuous paper transport direction, of the pair of support means, for forming a continuous paper supply port between the part of the guiding means and the support means, and a guide for guiding an opposite face of the continuous paper passing through the supply port. Preferably, the continuous paper cutting unit further includes means for guiding, advancing and retracting of press means, a part of the guiding means being placed facing the downstream support means in a continuous paper transport direction, of the pair of support means, for forming a continuous paper discharge port between the part of the guiding means and the support means, and a guide for guiding an opposite face of the continuous paper directed for the discharge port. Preferably, the continuous paper cutting unit further includes a cutting means link mechanism for moving the cutting means to the perforations with the cutting means inclined to the continuous paper when the continuous paper is cut. Preferably, the cutting means link mechanism comprises a drive shaft, a pair of arms being disposed at both ends of the drive shaft for pivoting with the drive shaft, and a pair of connecting rods being connected to the arms and both ends of the cutting means, wherein a connection part of one arm and one connection rod and a connection part of the other arm and the other connection rod are placed out of phase with respect to a portion around the drive shaft.

To accomplish the sixth and seventh objects of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for supporting continuous paper on both sides of the perforations of the paper when the continuous paper is once stopped, press means having a pair of press parts capable of pressing the continuous paper on both sides of the perforations between the press parts and the support means, and cutting means being placed between the paired press parts and having an abutment part against the continuous paper to be cut, shaped like a circular arc when viewed from a perforation direction and being made longer than the perforations, the abutment part moving to the perforations with the abutment part inclined to the continuous paper when the continuous paper is cut. To accomplish the sixth object of the invention, a press force of the press means against the continuous paper in a cutting start part of the cutting means is set large as compared with the press force in a cutting end part.

To accomplish the seventh object of the invention, in the cutting means, an abutment angle of the abutment part against a cutting start part of the continuous paper is made large as compared with an abutment angle against a cutting end part of the continuous paper.

To accomplish the eighth object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for supporting continuous paper on both sides of the perforations of the paper when the continuous paper is once stopped, press means having a pair of press parts for defining a passage through which the continuous paper passes between the press parts and the support means when the continuous paper is transported and being energized by energization means for pressing the continuous paper on both sides of the perforations between the press parts and the support means when the continuous paper is cut, and cutting means being placed between the paired press parts and moving from one face of the continuous paper to an opposite face when the continuous paper is once stopped, thereby cutting the continuous paper along the perforations, wherein the pair of press parts car, swing independently of each other for the support means. Preferably, the pair of press parts is positioned near the perforations when the continuous paper is transported when viewed from a perforation direction and swings so as to go away from the perforations when the continuous paper is pressed between the press parts and the support means.

Further, the press means comprises the pair of press parts coming in contact with the continuous paper, a moving frame to which the press parts are attached, and an extremely elastic member placed between the moving frame and the press parts. Preferably, the pair of press parts can swing independently of each other for the support means.

To accomplish the ninth object of the invention, there is provided a continuous paper cutting unit for transporting continuous paper having perforations in a direction orthogonal to the perforations, once stopping the continuous paper, and cutting the continuous paper along the perforations at the stop time, the cutting unit comprising a pair of support means for supporting continuous paper on both sides of the perforations of the paper when the continuous paper is once stopped, press means having a pair of press parts for defining a passage through which the continuous paper passes between the press parts and the support means when the continuous paper is transported and being energized by energization means for pressing the continuous paper on both sides of the perforations between the press parts and the support means when the continuous paper is cut, and cutting means being placed between the paired press parts and moving from one face of the continuous paper to an opposite face when the continuous paper is once stopped, thereby cutting the continuous paper along the perforations, the pair of press parts being made of taper-like elastic members becoming thicker as they go away from the perforations. Preferably, the pair of press parts is positioned near the perforations when the continuous paper is transported when viewed from a perforation direction and moves so as to go away from the perforations when the continuous paper is pressed between the press parts and the support means.

To accomplish the tenth object of the invention, according to the invention, there is provided a continuous paper cutting unit for transporting continuous paper having perforations in a direction orthogonal to the perforations, once stopping the continuous paper, pressing and holding the continuous paper on both sides of the perforations at the stop time, moving a cutting member like a blunt instrument from one face of the continuous paper to an opposite face, and tearing the continuous paper along the perforations, then again transporting the continuous paper, the cutting unit comprising a support member for supporting and guiding the continuous paper at least on an upstream side in a transport direction of the continuous paper when the continuous paper is transported, wherein the continuous paper is once transported upstream before it is transported again after the continuous paper is cut, then transported downstream.

BRIEF DESCRIPTION OF THE DRAWINGS

Other features and advantages of the invention will be apparent from the following description taken in connection with the accompanying drawings, wherein:

FIGS. 30(*a*)–(*c*) mainly show the operation at the standby time of the cutting means 50, the cutting means link mechanism 60, and the press means link mechanism 70 of the second embodiment of the invention; (a) is a left side view, (b) is a right side view, and (c) is a front view of the cutting means 50;

DESCRIPTION OF THE PREFERRED EMBODIMENTS

Referring now to the accompanying drawings, there are shown the following preferred embodiments of the invention.

First embodiment

Figures 1A, 1B, 1C, 1D:
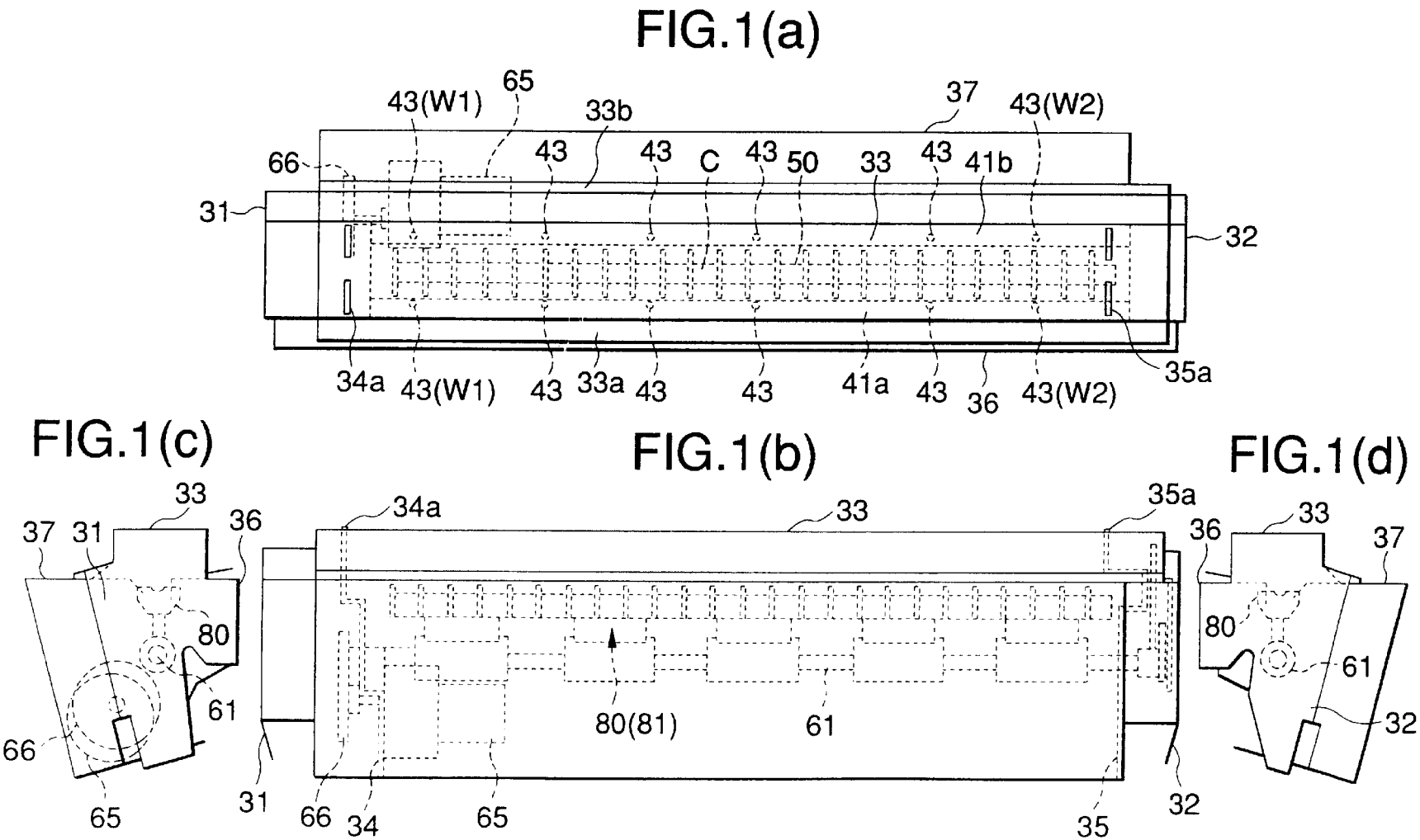
FIGS. 1(*a*)–1(*d*) show an outline of a first embodiment of a continuous paper cutting unit according to the invention; (a) is a plan view, (b) is a front view, (c) is a left side view, and (d) is a right side view.
Figure 2A:
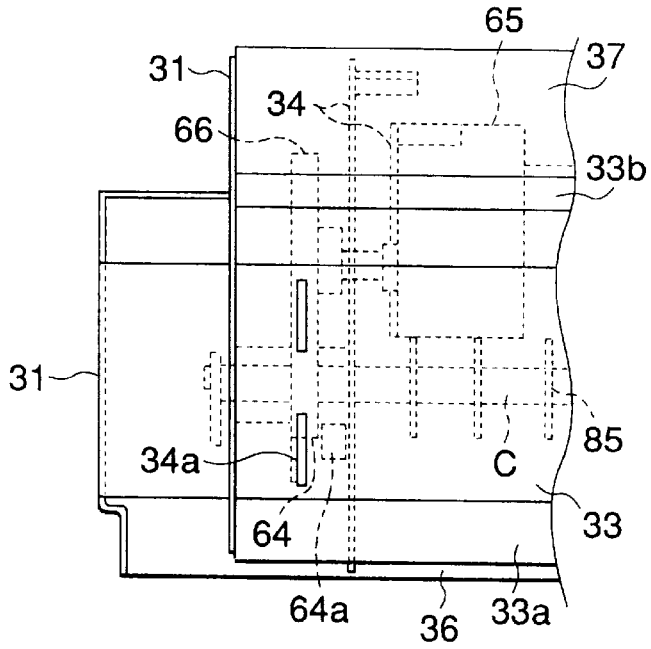
FIGS. 2(*a*)–2(*c*) are enlarged views of the left parts in FIGS 1(*a*)–1(*d*); (a) is a fragmentary plan view, (b) is a fragmentary front view, and (c) is a left side view.
Figure 2C:
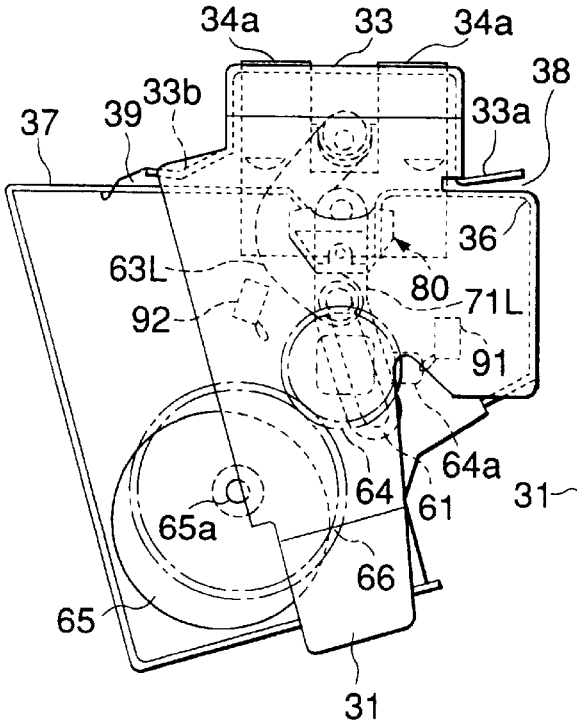
Figure 2B:
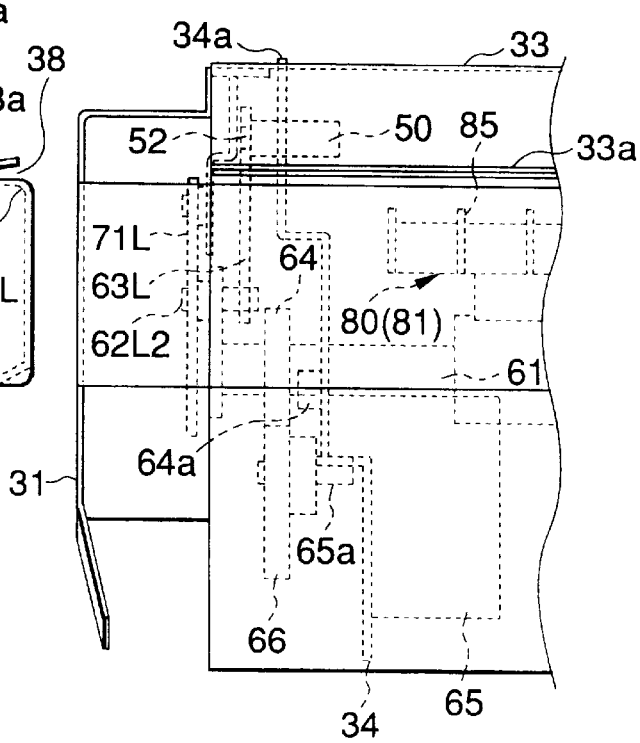
Figure 3A:
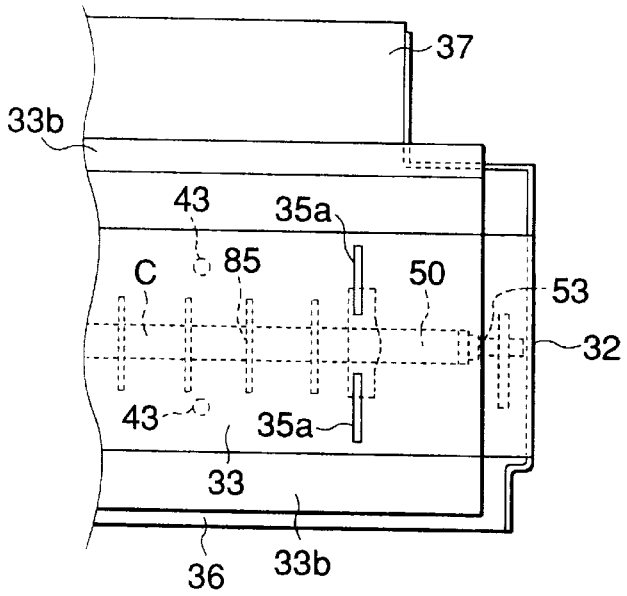
FIGS. 3(*a*)–3(*c*) are enlarged views of the right parts in FIG. 1;(*a*) is a fragmentary plan view, (b) is a fragmentary front view, and (c) is a right side view.
Figure 3B:
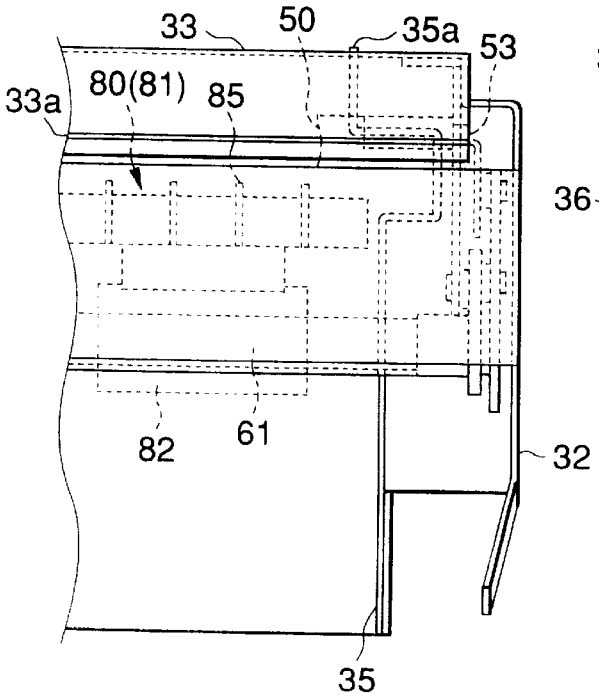
Figure 3C:
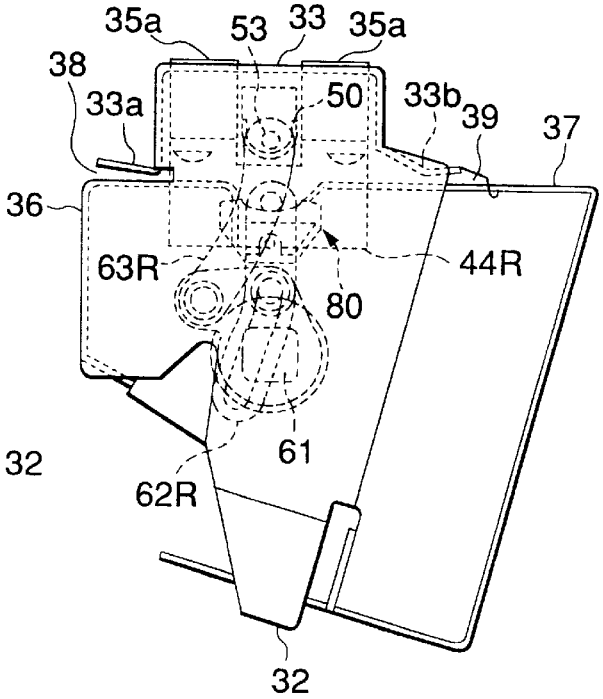

FIGS. 1(*a*)–(*d*) show an outline of a first embodiment of a continuous paper cutting unit according to the invention; (a) is a plan view, (b) is a front view, (c) is a left side view, and (d) is a right side view. FIGS. 2(*a*)–(*c*) show enlarged views of the left sections in FIGS. 1(*a*)–(*d*); (a) is a fragmentary plan view, (b) is a fragmentary front view, and (c) is a left side view. FIGS. 3(*a*)–(*c*) show enlarged views of the right sections in FIGS. 1(*a*)–(*d*); (a) is a fragmentary plan view, (b) is a fragmentary front view, and (c) is a right side view.

In FIGS. 1(*a*)–(*d*), 2(*a*)–(*c*) and 3(*a*)–(*c*), numerals 31 and 32 are side frames placed left and right, numeral 33 is an upper frame, numerals 34 and 35 are subframes placed a little more inwardly than the side frames 31 and 32, numeral 36 is a paper feed guide placed on the front side of the unit, and numeral 37 is a paper discharge guide placed on the rear side of the unit. The frames 31–35, the paper feed guide 36, and the paper discharge guide 37 are coupled at proper points to each other in one piece, making up the whole unit frame.

The paper feed guide 36 and the paper discharge guide 37 form a pair of support means for guiding continuous paper when the continuous paper is transported and supported on one face of the continuous paper (in the embodiment, lower face) which is cut on both sides of perforations, as described below. The paper feed guide 36 provides the support means positioned upstream in the continuous paper transport direction and the paper discharge guide 37 provides the support means positioned downstream in the continuous paper transport direction.

As shown in FIGS. 2 and 3, a front lower end part 33a of the upper frame 33 is bent so that it is placed facing the paper feed guide 36, and a slit-like paper feed port 38 is formed between the front lower end part 33*a* and the paper feed guide 36. A rear lower end part 33*b* of the upper frame 33 is bent so that it is placed facing the paper discharge guide 37, and a slit-like paper discharge port 39 is formed between the rear lower end part 33*b* and the paper discharge guide 37. The front lower end part 33*a* of the upper frame 33 forms a guide for guiding the other face of continuous paper passing through the supply port 38 (in the embodiment, upper face) and the rear lower end part 33*b* forms a guide having a paper guide face for guiding the other face of the continuous paper directed for the discharge port 39.

Figure 4:
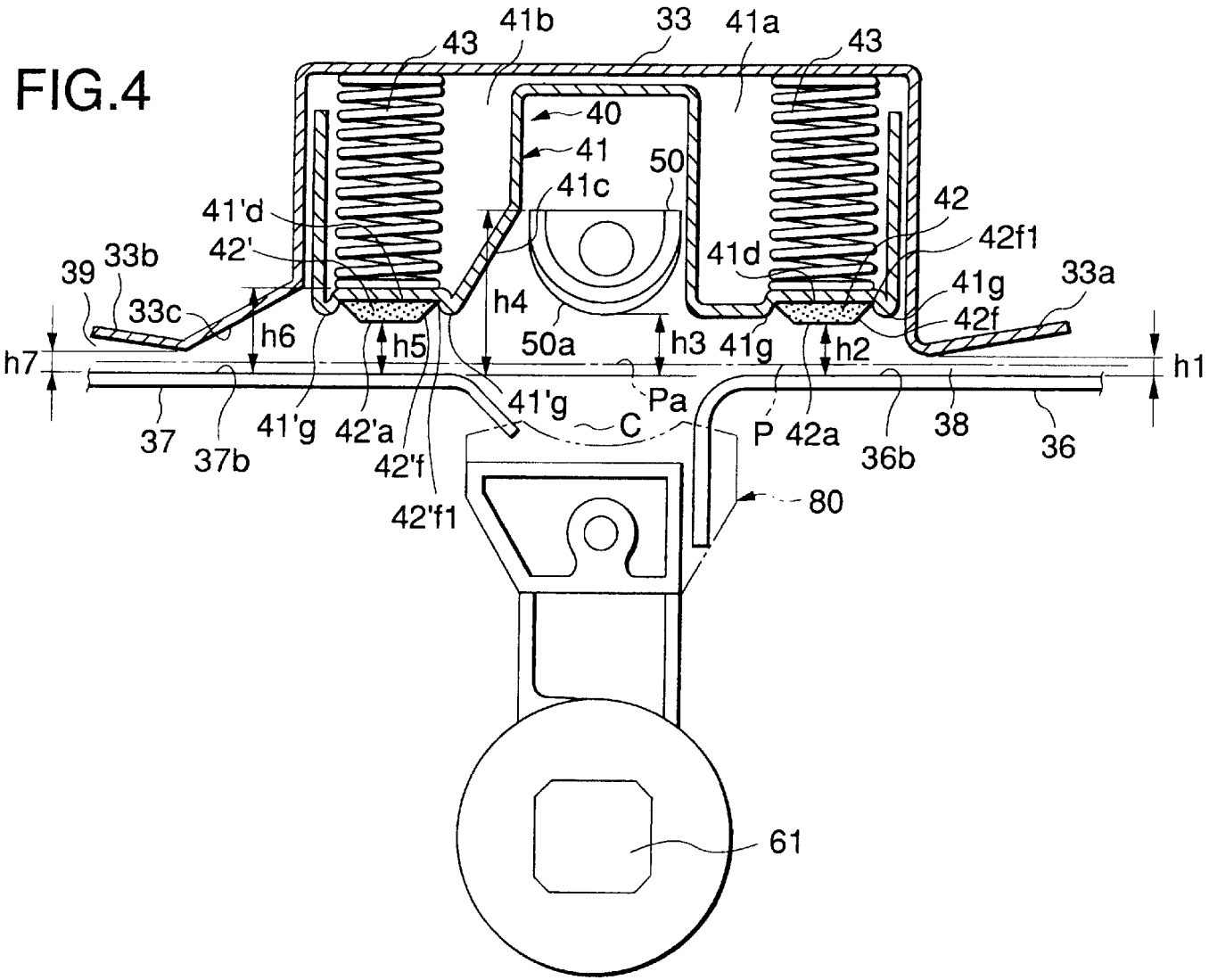
FIG. 4 is an enlarged left sectional view to mainly show an upper frame 33, a paper feed guide 36, a paper discharge guide 37, press means 40, and cutting means 50.
Figure 5:
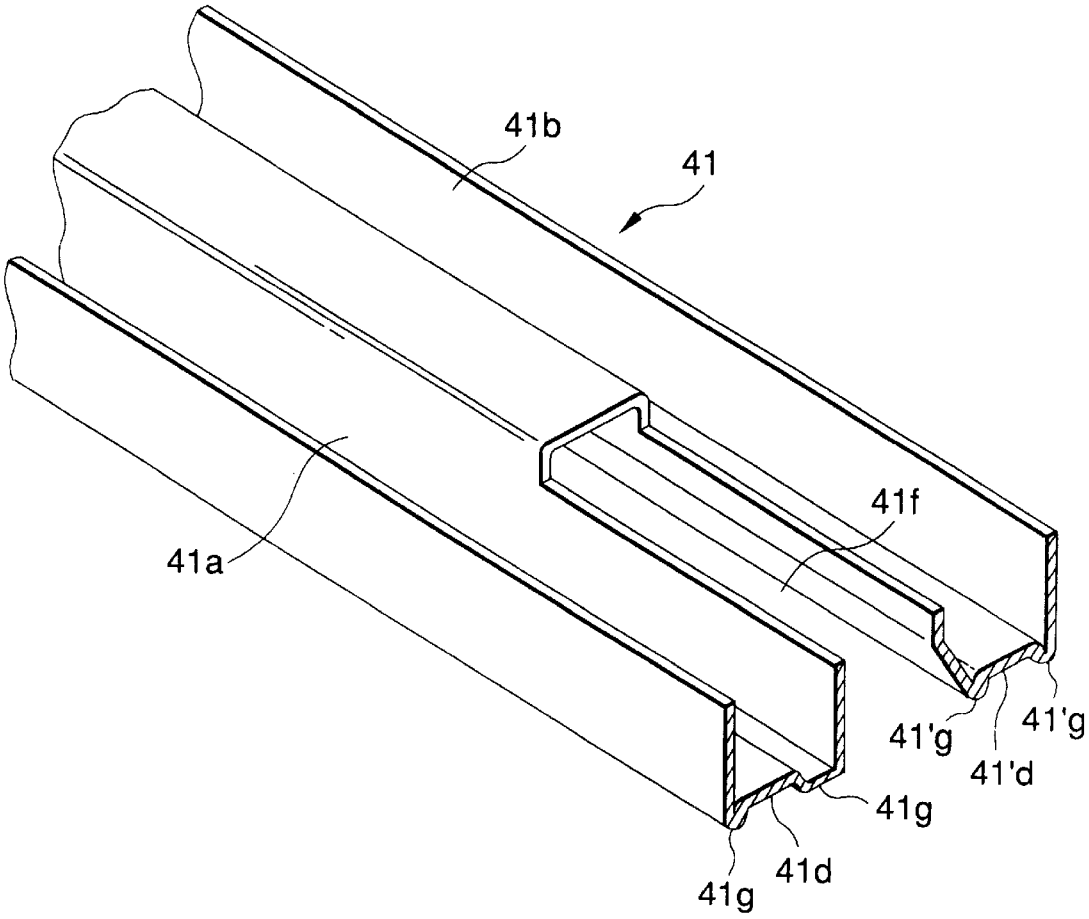
FIG. 5 is a fragmentary perspective view to show a moving frame 41 of the press means 40.

FIG. 4 is an enlarged left sectional view to mainly show the upper frame 33, the paper feed guide 36, the paper discharge guide 37, press means 40, and cutting means 50. FIG. 5 is a fragmentary perspective view to show a moving frame of the press means 40.

In FIG. 4, P denotes continuous paper to be cut and Pa denotes perforations. The continuous paper P is transported from the paper feed port 38 to the paper discharge port 39. C denotes a slit-like cutting space formed between the paper feed guide 36 and the paper discharge guide 37.

The press means 40 comprises a moving frame 41 shaped substantially like an inverse recess as a whole (see FIG. 5) and press plates 42 and 42' disposed at the lower end of the moving frame 41. The press plates 42 and 42' make up a pair of press parts.

The press means 40 is placed so that it is guided on the inner face of the upper frame 33 acting as guide means and can move forward and backward relative to a pair of the guide means 36 and 37; when the continuous paper P once stops, it is pressed on both sides of the perforations Pa between the press means 40 and the guide/support means 36, 37, as described below.

The moving frame 41 is formed with a guide face 41*c* for guiding continuous paper between the press part 42' positioned downstream in the continuous paper transport direction from the cutting means 50 and the guide/support means 37 positioned downstream from the guide/support means 36 between the press part 42' and the cutting means 50.

The press plates 42, 42' are made of an elastic substance such as rubber and are trapezoidal in cross section. That is, they have a continuous paper press face parallel with a continuous paper P support face 36*b*, 37*b* of the guide/support means 36, 37 (in the embodiment, a lower face 42*a*, 42'*a*) and slopes 42*f*, 42'*f* contiguous with the continuous paper press face on the upstream side in the continuous paper transport direction (in FIG. 4, the right) and inclined to the upstream side so that it goes away from the support face 36*b*, 37*b*. The slopes 42*f*, 42'*f* form a guide face of the continuous paper P.

Both side parts 41*g* and 41*g*, 41'*g* and 41'*g* (see FIG. 5) of the press plate 42, 42' on an attachment face 41*d*, 41'*d* of the press plate 42, 42' project relative to the attachment face. That is, the moving frame 41 of the press means is formed with moderate projections 41*g* and 41'*g* covering end margin parts 42*f*1 and 42'*f*1 of the slopes 42*f* and 42'*f* of the press plates when viewed from the upstream side in the continuous paper transport direction. The lower ends of the projections 41g and 41'g are positioned above the lower faces 42a and 42'a of the press plates 42 and 42'.

Figure 6A:
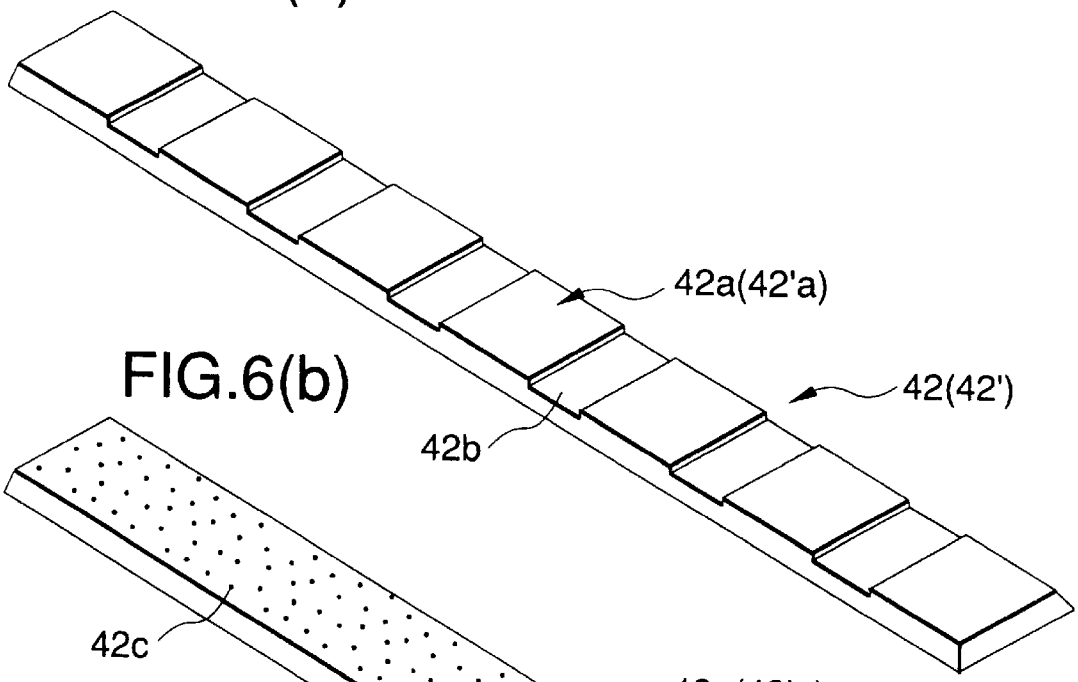
FIG. 6(*a*), (*b*), and (*c*) are perspective views to show examples of a press plate 42, 42'.
Figure 6B:
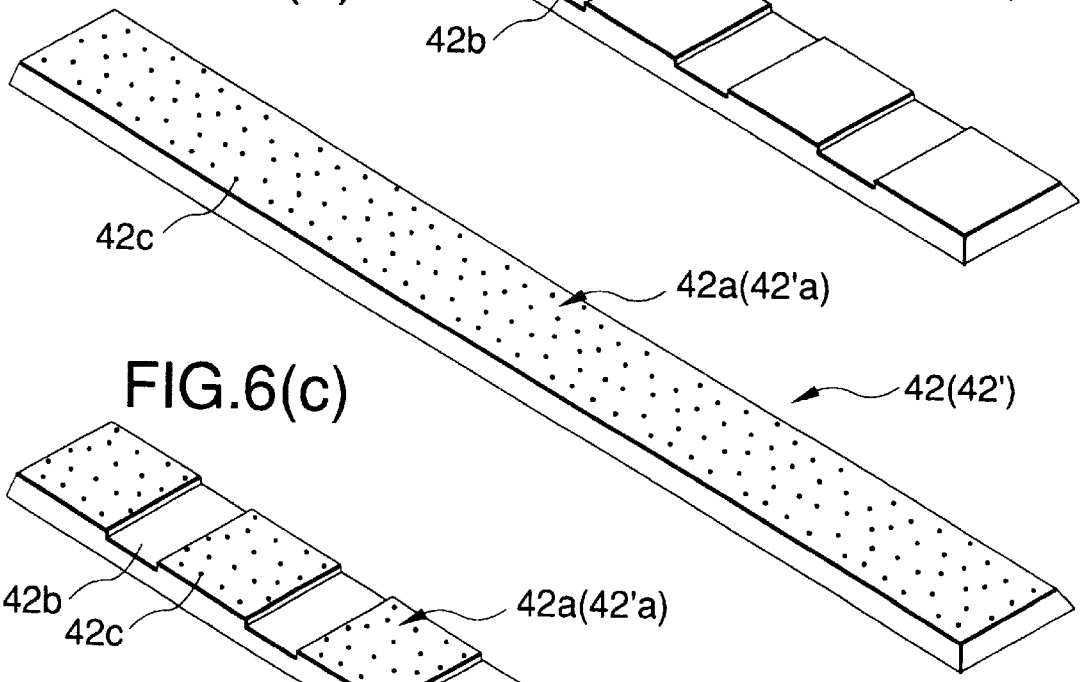
Figure 6C:
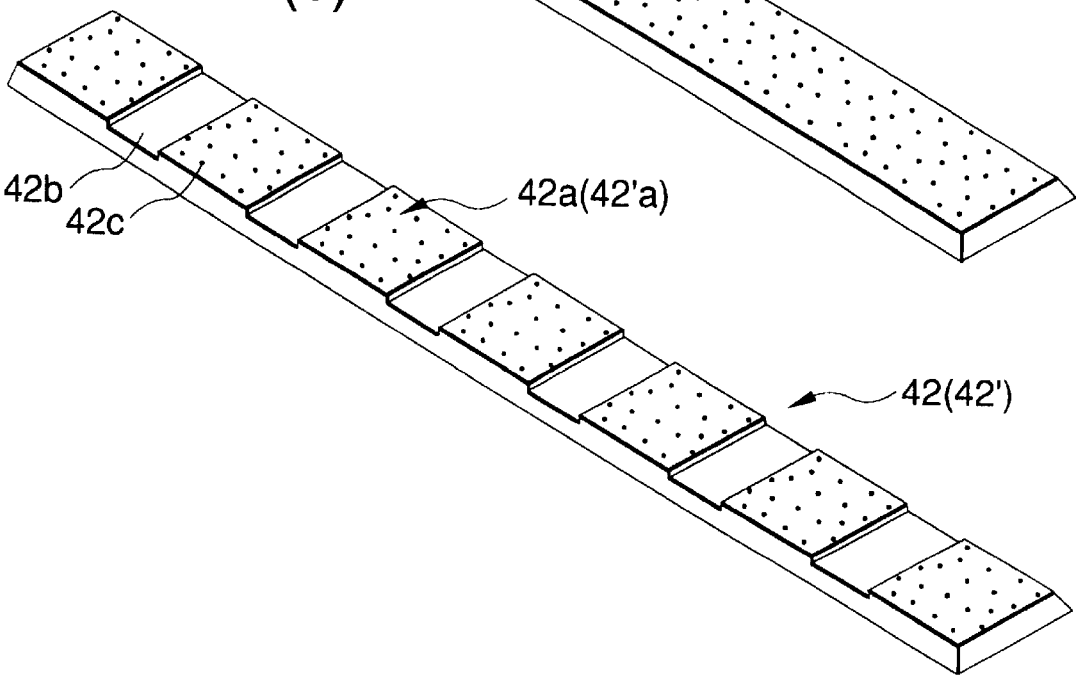

Since the press plates 42 and 42' press the continuous paper P on the lower faces 42a and 42'a as described below, preferably the lower face 42a, 42'a is formed with a plurality of grooves 42b as shown in FIG. 6(a), microscopic asperities 42c (made by so-called crimping) as shown in FIG. 6(b), or grooves 42b and microscopic asperities 42c (made by crimping) as shown in FIG. 6(c). Such a structure can prevent paper powder deposited on the lower face 42a, 42'a from lowering a press force or frictional force against the continuous paper P.

Figure 7A:
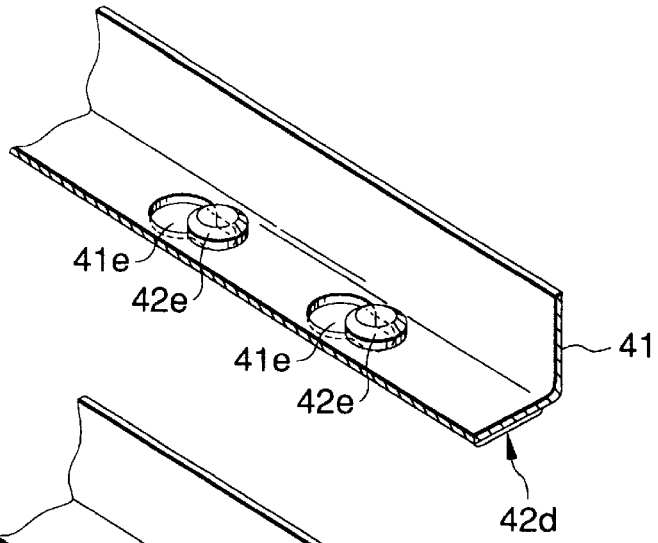
FIG. 7(*a*) is a fragmentary perspective view to show an attachment structure of the press plate 42, 42' to the moving frame 41, FIG. 7(*b*) is a fragmentary perspective view of the moving frame 41, FIG. 7(*c*) is a perspective view of one of single pieces making up the press plate 42, 42', and FIG. 7(*d*) is a fragmentary perspective view to show an attachment structure of the press plate 42, 42' to the moving frame 41.
Figure 7B:
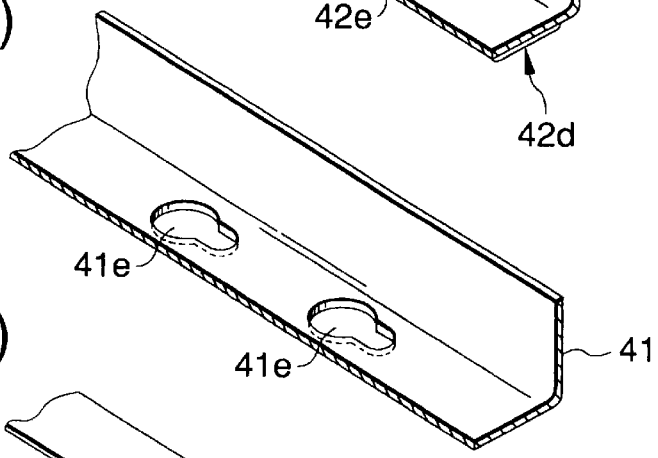
Figure 7C:
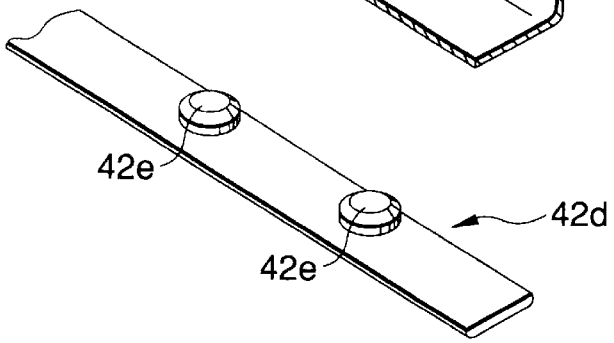
Figure 7D:
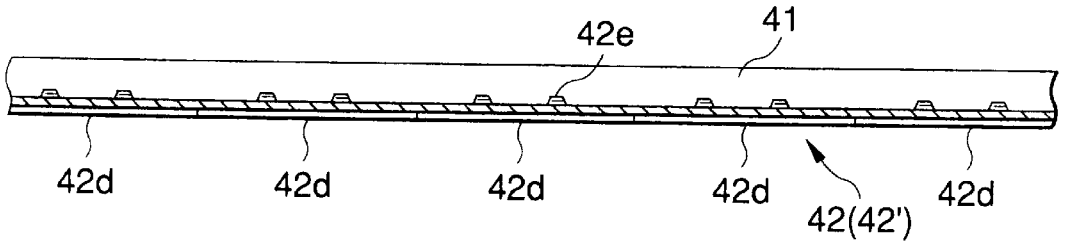

In the first embodiment, the press plates 42, 42' are divided, and engagement protrusions 42e and 42e are disposed on the top face of a single piece 42d (attachment face to the moving frame 41) as shown in FIG. 7(c) and the moving frame 41 is formed with a plurality of potbellied engagement holes 41e as shown in FIG. 7(b). The protrusions 42e are engaged in the holes 41e as shown in FIG. 7(a), whereby the single piece 42d is fixed to the moving frame 41, and a plurality of the single pieces 42d are attached on a row as shown in FIG. 7(d), thereby making up the whole press plate 42, 42'.

In FIG. 4, numerals 43 and 43 are energization means for always energizing the press means 40 toward the support means, namely, the paper feed guide 36 and the paper discharge guide 37. The energization means 43 is made of compression springs placed between the moving frame 41 of the press means 40 and the upper frame 33. The compression springs 43 are disposed in each of two recesses 41a and 41b of the moving frame 41. In the embodiment, six springs are placed in each of the recesses 41a and 41b (12 springs in total) as shown in FIG. 1(a).

The press means 40 is always energized by the energization means 43 toward the paper feed guide 36 and the paper discharge guide 37. Movement of the press means 40 is restricted by a press means link mechanism 70 described later.

In FIG. 4, numeral 50 is cutting means placed between a pair of press plates 42 and 42', namely, between the two recesses (compression spring housing sections) 41a and 41b of the moving frame 41. The cutting means 50 is shaped like a circular arc in an abutment part 50a against the continuous paper P when viewed from the perforation direction of the continuous paper P to be cut (direction orthogonal to the paper face of FIG. 4). It extends in the same direction as the perforations (direction orthogonal to the paper face of FIG. 4) and is formed longer than the perforations, namely, longer than the width of the continuous paper P (see FIGS. 1(a) and 17(c)).

Figure 8A:
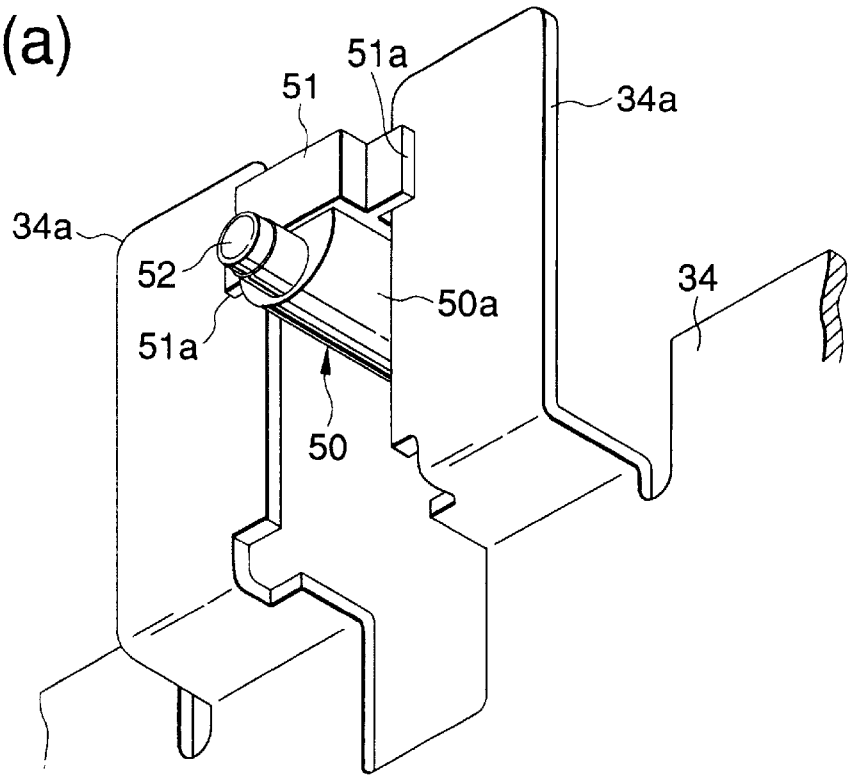
FIG. 8(*a*) is a perspective view to show the left end periphery of the cutting means 50 and FIG. 8(*b*) is a perspective view at a different angle.
Figure 8B:
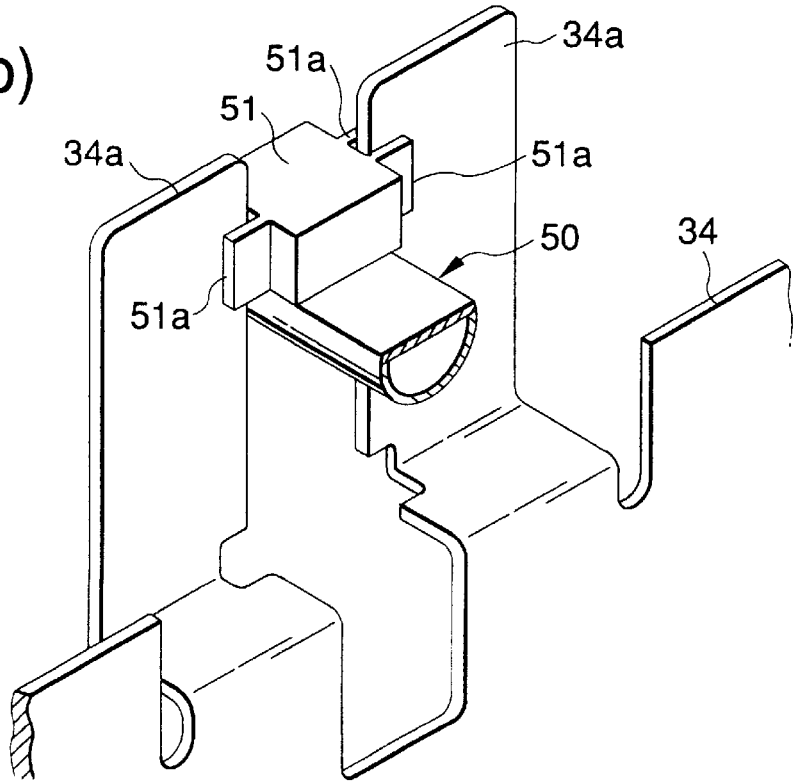

FIG. 8(a) is a perspective view to show the left end periphery of the cutting means 50 and (b) is a perspective view at a different angle.

In FIGS. 8(a) and (b), numeral 34a is an upper piece of the subframe 34 also shown in FIGS. 1 and 2. The upper pieces 34a and 34a are fixed to the upper frame 33 as shown in FIGS. 1 and 2.

As shown in FIGS. 8(a) and (b), the left end part of the cutting means 50 is inserted between the upper pieces 34a and 34a and can move up and down as it is guided by the upper pieces 34a and 34a. Likewise, the right end part of the cutting means 50 is also inserted between upper pieces 35a and 35a of the right subframe 35, as shown in FIG. 3, and can move up and down as it is guided by the upper pieces 35a and 35a. The upper pieces 35a and 35a are also fixed to the upper frame 33.

As shown in FIGS. 8(a) and (b), a guide block 51 is fixed to the left end part of the cutting means 50. It is provided with four guide pieces 51a in total and the upper piece 34a of the subframe is inserted loosely between the guide pieces 51a, whereby the cutting means 50 is restricted in movement in the axial direction thereof (from side to side in FIG. 1(a)).

That is, the cutting means 50 can move up and down as it is guided by the upper pieces 34a, 34a, 35a, and 35a of the left and right subframes, and is restricted in movement in the axial direction thereof as the guide block 51 is guided by the upper pieces 34a of the left subframe.

Figure 9A:
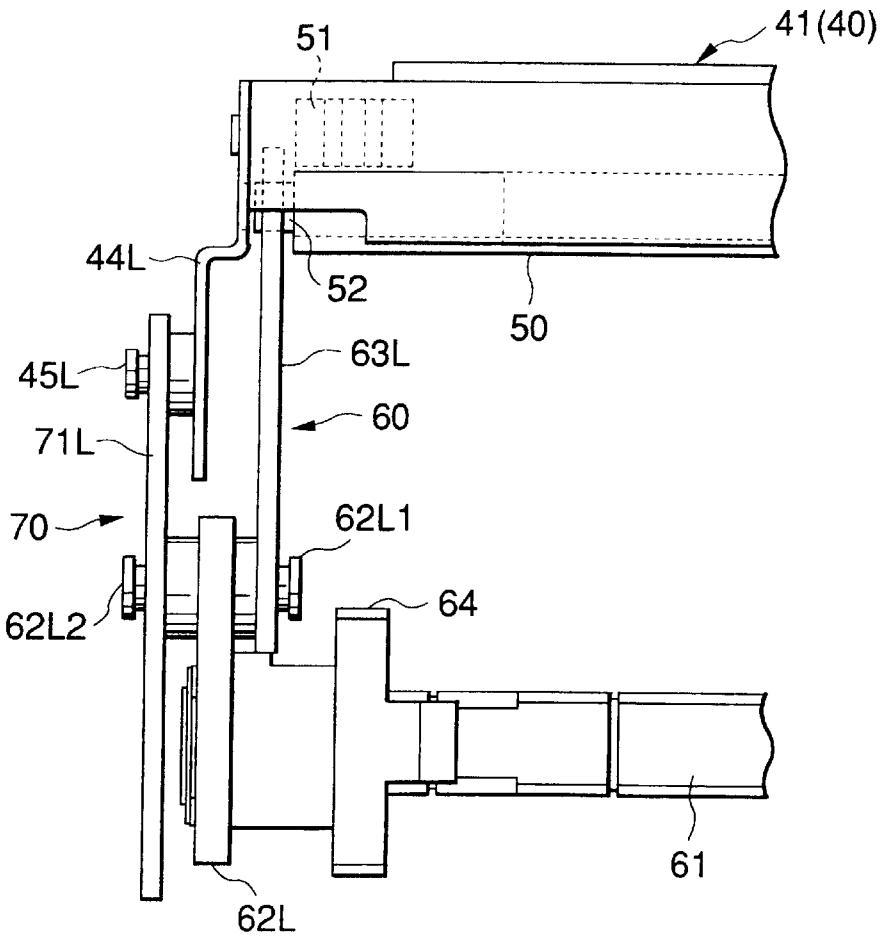
FIGS. 9(*a*) and (*b*) show a cutting means link mechanism 60 and a press means link mechanism 70; (a) is a front view of the left portion and (b) is a left side view.

The cutting means 50 is provided at both side ends with pins 52 and 53 for a cutting means link mechanism 60 described later. (See FIGS. 3 and 10 for the pin 53 at the right end.) FIGS. 9(a) and (b) show the cutting means link mechanism 60 and the press means link mechanism 70; (a) is a front view of the left portion and (b) is a left side view. Likewise, FIGS. 10(a) and (b) show the cutting means link mechanism 60 and the press means link mechanism 70; (a) is a front view of the right portion and (b) is a rig;it side view.

As shown in FIGS. 9(a) and (b) and 10(a) and (b), the cutting means link mechanism 60 comprises a drive shaft 61 shaped substantially like a rectangular rod, a pair of arms 62L and 62R fixed to both ends of the drive shaft 61, and connecting rods 63L and 63R connected pivotably to the ends of the cutting means 50 (pins 52 and 53).

As shown in FIGS. 9(a) and (b), a gear 64 is fixed to the left end part of the drive shaft 61. The gear 64 meshes with a gear 66 fixed to an output shaft 65a of a motor 65 attached to the subframe 34 as shown in FIG. 1(b), whereby the drive shaft 61 is rotated by the motor 65 as described later.

As shown in FIGS. 9(a) and (b), the left arm 62L is provided with a first pin 62L1 and this first pin 62L1 and the left end pin 52 of the cutting means 50 are connected by the connecting rod 63L.

Figure 9B:
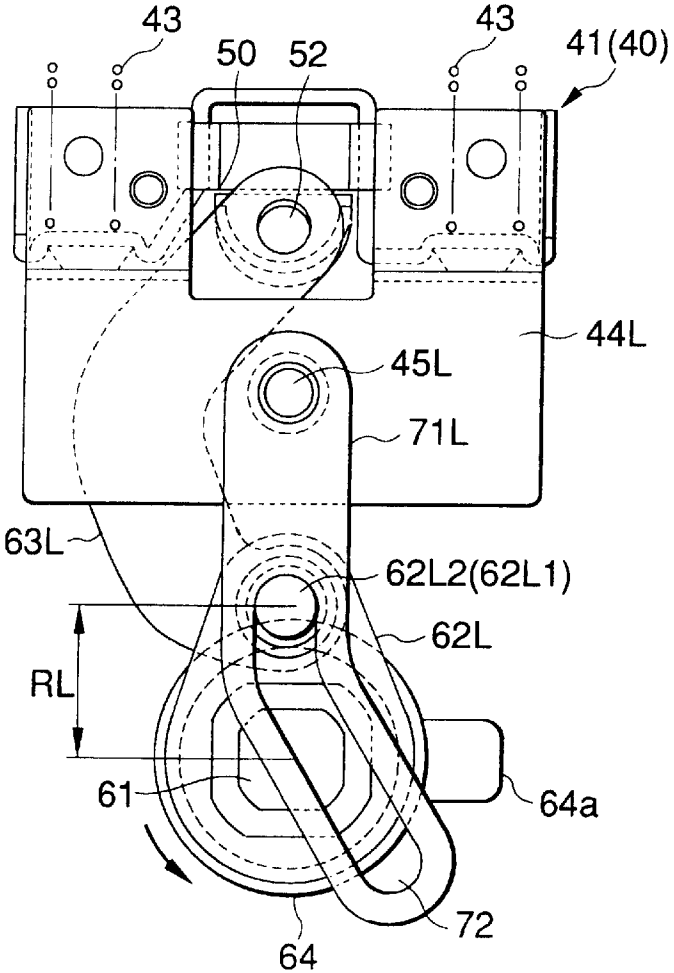
Figure 10B:
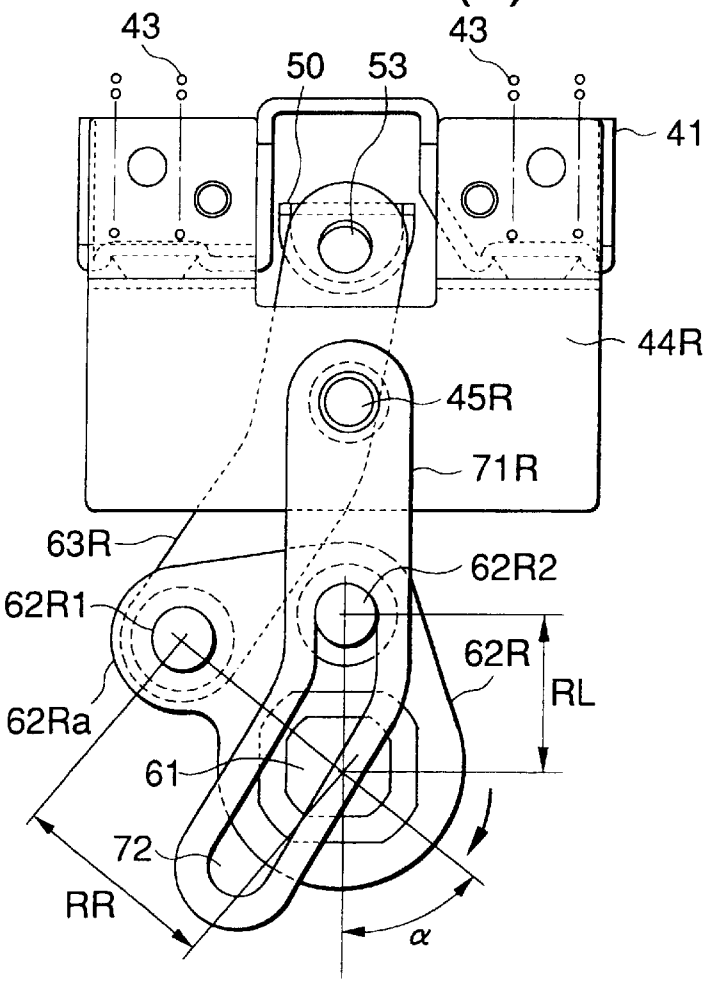
FIGS. 10(*a*) and (*b*) show the cutting means link mechanism 60 and the press means link mechanism 70; (a) is a front view of the right portion and (b) is a right side view.
Figure 10A:
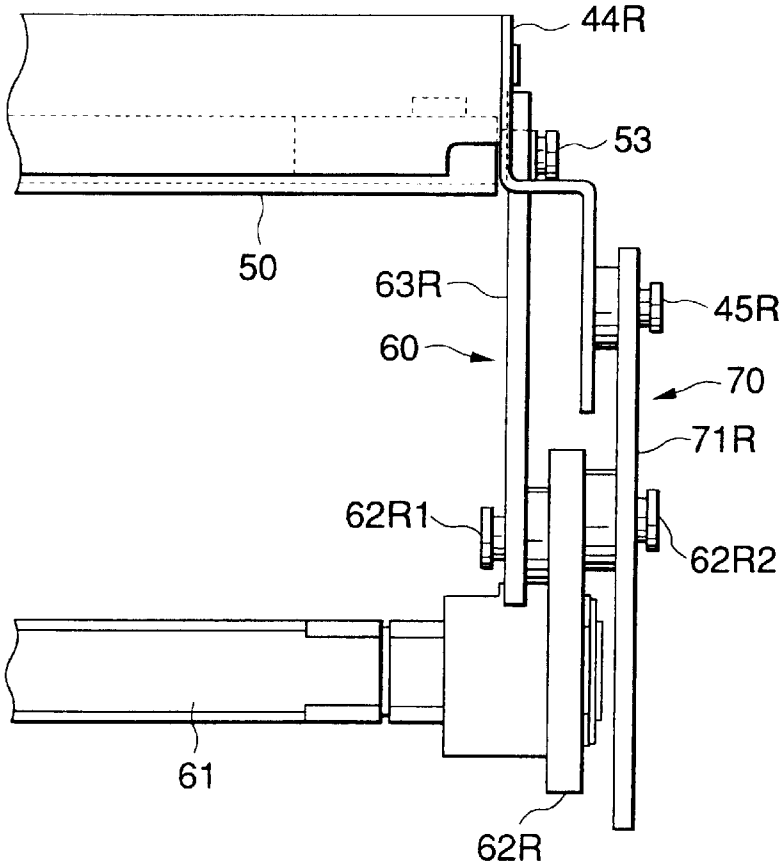

As shown in FIGS. 10(a) and (b), the right arm 62R differs from the left arm 62L somewhat in shape. That is, the former differs from the latter in that it is formed with a projection 62Ra. This projection 62Ra is provided with a first pin 62R1 and this first pin 62R1 and the right end pin 53 of the cutting means 50 are connected by the connecting rod 63R. As a result, as seen in FIGS. 9(b) and 10(b), the distance RL between the center of the drive shaft 61 and the center of the first pin 62L1 of the left arm differs from distance RR between the center of the drive shaft 61 and the center of the first pin 62R1 of the right arm; RL<RR. For positions around the drive shaft 61, the first pin 62R1 of the right arm shifts by angle with the first pin 62L1 of the left arm. That is, the connection part of the left arm 62L and the connection rod 63L (pin 62L1 portion) and the connection part of the right arm 62R and the connection rod 63R (pin 62R1 portion) are placed out of phase with respect to the portion around the drive shaft 61.

As shown in FIGS. 9(a) and (b) and 10(a) and (b), the press means link mechanism 70 comprises the drive shaft 61 shared with the cutting means link mechanism 60, a pair of the arms 62L and 62R shared with the cutting means link mechanism 60, and connecting rods 71L and 71R connected pivotably to the arms 62L and 62R and the ends of the press means 40.

As shown in FIGS. 9(a) and (b), the left arm 62L is provided with a second pin 62L2. This second pin 62L2 is at the same position as the first pin 62L1 with respect to the portion around the drive shaft; it is placed at the left of the first pin 62L1. The second pin 62L2 and a pin 45L disposed in a connecting plate 44L fixed to the left end of the moving frame 41 of the press means 40 and hanging down are connected by the connecting rod 71L. A long hole 72 is made in the connecting rod 71L and the second pin 62L2 is connected slidably to the long hole 72.

The press means link mechanism 70 basically is the same in left and right structures (represented symmetrically in FIGS. 9(*a*) and (*b*) and 10(*a*) and (*b*)). That is, as shown in FIGS. 10(*a*) and (*b*), the right arm 62R is provided with a second pin 62R2 at the same position as the second pin 62L2 at the left with respect to the portion around the drive shaft 61, and the second pin 62R2 and a pin 45R disposed in a connecting plate 44R fixed to the right end of the moving frame 41 of the press means 40 and hanging down are connected by the connecting rod 71R. A long hole 72 is made in the connecting rod 71R and the second pin 62R2 is connected slidably to the long hole 72.

As described with reference to FIG. 4, the press means 40 is always energized by the energization means 43 toward the paper feed guide 36 and the paper discharge guide 37. When the press means link mechanism 70 is in the state shown in FIGS. 9(*a*) and (*b*) and 10(*a*) and (*b*) (standby state described later), the energization force of the energization means 43 is received on the drive shaft 61 via the connecting plates 44L and 44R, the pins 45L and 45R, the connecting rods 71L and 71R, the second pins 62L2 and 62R2, and the arms 62L and 62R, whereby movement of the press means 40 is restricted. As shown in FIGS. 1–3, the drive shaft 61 is placed in parallel with the slit-like cutting space C and is supported rotatably by the subframes 34 and 35.

Figure 11:
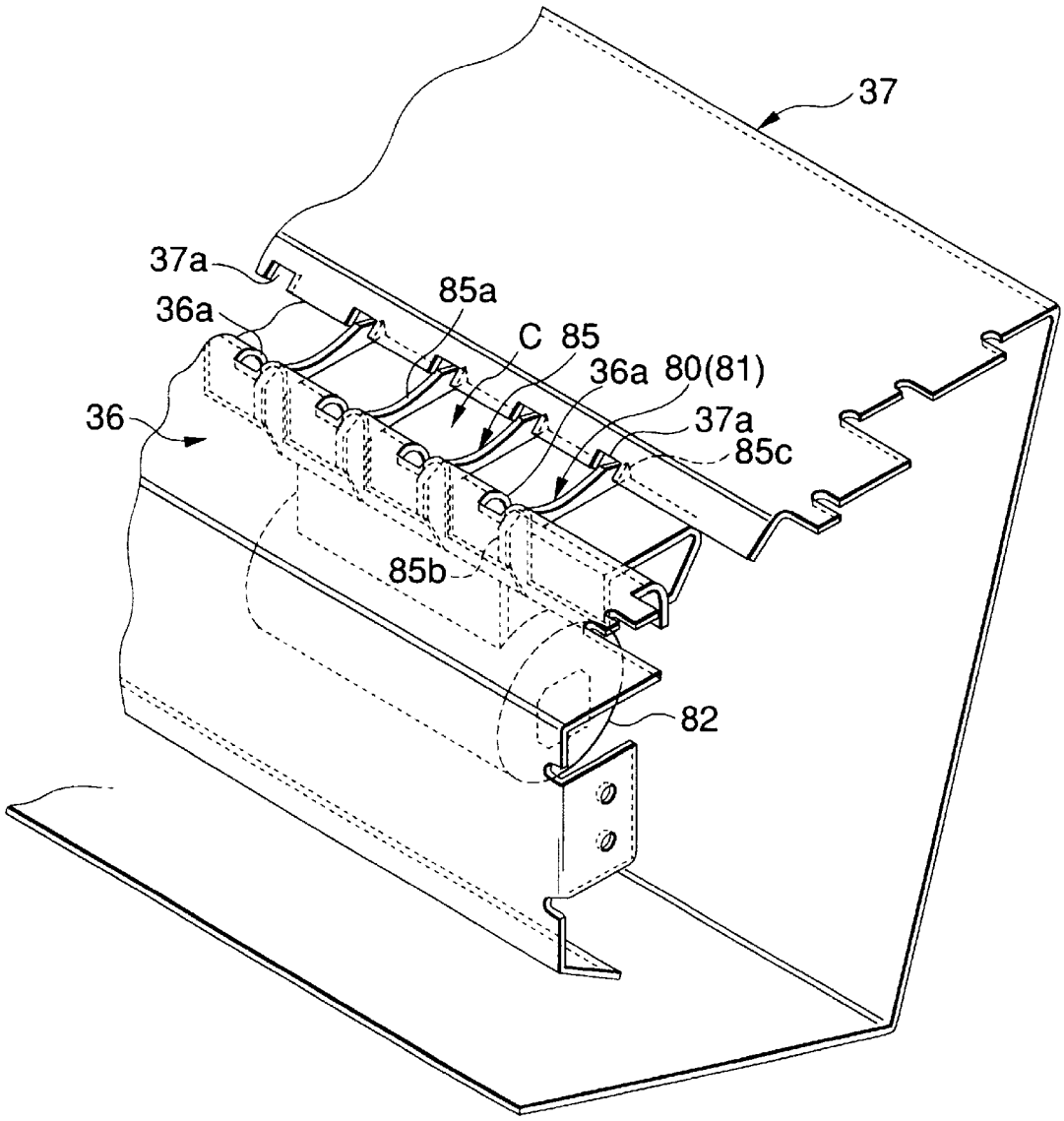
FIG. 11 is a fragmentary enlarged perspective view to show cutting space C in detail.

FIG. 11 is a fragmentary enlarged perspective view to show the cutting space C (see FIG. 4) in detail.

In FIGS. 11 and 4, numeral 80 is movable guide means for preventing the tip of the continuous paper P (see FIG. 4) transported as described later from entering the slit-like cutting space C, namely, the gap between the paper feed guide 36 and the paper discharge guide 37 and causing a paper jam to occur. When the drive shaft 61 rotates and the continuous paper P is cut by the cutting means 50 as described below, the movable guide means 80 retracts from the cutting space C in association with rotation of the drive shaft 61.

As shown in FIGS. 12 and 1–3, the movable guide means 80 is provided by mounting a plurality of guide blocks 81 (in the embodiment, five guide blocks) on the drive shaft 61.

Figure 13A:
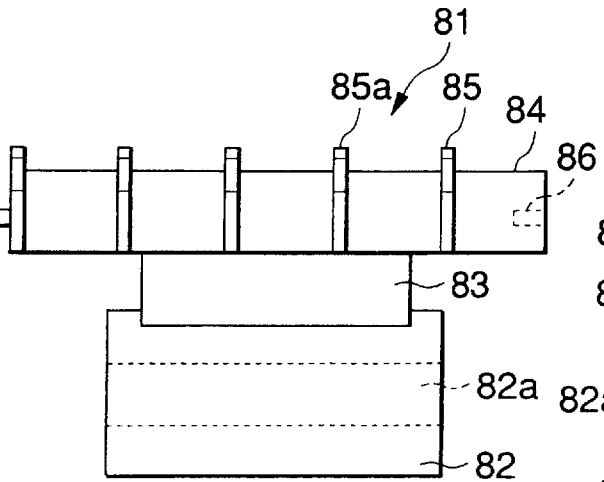
FIGS. 13(*a*)–(*c*) show a guide block 81; (a) is a front view, (b) is a left side view, and (c) is a right side view.
Figure 13B:
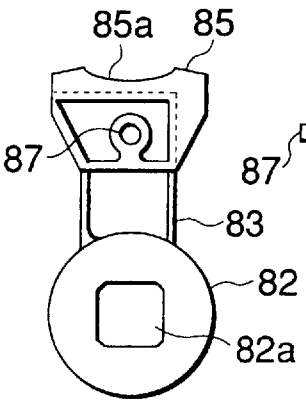
Figure 13C:
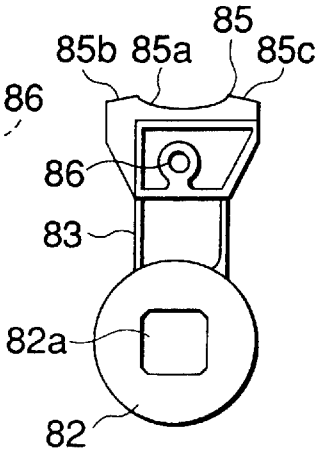
Figure 14:
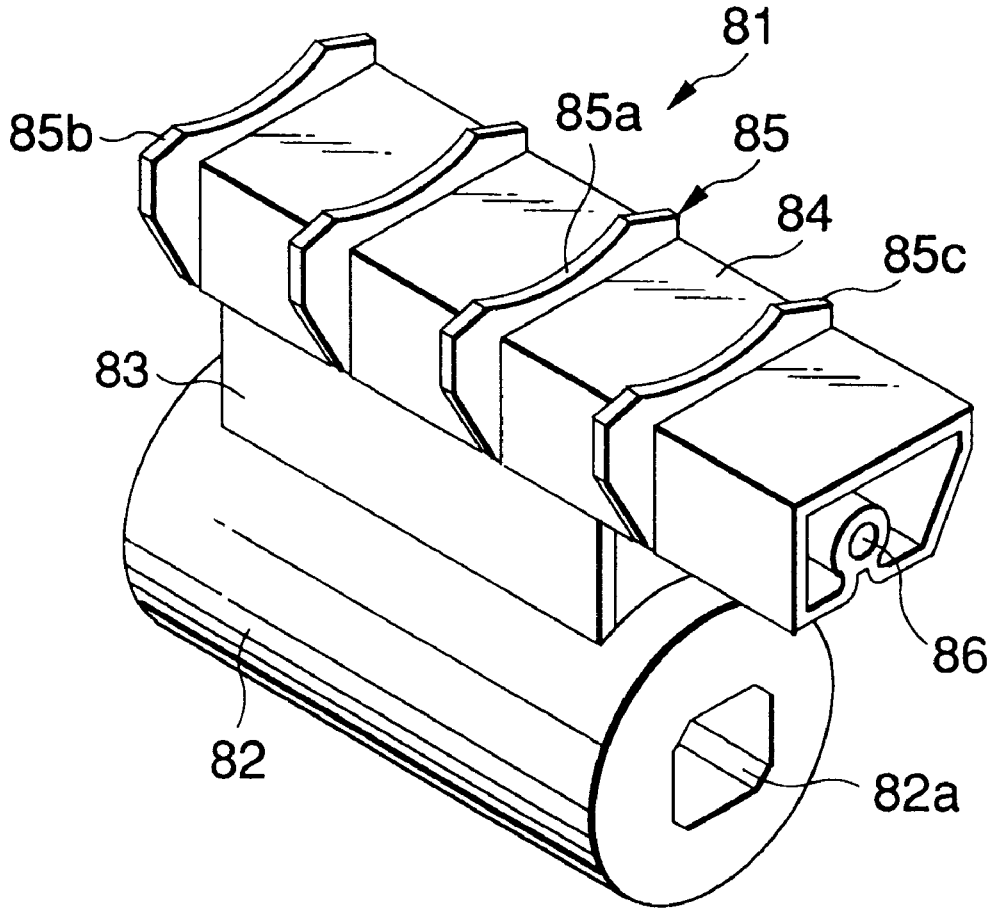
FIG. 14 is a perspective view to show the guide block 81.

FIGS. 13(*a*)–(*c*) show the guide block 81; (a) is a front view, (b) is a left side view, and (c) is a right side view. FIG. 14 is a perspective view to show the guide block 81.

As shown in FIGS. 13 and 14, the guide block 81 comprises a base 82, an arm part 83, and a guide part 84 molded in one piece, and top faces 85*a* of ribs 85 formed in the guide part 84 form a guide face of continuous paper. The guide part 84 is formed on one side face with a hole 86 and on the other side face with a protrusion 87 fitted into the hole 86 of the contiguous guide block. The base 82 is formed with a square hole 82*a* into which the drive shaft 61 is inserted.

Figure 12:
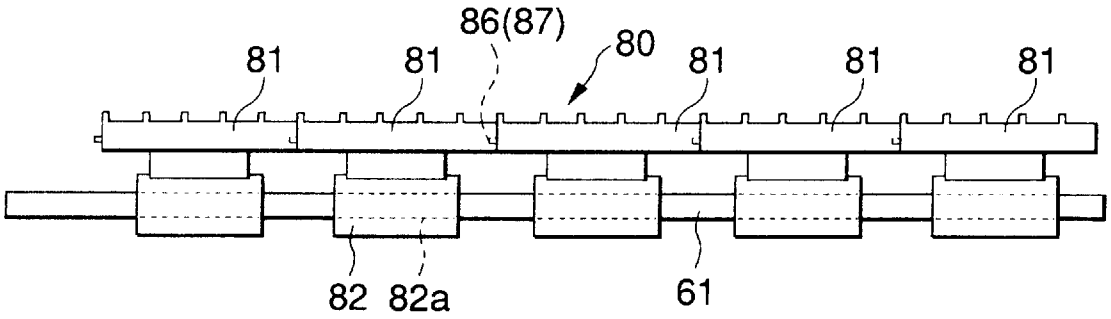
FIG. 12 is a front view showing how to install a movable means 80 to a drive axis.

The drive shaft 61 is inserted into the square holes 82*a* of the guide blocks 81 and the protrusion 87 of each guide block 81 is fitted into the hole 86 of the contiguous guide block 81, whereby the movable guide means 80 is mounted on the drive shaft 61 as shown in FIG. 12.

As shown in FIG. 11, notches 36*a* and 37*a* are made like comb teeth in the end margins of the paper feed guide 36 and the paper discharge guide 37 facing the cutting space C. Front end parts 85*b* and rear end parts 85*c* of the ribs 85 enter the notches 36*a* and 37*a* in a state in which the movable guide means 80 is mounted on the drive shaft 61 and the drive shaft 61 is built in the cutting unit.

Figure 15A:
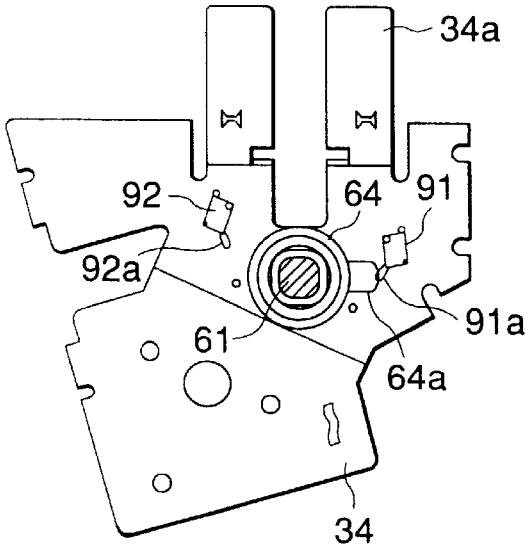
FIGS. 15(*a*), (*b*), and (*c*) are left side views to mainly show a left subframe 34.
Figure 15B:
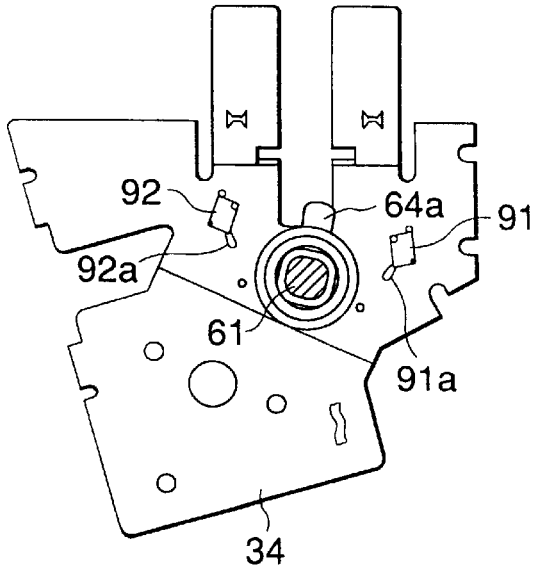
Figure 15C:
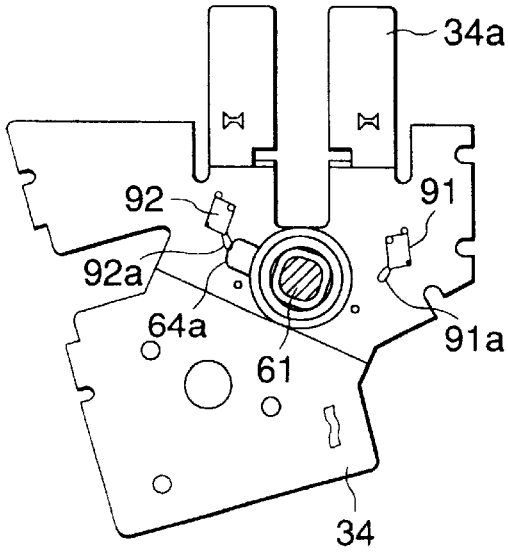

FIGS. 15(*a*)–(*c*) depicts left side views to mainly show the Jeft subframe 34.

In FIGS. 15(*a*)–(*c*), a detected piece 64*a* molded integrally with the gear 64 is fixed to the drive shaft 61 (see FIGS. 2(*a*)–(*c*)).

Detectors 91, 92 are detection means, such as limit switches. The detectors 91 and 92 comprise levers 91*a* and 92*a*, respectively, for abutting the detected piece 64*a* and swinging. When either of the levers abuts the detected piece 64*a* and swings, the detector comprising the lever sends a detection signal to control means (not shown). One detector 91 detects the drive shaft 61 at a standby position and the other detector 92 detects a rotation end position of the drive shaft 61. The detailed operation will be described below.

The continuous paper cutting unit of the first embodiment further includes paper feed means (not shown), such as a paper feed roller or a pin tractor, paper discharge means (not shown), such as a paper discharge roller or a pin tractor, and control means for controlling the entire cutting unit. Next, the operation of the continuous paper cutting unit will be discussed in the order of the standby state, paper feed operation, and cutting operation mainly with reference to FIGS. 16–20. The structure will also be described additionally as required.

Figure 16A:
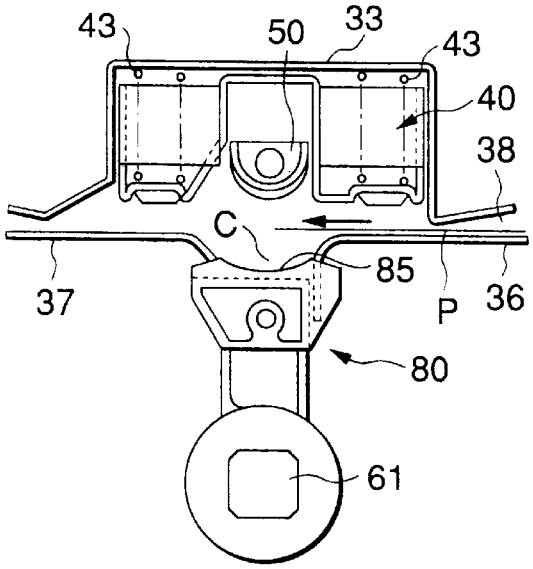
FIGS. 16(*a*), (*b*), and (*c*) are left side views to explain the operation of the continuous paper cutting unit; (a) shows a standby state, (b) shows a state just before cutting, and (c) shows a state after cutting.
Figure 16B:
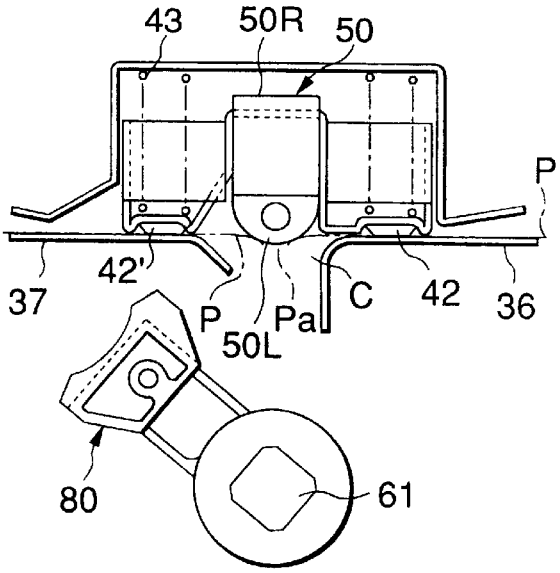
Figure 16C:
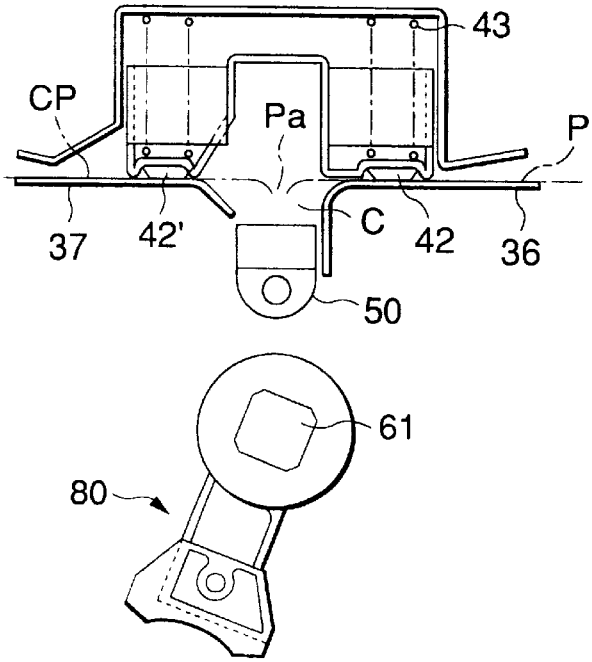

FIGS. 16(*a*), (*b*), and (*c*) are left side views to explain the operation of the continuous paper cutting unit. FIGS. 17–20 are drawings to mainly show the operation of the cutting means 50, the cutting means link mechanism 60, and the press means link mechanism 70; in each of the figures, (a) is a left side view, (b) is a right side view, and (c) is a front view of the cutting means 50. FIG. 18(*d*) is a frontal sectional view to show the relationship between the cutting means 50 and the moving frame 41 of the press means 40.

Standby State

Figure 17A:
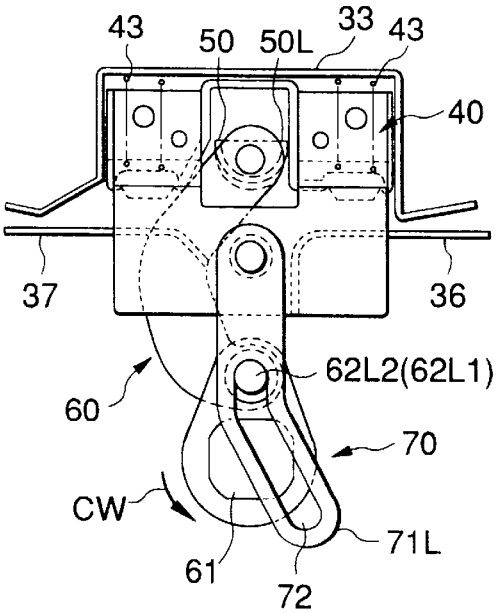
FIGS. 17(*a*)–(*c*) mainly show the operation of the cutting means 50, the cutting means link mechanism 60, and the press means link mechanism 70 (standby state); (a) is a left side view, (b) is a right side view, and (c) is a front view of the cutting means 50.
Figure 17B:
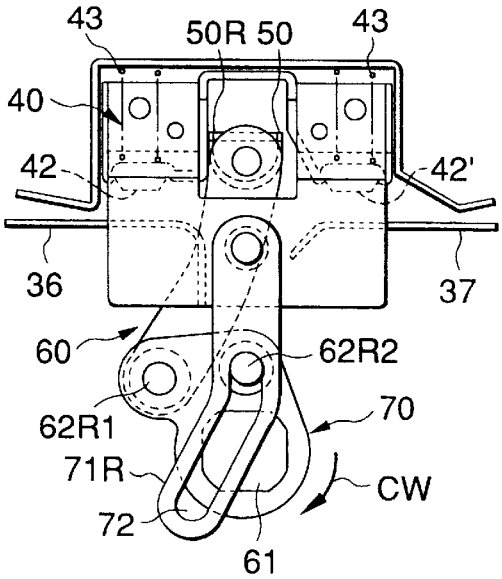
Figure 17C:
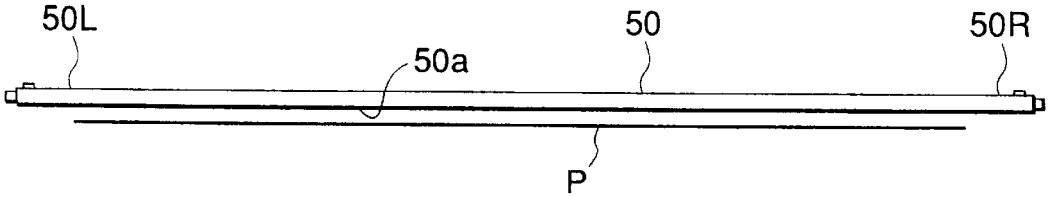
Figure 18A:
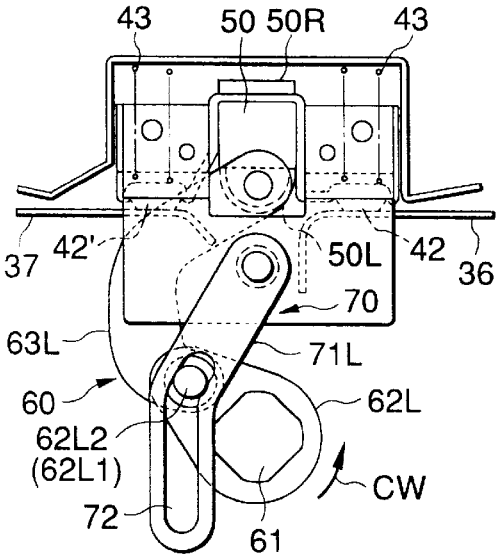
FIGS. 18(*a*)–(*d*) mainly show the operation of the cutting means 50, the cutting means link mechanism 60, and the press means link mechanism 70 (top dead center state); (a) is a left side view, (b) is a right side view, (c) is a front view of the cutting means 50, and (d) is a frontal sectional view to show the relationship between the cutting means 50 and the moving frame 41 of the press means 40.
Figure 18B:
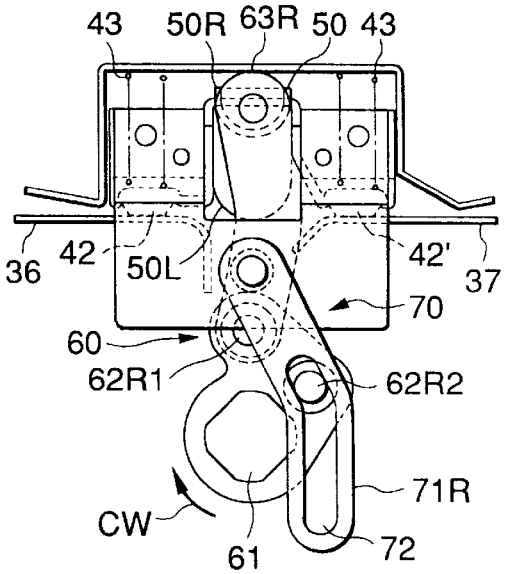
Figure 18C:
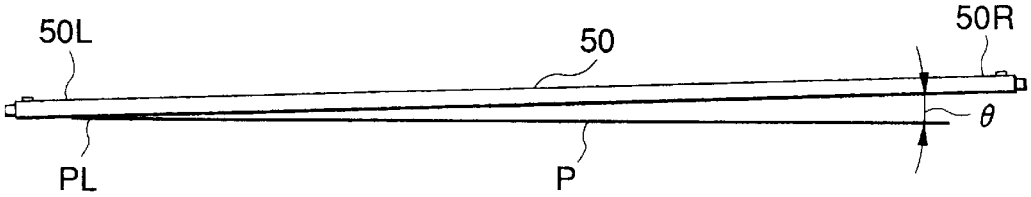
Figure 18D:
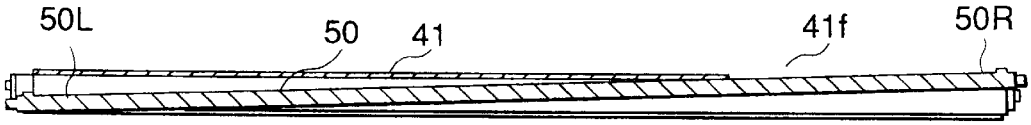

In the standby state, the motor 65 stops and the cutting means link mechanism 60 and the press means link mechanism 70 are in the state shown in FIG. 17, namely, the state shown in FIGS. 9 and 10.

At this time, in the cutting means 50, the abutment part 50*a* is in a substantially parallel state witch the support faces 36*b* and 37*b* (substantially horizontal state) at a distance (see h3) substantially equal to the distance between the continuous paper P support face 36*b*, 37*b* of the support means (paper feed guide 36, paper discharge guide 37) and the press part (press plate) 42, 42' (see h2, h5), as shown in FIGS. 4 and 17(*c*). The abutment part 50*a* is substantially parallel with the support faces 36*b* and 37*b* at the distance (see h3) a little longer than the distance between the support face 36*b*, 37*b* and the press part (see h2, h5).

The energization force of the energization means 43 of the press means 40 is received on the press means link mechanism 70 and movement of the press means 40 is restricted, as described above. The press means 40 is at the position shown in FIG. 16(*a*).

At this time, as shown in FIG. 4, assuming that the distance between the lowermost end part (bend) of the front lower end part 33*a* of the upper frame 33 and the support face 36*b* of the paper feed guide 36, namely, the height of the paper feed port 38 is h1, that the distance between the lower face 42*a* of the upstream press plate 42 and the support face 36*b* is h2, that the distance between the abutment part 50*a* of the cutting means 50 (more accurately, the lowermost end part of the abutment part 50*a*) and the support face 36*b*, 37*b* (more accurately, plane connecting the support faces 36*b* and 37*b*) is h3, that the distance between the top end of the guide face 41*c* of the moving frame 41 and the paper discharge guide 37 (accurately, plane connecting the top face of the paper feed guide 36 and the top face of the paper discharge guide 37) is h4, that the distance between the lower face 42'*a* of the downstream press plate 42' and the support face 37*b* of the paper discharge guide 37 is h5, that the distance between the top end (upstream end) of the inclined paper guide face 33*c* of the upper frame 33 adjoining the press means 40 downstream from the press means 40 and the support face 37*b* of the paper discharge guide 37 is h6, that the distance between the lowermost end part (bend) of the rear lower end part 33*b* of the upper frame 33 and the support face 37*b* of the paper discharge guide 37, namely, the height of the paper discharge port 39 is h7, and that the thickness of the continuous paper P is t (not shown), $t<h1<h2<h3$ $h3<h4$ $h5<h6$ $t<h7<h5$ The movable guide means 80 faces the cutting space C as shown in FIGS. 4 and 16(*a*).

Paper Feed Operation

In the state as described above, the paper feed means (not shown) is driven and the continuous paper P is supplied from the paper feed port 38 to the cutting space C as shown in FIG. 16(*a*). At the time, as described above, $t<h1<h2<h3$, $h3<h4$, $h5<h6$, $t<h7<h5$, and both side parts 41*g* and 41*g* and 41'*g* and 41'*g* of the press plates 42 and 42' on the attachment faces 41*d* and 41'*d* of the press plates 42 and 42' of the moving frame 41 project below the attachment faces. Moreover, the slopes 42*f* and 42'*f* of the press plates 42 and 42' form the guide face of the continuous paper P. Thus, the tip of the paper is smoothly guided and therefore the smooth paper feed operation is enabled.

As shown in FIG. 16(*a*), the movable guide means 80 faces the cutting space C, whereby the continuous paper P is guided by the movable guide means 80, so that the continuous paper P does not enter the cutting space C. Therefore, a smooth transport state of the continuous paper P is enabled without causing a paper jam to occur.

The continuous paper P is supplied so that the perforations Pa thereof are positioned substantially at the center of the cutting space C.

Cutting Operation

Figure 20A:
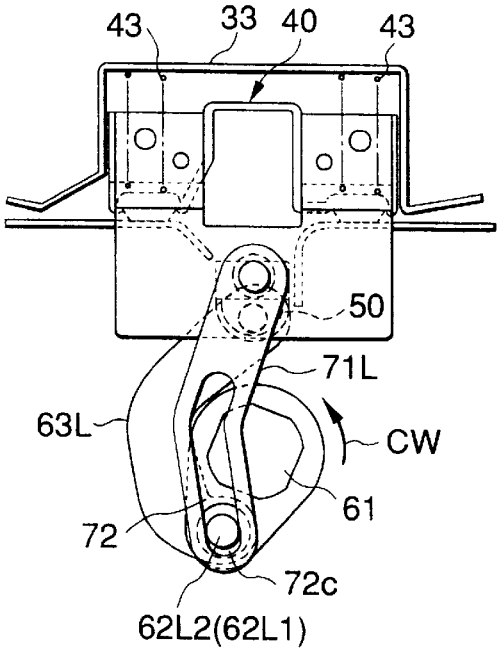
FIGS. 20(*a*)–(*c*) mainly show the operation of the cutting means 50, the cutting means link mechanism 60, and the press means link mechanism 70 (state after cutting); (a) is a left side view, (b) is a right side view, and (c) is a front view of the cutting means 50.
Figure 20B:
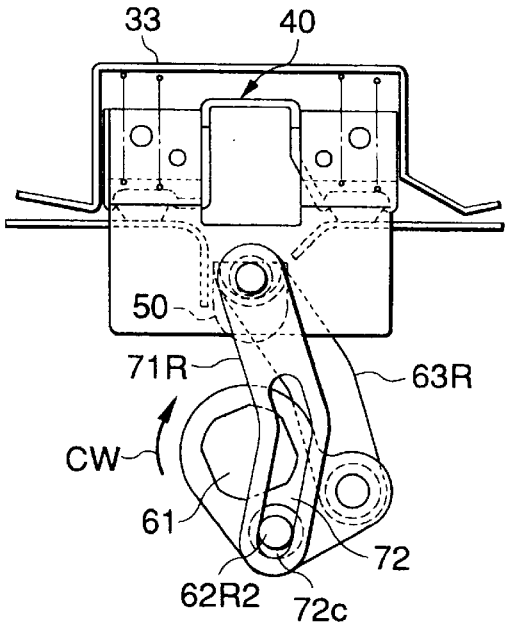
Figure 20C:
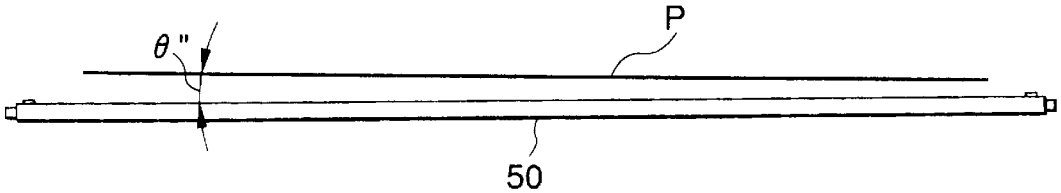

As the motor 65 is driven, the drive shaft 61 is rotated in the arrow CW direction (forward rotation direction) in a stroke from the standby state shown in FIGS. 17(*a*)–(*c*) to the state shown in FIGS. 20(*a*)–(*c*), thereby performing the cutting operation.

The main state of operation will be described in sequence.

FIGS. 18(*a*)–(*d*) shows a state in which the drive shaft 61 rotates about 45 degrees in the arrow CW direction from the state shown in FIGS. 17(*a*)–(*c*).

As the drive shaft 61 starts rotating from the state shown in FIGS. 17(*a*)–(*c*), the press means link mechanism 70 operates, whereby the press means 40 starts dropping by the energization force of the energization means 43. At the time, the energization force of the energization means 43 acts so as to aid in rotating the drive shaft 61 via the press means link mechanism 70.

While the drive shaft 61 rotates, when the press plates 42 and 42' of the press means 40 abut the paper feed guide 36 and the paper discharge guide 37 via the continuous paper P and the continuous paper P is sandwiched between the press plates and the guides, the energization force of the energization means 43 is received at the paper feed guide 36 and the paper discharge guide 37. Therefore, when the drive shaft 61 furthermore rotates, the second pins 62L2 and 62R2 of the arms 62L and 62R are slid in the long holes 72 of the connecting rods 71L and 71R. FIGS. 18(*a*)–(*c*) shows a state in which the press plates 42 and 42' of the press means 40 abut the paper feed guide 36 and the paper discharge guide 37 and then the drive shaft 61 further rotates a little.

On the other hand, as the drive shaft 61 starts rotating from the state shown in FIG. 17, the cutting means link mechanism 60 operates, whereby the lower end 50L of the cutting means 50 starts dropping and the right end 50R starts rising, because the position of the first pin 62R1 of the right arm relative to the portion around the drive shaft 61 shifts by angle a with respect to the first pin 62L1 of the left arm, as shown in FIG. 10(*b*).

FIG. 18 shows a state in which the right end 50R of the cutting means 50 rises completely and a state just before cutting of continuous paper is started. At this time, the left end 50L of the cutting means 50 approaches close to or abuts the left end of the continuous paper P (cutting start part) PL as shown in FIGS. 16(*b*) and 18(*c*). As a result, the cutting means 50 is inclined by θ relative to the paper face of the continuous paper P, as seen in FIG. 18(*c*).

As shown in FIGS. 18(*d*) and 5, a notch 41*f* for relieving the cutting means 50 is made at the right end of the moving frame 41 of the press means 40.

Therefore, if the right end 50R of the cutting means 50 rises, it does not interfere with the moving frame 41 of the press means.

As the drive shaft 61 starts rotating from the state shown in FIGS. 17(*a*)–(*c*), the movable guide means 80 also rotates and retracts from the cutting space C in the direction orthogonal to the length direction of the cutting space C, providing a passage for the cutting means 50 (described below), as shown in FIG. 16(*b*).

Figure 19A:
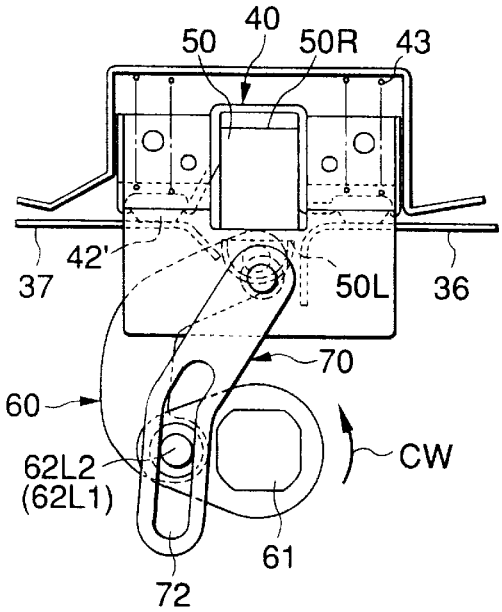
FIGS. 19(*a*)–(*c*) mainly show the operation of the cutting means 50, the cutting means link mechanism 60, and the press means link mechanism 70; (a) is a left side view, (b) is a right side view, and (c) is a front view of the cutting means 50 (state during cutting)
Figure 19B:
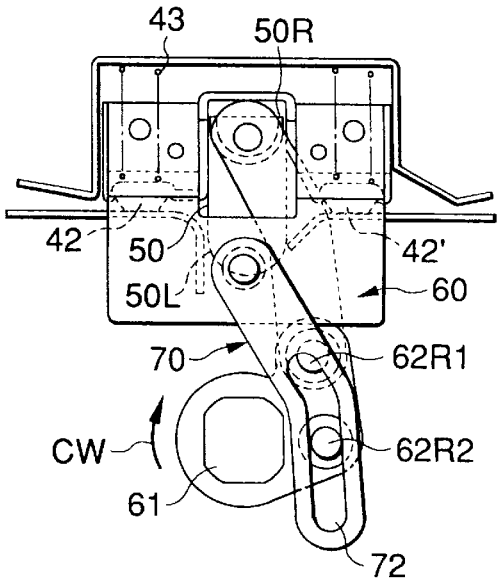
Figure 19C:
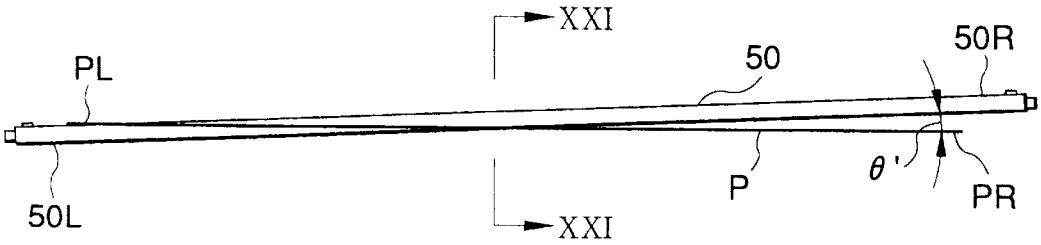

When the drive shaft 61 furthermore continues to rotate from the state shown in FIGS. 18(*a*)–(*c*), as shown in FIGS. 19(*a*)–(*c*), the cutting means link mechanism 60 operates accordingly, whereby the lower end 50L and the right end 50R of the cutting means 50 fall substantially at the same speed (for example, about 8 cm/s). As a result, the cutting means 50 cuts the perforations of the continuous paper P starting at the left (cutting start part) PL of the paper at angle θ' substantially equal to the above-mentioned angle θ, as shown in FIG. 19(*c*). Since the cutting means 50 thus cuts the continuous paper P in the inclined state, smooth cutting is executed. The reason why θ does not equal ζ' is that the distance RL between the center of the drive shaft 61 and the center of the first pin 62L1 of the left arm differs slightly from the distance RR between the center of the drive shaft 61 and the center of the first pin 62R1 of the right arm (RL<RR), as shown in FIGS. 9(*b*) and 10(*b*). However, because RL<RR, the cutting means 50 makes a motion close to the motion as if a human being grasped the left end 50L and swung it downward, and accordingly, the continuous paper P is cut smoothly starting at the paper left PL.

As in the state shown in FIGS. 18(*a*)–(*c*), the press means 40 continues to press the continuous paper P between the paper feed guide 36 and the paper discharge guide 37 by the energization force of the same magnitude of the energization means 43, and the second pins 62L2 and 62R2 of the arms 62L and 62R furthermore move in the long holes 72 of the connecting rods 71L and 71R with the rotation of the drive shaft 61 (see FIGS. 19(*a*)–(*c*)).

Figure 21:
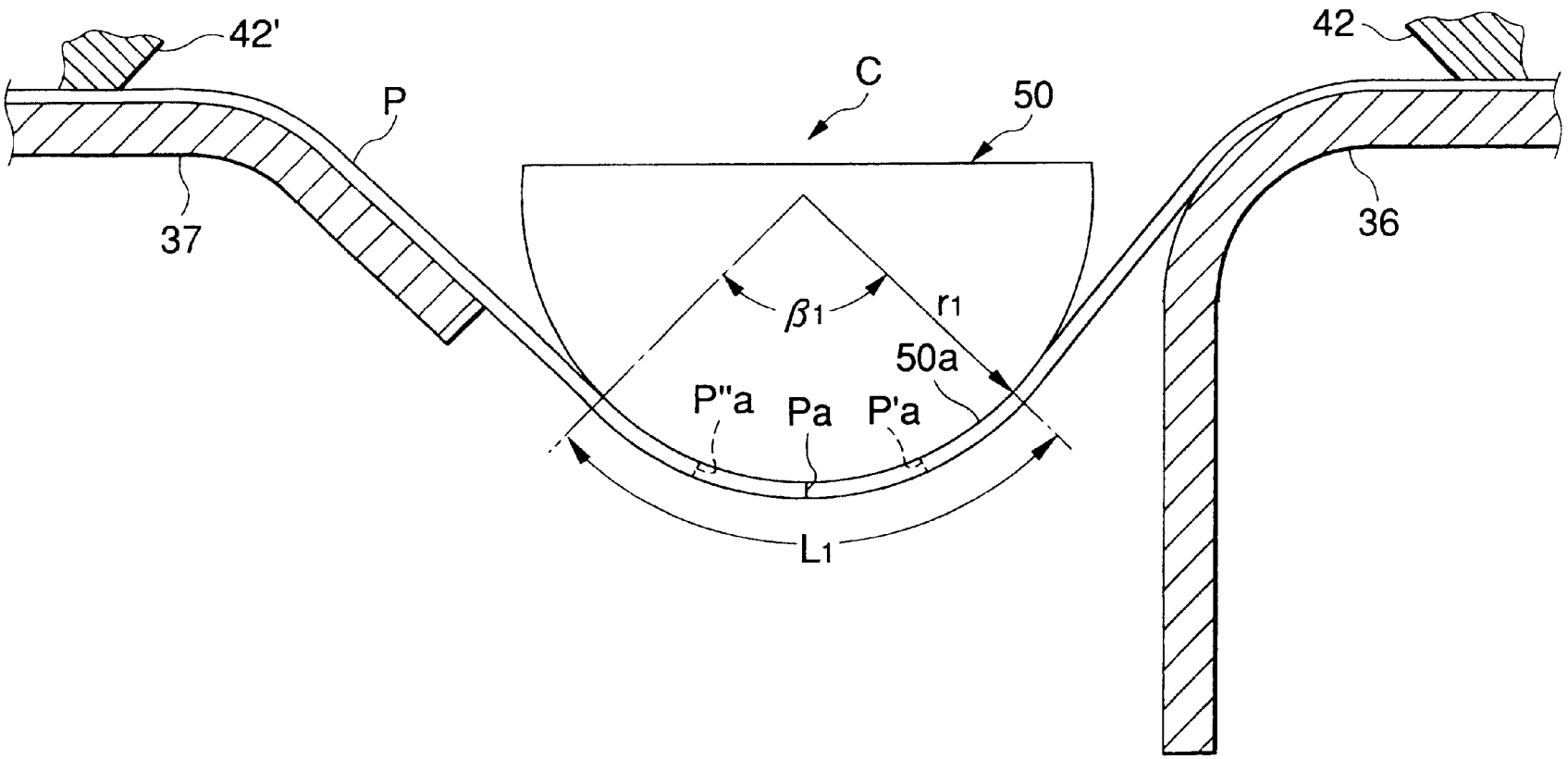
FIG. 21 is a schematic drawing to show how continuous paper P is cut; it is equivalent to an enlarged view taken on line XXI—XXI in FIG. 19(*c*)

FIG. 21 is a schematic drawing to show how the continuous paper P is cut (accurately, the state just before the paper is cut); it is equivalent to an enlarged view taken on line XXI—XXI. in FIG. 19(*c*).

As seen in FIG. 21, if the cutting means 50 falls in a state in which the continuous paper P is sandwiched and held between the press plates 42 and 42' and the paper feed guide 36 and the paper discharge guide 37 on both sides of the perforations Pa, the continuous paper P is partially wound around the cutting means 50 accordingly. As the cutting means 50 furthermore falls, soon the continuous paper P is cut (torn) along the perforations Pa.

Here, assuming that the radius of the circular arc portion of the cutting means 50 is r1 and that the winding angle of the continuous paper P around the circular arc portion is β1, the winding length of the continuous paper P around the cutting means 50, L1, is r1 ·β1.

On the other hand, when the continuous paper P is fed, the perforations Pa are not necessarily accurately positioned at the center of the cutting space C because of a transport error of the paper, etc. In FIG. 21, the state in which the perforations Pa are positioned at the center of the cutting space C is drawn by the solid line, but can shift from the center as indicated by the phantom line Pa' or Pa". However, according to the embodiment, the contact part (cutting part) of the cutting means 50 with the continuous paper is shaped like a circular arc and the above-mentioned winding length L1 is provided, thus if the perforations Pa are out of place within the range of the length L1, the continuous paper P is cut reliably along the perforations Pa.

Multiple-part forms are also often used as the continuous paper P. The continuous paper P usually is folded in zigzags along the perforations as indicated by reference numeral 2 in FIG. 56(*a*) and is fed linearly from the folded state. Thus, if the continuous paper is multiple-part forms, a shift occurs among the parts of the multiple-part forms and as a result, the perforations of the parts also shift, as shown in FIG. 22.

Figure 22:
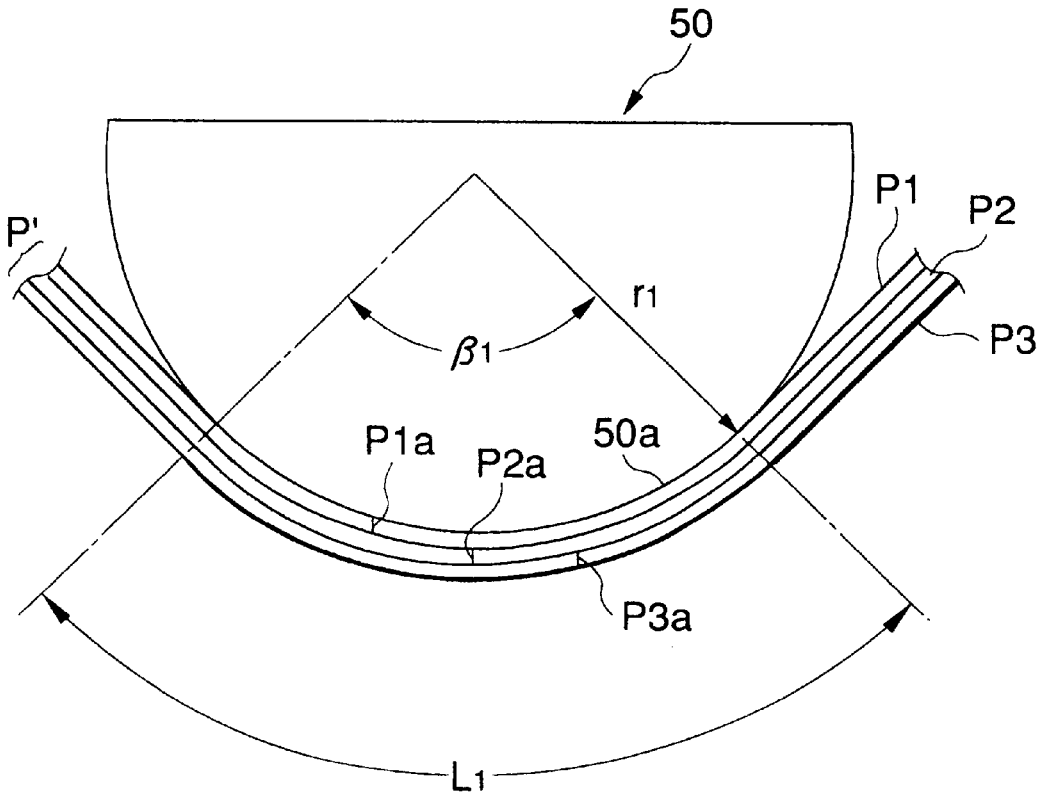
FIG. 22 is a schematic drawing to show how multiple-part forms P' are cut; it is equivalent to an enlarged view taken on line XXI—XXI in FIG. 19(*c*)

In FIG. 22, P' is multiple-part forms consisting of three parts P1, P2, and P3. If the continuous paper to be cut is multiple parts forms P', the perforations P1*a*, P2*a*, and P3*a* of the parts P1, P2, and P3 shift, for example, as shown in the figure.

However, according to the embodiment, the contact part (cutting part) of the cutting means 50 with the continuous paper is shaped like a circular arc and the above-mentioned winding length L1 is provided. Thus, if the perforations P1*a*, P2*a*, and P3*a* are out of place within the range of the length L1, the parts P1, P2, and P3 of the continuous paper (multiple-part forms) P' are cut reliably along their respective perforations P1*a*, P2*a*, and P3*a*.

Conversely, in the embodiment, if the position of the perforations shifts from the center of the cutting space C because of a transport error of the continuous paper, etc., and/or the perforations of the parts shift from the center of the cutting space C because the continuous paper is multiple-part forms, the continuous paper (multiple-part forms) can be cut reliably along the perforations, namely, the above-mentioned winding length L1 is provided by setting the shape of the circular arc portion 50*a* of the cutting means 50 and the spacing between the paper feed guide 36 and the paper discharge guide 37. At least the circular arc portion 50*a* of the cutting means 50 is made of a material having a small friction coefficient with the forms (continuous paper), for example, a galvanized sheet iron; because if the cutting means 50 is slippery with respect to the forms (continuous paper), the forms (continuous paper) can be cut reliably along the perforations.

The drive shaft 61 furthermore continues to rotate from the state shown in FIGS. 19(*a*)–(*c*), and as shown in FIGS. 20(*a*)–(*c*), and the cutting means link mechanism 60 operates accordingly, whereby the lower end 50L and the right end 50R of the cutting means 50 further fall substantially at the same speed, and the cutting means 50 completely passes through below the continuous paper P as shown in FIG. 20(*c*). As a result, the continuous paper P is cut completely along the perforations Pa (see FIG. 16(*c*)). The reason why the inclined angle of the cutting means 50 with the continuous paper P at this time, θ", does not become equal to the above-mentioned angle θ' is as described above.

As in the state shown in FIGS. 18(*a*)–(*c*), the press means 40 continues to press the continuous paper P between the paper feed guide 36 and the paper discharge guide 37 by the energization force of the same magnitude of the energization means 43, and the second pins 62L2 and 62R2 of the arms 62L and 62R furthermore move in the long holes 72 of the connecting rods 71L and 71R with the rotation of the drive shaft 61. The long hole 72 is made so that a slight spacing 72C is formed between the second pin 62L2, 62R2 of the arm 62L, 62R and the lower end of the long hole 72 of the connecting rod 71L, 71R even in the state in which the drive shaft 61 completely rotates as shown in FIGS. 20(*a*) and (*b*).

The movable guide means 80 rotates with rotation of the drive shaft 61, providing a passage for the cutting means 50, as shown in FIG. 16(*c*).

Thus, the continuous paper P is completely cut along the perforations Pa. Then, the drive shaft 61 reversely rotates from the state shown in FIGS. 20(*a*)–(*c*) to the state shown in FIGS. 17(*a*)–(*c*) and the members also return to the standby state shown in FIGS. 17(*a*)–(*c*).

Then, the paper feed means (not shown) and the paper discharge means (not shown) are driven, the cut paper CP (see FIG. 16(*c*)) is discharged to the outside of the cutting unit, and the next perforations are positioned in the cutting space C for repeating the above-mentioned operation.

Figure 23:
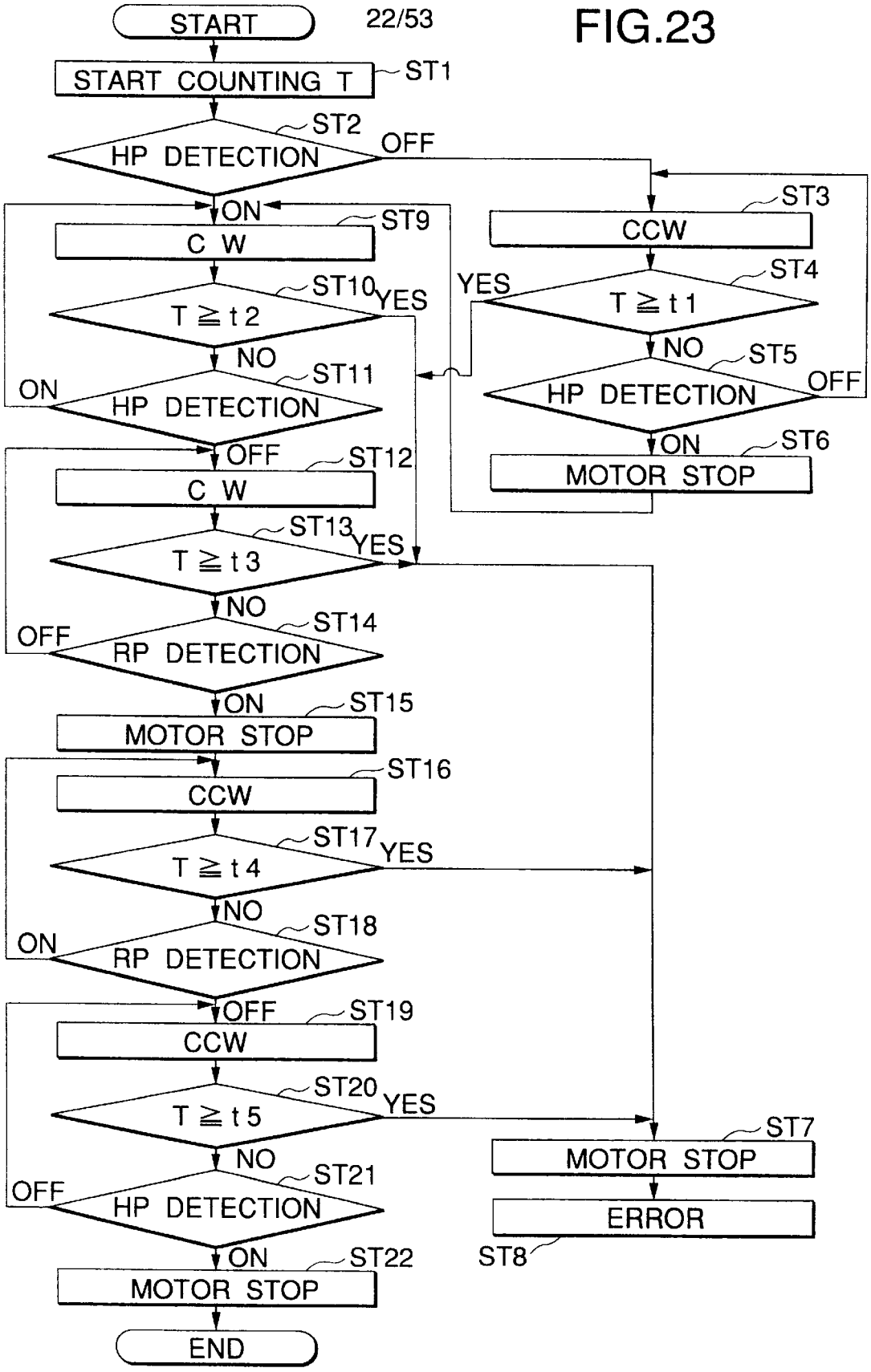
FIG. 23 is a flowchart to show a specific sequence for performing the cutting operation.

FIG. 23 is a flowchart to show a specific sequence for performing the above-mentioned cutting operation in the embodiment. The cutting operation sequence will be discussed with reference to the flowchart.

(i) To start the cutting operation, counting the elapsed time T is started with a timer of the control means at step ST1.

(ii) Whether or not the drive shaft 61 is placed at the standby position is detected at step ST2 based on whether or not the detected piece 64*a* molded integrally with the gear 64 fixed to the drive shaft 61 swings the lever 91*a* of one detector 91 and turns on the detector 91 (HP detection), namely, a detection signal is sent to the control means.

(iii) If it is determined at step ST2 that the detector 91 is off, namely, the drive shaft 61 is not at the standby position, the motor 65 is rotated reversely (counterclockwise) for reversely rotating the drive shaft 61 and returning the drive shaft 61 to the standby position at steps ST3-ST6. If the drive shaft 61 does not return to the standby position still after the expiration of a predetermined time (t1), some error is assumed to occur. Then, the motor 65 is stopped at step ST7 and an error message is displayed on display means (not shown)-at step ST8.

More particularly, first the motor 65 is rotated reversely (counterclockwise) for reversely rotating the drive shaft 61 at step ST3. Next, whether or not the elapsed time T reaches the predetermined time t1 is determined at step ST4. The time t1 is set a little longer than the time normally required for the drive shaft 61, in the completely forward rotation state (see FIGS. 20(*a*)–(*c*)), to be reversely rotated and returned to the standby position (see FIGS. 17(*a*)–(*c*)). Therefore, at the normal operation time, the determination at step ST4 is "No" and control goes to step ST5 at which point whether or not the detector 91 is turned on is determined. If the detector 91 is turned on, it means that the drive shaft 61 returned to the standby position, thus the motor 65 is stopped at step ST6 and control goes to step ST9. If the detector 91 is turned off, it means that the drive shaft 61 did not return to the standby position, thus returns to step ST3 for repeating the above-mentioned operation. If it is determined at step ST4 that the predetermined time t1 has elapsed while the operation is repeated, some error is assumed to occur. Then, the motor 65 is stopped at step ST7 and an error message is displayed on the display means (not shown) at step ST8.

(iv) If it is determined at step ST2 that the detector 91 is on, namely, the drive shaft 61 is at the standby position, the motor 65 is rotated forward (clockwise) for forward rotation of the drive shaft 61 until the other detector 92 detects the detected piece 64*a* (see FIG. 15(*c*)) at steps ST9–ST15 to drop the cutting means 50 for cutting continuous paper. If the drive shaft 61 does not move from the standby position even after the expiration of a predetermined time (t2) or if the other detector 92 does not detect the detected piece 64*a* even after the expiration of a predetermined time (t3), some error is assumed to occur. Then, the motor 65 is stopped at step ST7 and an error message is displayed on the display means (not shown) at step ST8.

More particularly, first the motor 65 is rotated forward (clockwise) for forward rotating the drive shaft 61 at step ST9.

Next, whether or not the elapsed time T reaches the predetermined time t2 is determined at step ST10. The time t2 is set a little longer than the time normally required for the drive shaft 61 at the standby position (see FIGS. 17(*a*)–(*c*) and 15(*a*)) to rotate forward and the lever 91*a* of the detector 91 to swing for turning off the detector 91 (HP detection) (if it is determined at step ST2 that the detector 91 is off, the time required to determine at step ST5 that the detector 91 is on is added).

Therefore, in normal operation, the determination at step ST10 is "No" and control goes to step ST11.

At step ST11, whether or not the detector 91 is turned off is determined.

If the detector 91 is on, it means that the drive shaft 61 did not yet completely exit from the standby position, thus control returns to step ST9 for repeating the above-mentioned operation. If it is determined at step ST10 that the predetermined time t2 has elapsed while the operation is repeated, some error is assumed to occur. Then, the motor 65 is stopped at step ST7 and an error message is displayed on the display means (not shown) at step ST8.

If the detector 91 is turned off within the predetermined time t2, it means that the drive shaft 61 is normally rotating (see FIG. 15(*b*)). Then, successively the motor 65 is rotated forward (clockwise) at step ST12 and whether or not the elapsed time T reaches the predetermined time t3 is determined at step ST13. The time t3 is set a little longer than the time normally required for the drive shaft 61 at the standby position (see FIGS. 17 and 15(*a*)) to forward rotate and the detected piece 64*a* to swing the lever 92*a* of the other detector 92 for turning off the other detector 92 (RP detection) (if it is determined at step ST2 that the detector is off, the time required to determine at step ST5 that the detector is on is added).

Therefore, in normal operation, the determination at step ST13 is "No" and control goes to step ST14.

At step ST14, whether or not the other detector (RP detection) 92 is turned on is determined.

If the other detector 92 is off, it means that the drive shaft 61 did not yet completely rotate, thus control returns to step ST12 for repeating the above-mentioned operation. If it is determined at step ST13 that the predetermined time t3 has elapsed while the operation is repeated, some error is assumed to occur. Then, the motor 65 is stopped at step ST7 and an error message is displayed on the display means (not shown) at step ST8.

If the detector 92 is turned on within the predetermined time t3, it means that the drive shaft 61 has normally rotated completely, namely, the continuous paper has been cut. Then, the motor 65 is stopped at step ST15 and the return operation is executed at steps ST16 and below.

(v) The return operation is performed by rotating the motor 65 reversely (counterclockwise) for reversely rotating the drive shaft 61 and returning the shaft to the standby position at steps ST16–ST22. If the drive shaft 61 does not move from the rotation end position (see FIG. 15(*c*)) even after the expiration of a predetermined time (t4) or does not return to the standby position (see FIG. 15(*a*)) even after the expiration of a predetermined time (t5), some error is assumed to occur. Then, the motor 65 is stopped at step ST7 and an error message is displayed on display means (not shown) at step ST8.

More particularly, first the motor 65 is rotated in reverse (counterclockwise) for reversely rotating the drive shaft 61 at step ST16.

Next, whether or not the elapsed time T reaches the predetermined time t4 is determined at step ST17. The time t4 is set a little longer than the time normally required for the drive shaft 61 at the rotation end position (see FIG. 15(*c*)) to reversely rotate and the lever 92*a* of the other detector 92 to swing to turn off the detector 92 (RP detection) (if it is determined at step ST2 that the detector is off, the time required to determine at step ST5 that the detector is on is added).

Therefore, in normal operation, the determination at step ST17 is "No" and control goes to step ST18.

At step ST18, whether or not the other detector 92 (RP detection) is turned off is determined.

If the detector 92 is on, it means that the drive shaft 61 has not yet completely exited from the complete rotation position (rotation end position), thus control returns to step ST16 for repeating the above-mentioned operation. If it is determined at step ST17 that the predetermined time t4 has elapsed while the operation is repeated, some error is assumed to occur. Then, the motor 65 is stopped at step ST7 and an error message is displayed on the display means (not shown) at step ST8.

If the detector 92 is turned off within the predetermined time t4, it means that the drive shaft 61 is normally rotating in reverse. Then, successively the motor 65 is rotated in reverse (counterclockwise) at step ST19 and whether or not the elapsed time T reaches the predetermined time t5 is determined at step ST20. The time t5 is set a little longer than the time normally required for the drive shaft 61 at the rotation end position (see FIG. 15(*c*)) to be reversely rotated and returned to the standby position (see FIG. 15(*a*)) (if it is determined at step ST2 that the detector is off, the time required to determine at step ST5 that the detector is on is added).

Therefore, in normal operation, the determination at step ST20 is "No" and control goes to step ST21.

At step ST21, whether or not the detector (HP detection) 91 is turned on is determined.

If the detector 91 is off, it means that the drive shaft 61 did not return to the standby position, thus control returns to step ST19 for repeating the above-mentioned operation. If it is determined at step ST20 that the predetermined time t5 has elapsed while the operation is repeated, some error is assumed to occur. Then, the motor 65 is stopped at step ST7 and an error message is displayed on the display means (not shown) at step ST8.

If the detector 91 is turned on within the predetermined time t5, it means that the drive shaft 61 has normally returned to the standby position. Then, the motor 65 is stopped at step ST22.

One cutting operation and one return operation are now complete.

The continuous paper cutting unit produces the following effects:

(1*a*): At the standby time, the cutting means 50 is held at the standby position by the cutting means link mechanism 60. The press means 40 is held at the standby position by the press means link mechanism 70 in a state in which it is against the energization force of the energization means 43.

At the time of the cutting operation, the press means link mechanism 70 allows the energization means 43 to move the press means 40 to the paper feed guide 36 and the paper discharge guide 37. Thus, the press means 40 moves to the paper feed guide 36 and the paper discharge guide 37 and the continuous paper P is pressed between the press means 40 and the paper feed guide 36 and the paper discharge guide 37. The press force is provided by the energization force of the energization means 43. The cutting means link mechanism 60 moves the cutting means 50 to the perforations Pa for cutting the continuous paper P along the perforations Pa.

At this time, the continuous paper P is pressed on both sides of the perforations Pa by the paper feed guide 36, the paper discharge guide 37, and the press means 40, and the cutting means 50 extends in the same direction as the perforations Pa of the continuous paper P and is longer than the perforations Pa. Thus, the continuous paper P is cut along the perforations Pa.

After the press means 40 is pressed against the paper feed guide 36 and the paper discharge guide 37 via the continuous paper P at the cutting operation time, the press means link mechanism 70 is freed from support of the press means 40. Thus, the drive force required at the cutting time may be small.

(1*b*): Since the cutting means link mechanism 60 and the press means link mechanism 70 are driven by the single common drive shaft 61, the structure can be simplified and the cutting unit can be miniaturized.

Moreover, at the cutting time, the energization force of the energization means 43 for moving the press means 40 to the paper feed guide 36 and the paper discharge guide 37 aids in moving the cutting means 50 in the cutting direction by the cutting means link mechanism 60, so that the cutting means 50 can be moved by a smaller drive force of the motor.

Therefore, the motor drive force required at cutting time may be smaller.

(1*c*): The cutting means 50 can cut the continuous paper P reliably along the perforations Pa because the abutment part against the continuous paper P is shaped like a circular arc when viewed from the perforation direction.

Assume that the cutting means is made of a sharp-edged tool, for example. Because of sharpness of the blade of the tool, the continuous paper P is cut at a position shifting from the perforations Pa unless the blade correctly cuts the paper along the perforations Pa.

In contrast, according to the continuous paper cutting unit of the embodiment, the abutment part of the cutting means 50 against the continuous paper P is shaped like a circular arc when viewed from the perforation direction. Thus, if the cutting means 50 abuts a position shifting a little from the perforations Pa, the continuous paper P is torn and cut along the perforations Pa.

Therefore, the continuous paper cutting unit of the embodiment can cut the continuous paper reliably along the perforations Pa.

(1*d*): The cutting means link mechanism 60 comprises the arms 62L and 62R pivoting together with the drive shaft 61 and the connecting rods 63L and 63R connected pivotably to the arms 62L and 62R and the cutting means 50. The press means link mechanism 70 comprises the arms 62L and 62R pivoting together with the drive shaft 61 and the connecting rods 71L and 71R connected pivotably to the arms 62L and 62R and the press means 40 and the connecting rods 71L and 71R and the arms 62L and 62R are connected slidably via the long holes 72. Thus, the cutting unit can be made in a comparatively simple structure.

(1*e*): After the cutting means 50 cuts the paper, the drive shaft 61 is rotated in reverse and returns to the standby position. Thus, the cutting unit can be miniaturized.

Figures 56A, 56B, 56C, 56D, 56E:
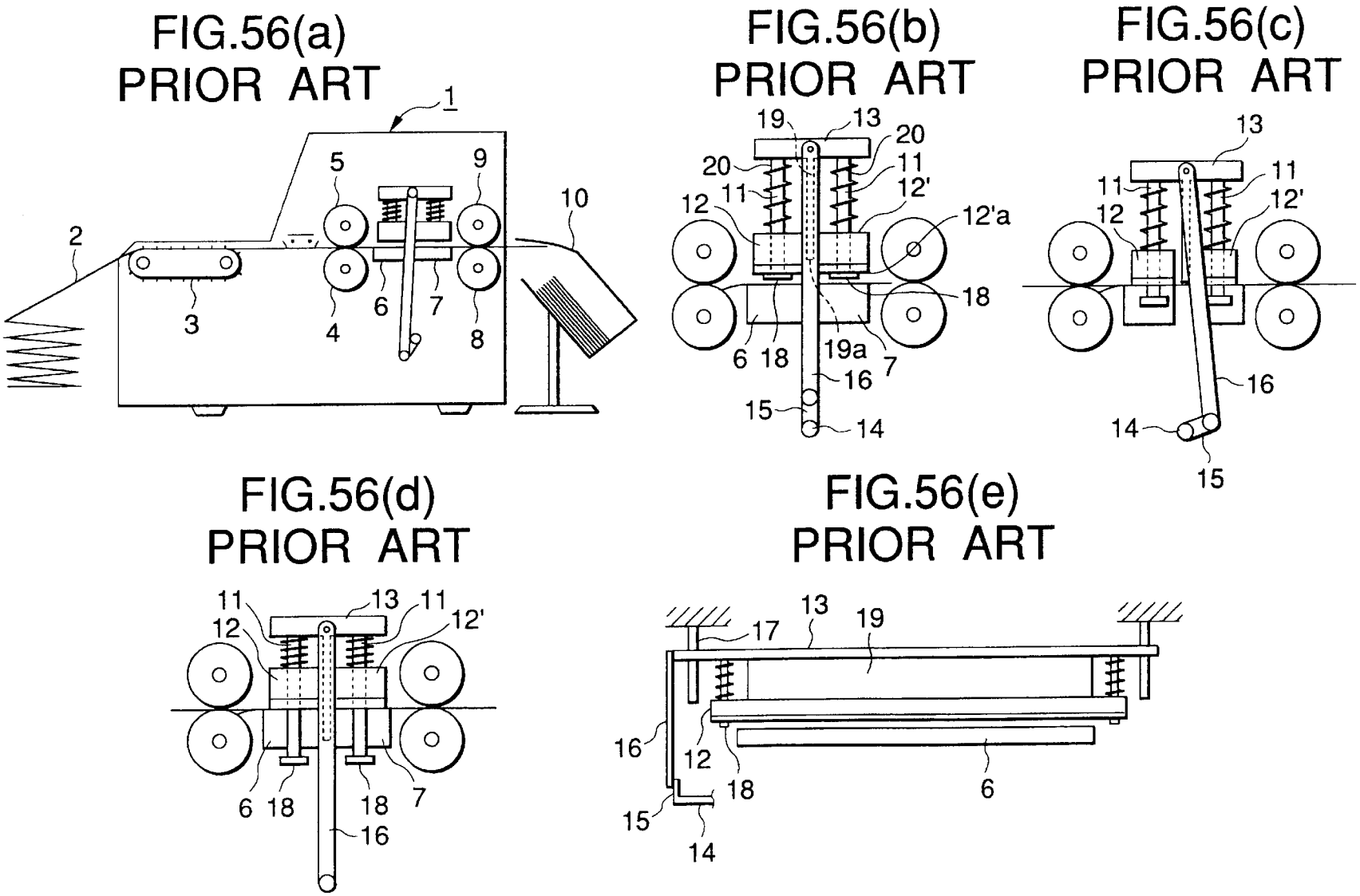
FIG.56(a) PRIOR ART
FIG.56(b) PRIOR ART
FIG.56(c) PRIOR ART
FIG.56(d) PRIOR ART
FIG.56(e) PRIOR ART
FIGS. 56(*a*)–(*e*) are illustrations of related art.
Figure 57A:
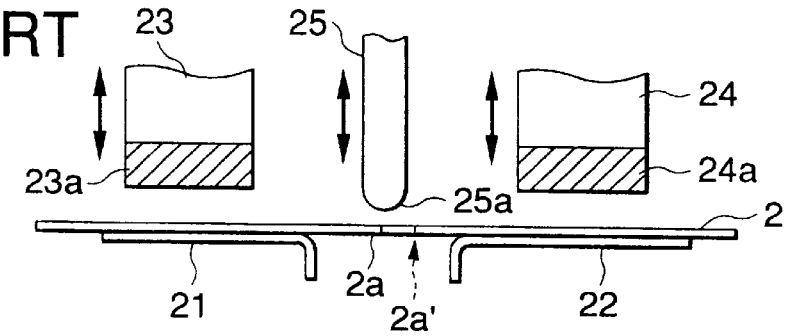
FIG.57(a) PRIOR ART
FIGS. 57(*a*)–(*d*) are illustrations of related art.
Figure 57B:
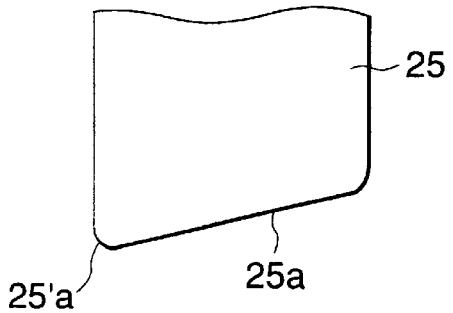
FIG.57(b) PRIOR ART
Figure 57C:
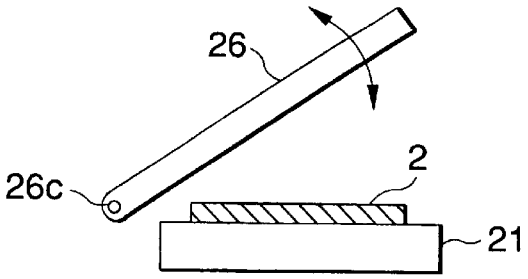
FIG.57(c) PRIOR ART
Figure 57D:
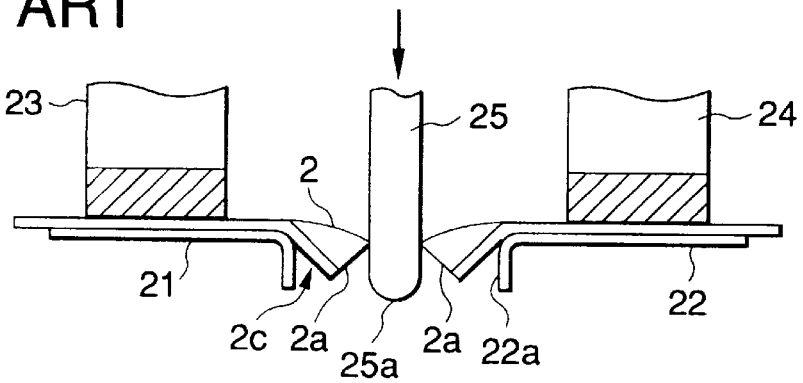
FIG.57(d) PRIOR ART

If the drive shaft makes one turn and returns to the standby position as in the conventional cutting unit shown in FIG. 56, a space to allow at least one of the links making up a link mechanism to make one turn is required, so that the cutting unit increases in size as much as the space.

In contrast, according to the continuous paper cutting unit of the embodiment, since the drive shaft 61 is rotated in reverse and returns to the standby position, the space becomes unnecessary and the cutting unit can be decreased in size as much as the space.

(2*a*): The cutting unit comprises the guide means (33*a*) which are placed facing the upstream support means 36 in the continuous paper transport direction, of a pair of support means 36 and 37, for guiding one face of continuous paper P when the continuous paper P is transported, for forming the paper feed port 38 of the continuous paper P between the guide means and the support means 36, and guiding the other face of the continuous paper P passing through the feed port 38. Thus, the fed continuous paper P is guided into the feed port 38 by the support means 36 and the guide means (33*a*).

Further, the spacing h2 between the opposed face (42*a*) of at least the upstream press part 42 in the continuous paper transport direction, of a pair of press parts 42 and 42', when continuous paper is transported, to the continuous paper and the continuous paper support face 36*b* of the upstream support means 36, is formed larger than the spacing h1 between the guide means (33*a*) at the feed port 38 and the continuous paper support face 36*b* of the upstream support means 36. Thus, the continuous paper P passing through the feed port 38 does not strike against the press part 42 or becomes extremely hard to strike against the press part 42.

Therefore, the continuous paper cutting unit can produce a smooth feed state of the continuous paper P.

(2*b*): The cutting unit comprises the guide means (33*b*) having an inclined paper guide face 33*c* being placed facing the downstream support means 37 in the continuous paper transport direction for forming the paper discharge port 39 of the continuous paper P between the guide means and the support means 37 and guiding the other face of the continuous paper P directed for the discharge port 39. Thus, the transported continuous paper P is guided into the discharge port 39 by the support means 37 and the guide means (33*b*).

Further, the spacing h6 between the upstream end of the paper guide face 33*c* and the continuous paper support face 37*b* of the support means 37 is formed large as compared with the-spacing h5 between the opposed face (42'*a*) of the downstream press part 42' to the continuous paper and the continuous paper support face 37*b* of the downstream support means 37, and the spacing h7 between the guide means (33*b*) at the discharge port 39 and the continuous paper support face 37*b* of the downstream support means 37 is formed small as compared with the spacing h5. Thus, the continuous paper P passing through between the downstream press part 42' and the support means 37 is guided reliably into the discharge port 9 along the inclined paper guide face 33*c*.

Therefore, the continuous paper cutting unit can produce a smooth feed or transport state of the continuous paper P.

(2*c*): As a result of the effects (2*a*) and (2*b*), a smooth feed or transport state of the continuous paper P is produced over the passage from the feed port 38 to the discharge port 39.

(2*d*): The press means 40 advancing and retracting with respect to a pair of the support means 36 and 37 is guided by the guide means (upper frame 33), and thus can be advanced and retracted smoothly.

Moreover, the guide means (33*a*, 33*b*) is formed by a part of the upper frame 33, so that any other guide means other than the upper frame 33 need not be provided.

Therefore, the continuous paper cutting unit enables the press means 40 to advance and retract smoothly and can produce a smooth feed or transport state of the continuous paper with a small number of parts.

(2*e*): The press part 42, 42' has the continuous paper press face 42*a*, 42'*a* parallel with the continuous paper support face 36*b*, 37*b* of the support means 36, 37 and the slope 42*f*, 42'*f* contiguous with the continuous paper press face 42*a*, 42'*a* on the upstream side in the continuous paper transport direction and inclined to the upstream side so that it goes away from the support face 36*b*, 37*b*. Thus, the slopes 42*f* and 42'*f* play a role in guiding the continuous paper P. Therefore, a smoother feed or transport state of the continuous paper is produced.

(2*f*): The press means 40 is formed with the moderate projections 41*g* and 41'*g* covering the end margin parts 42*f*1 and 42'*f*1 of the slopes 42*f* and 42'*f* when viewed from the upstream side in the continuous paper transport direction (see FIG. 4). Thus, the tip of continuous paper is guided along the projections 41*g* and 41'*g* and does not strike against the end margin part 42*f*1 or 42'*f*1 of the slope.

Therefore, a still smoother feed or transport state of the continuous paper is produced.

(2*g*): When the continuous paper P is transported, the cutting means 50 is held by the cutting means link mechanism 60 so that the abutment part 50*a* shaped like a circular arc when viewed from the perforation direction becomes substantially parallel with the support face 36*b*, 37*b* at the distance (h3) substantially equal to the distance between the continuous paper P support face 36*b*, 37*b* of the support means 36, 37 and the press part 42, 42' (h2, h5), as shown in FIG. 4. Thus, the circular arc abutment part 50*a* serves as a guide for guiding the tip of the continuous paper P (after cutting, the cut part) together with a pair of the press parts 42 and 42'.

Therefore, the continuous paper cutting unit can produce a still smoother feed or transport state of the continuous paper P.

(2*h*): As shown in FIG. 4, the guide face 41*c* for guiding the continuous paper P between the press part 42' positioned downstream in the continuous paper transport direction from the cutting means 50 and the support means 37 positioned downstream from the support means 36 is formed between the press means 42' and the cutting means 50 at the continuous paper transport time. Thus, the continuous paper P passing through from the cutting means 50 in the downstream direction therefrom is guided reliably into the space between the press means 42' and the support means 37 positioned downstream.

Therefore, a still smoother feed state of the continuous paper P is produced.

Moreover, the guide face 41*c* is formed by the moving frame 41, a part of the press means 40, so that any other guide means than the press means 40 need not be provided.

(2*i*): As shown in FIG. 4, when the continuous paper P is transported, the cutting means link mechanism 60 holds the cutting means 50 so that the abutment part 50*a* becomes substantially parallel with the support face 36*b*, 37*b* at the distance (h3) a little longer than the distance between the support face 36*b*, 37*b* of the support means 36, 37 and the press part 42, 42' (h2, h5). Thus, the cutting means 50 abuts and guides the continuous paper P only if the continuous paper P attempts to enter the space between a pair of the press parts 42 and 42'.

Therefore, the cutting means 50 (see FIGS. 9(*a*) and (*b*) and 10(*a*) and (*b*)) does not interfere with the continuous paper P more than necessary and a still smoother feed state of the continuous paper P is produced.

(2*j*): The cutting means link mechanism 60 comprises the drive shaft 61, a pair of the arms 62L and 62R disposed at both ends of the drive shaft 61 and pivoting together with the drive shaft 61, and a pair of the connecting rods 63L and 63R connected to the arms and both end parts of the cutting means 50. The connection part of the left arm 62L and the connection rod 63L (pin 62L1 portion) and the connection part of the right arm 62R and the connection rod 63R (pin 62R1 portion) are placed out of phase by angle $\alpha$ with respect to the portion around the drive shaft 61. Thus, the cutting means link mechanism 60 can be simplified.

The mechanism for causing the cutting means 50 to make the motion as described above can also be formed using a mechanism with a cylinder, such as a mechanism for supporting both ends of the cutting means on separate cylinders, or a mechanism with a cam, for example.

However, the cylinder mechanism becomes complicated in structure and also becomes heavy. If an attempt is made to provide a desired stroke of the cutting means with the cam structure, the weight of the cam itself increases, thus the whole mechanism still becomes heavy.

In contrast, according-to the embodiment, the cutting means link mechanism can be simplified and therefore can be slimmed down.

(3*a*): When the continuous paper P is transported, the movable guide means 80 faces the cutting space C as shown in FIG. 16(*a*), whereby the continuous paper P is guided by the movable guide means 80, thus preventing the continuous paper P from entering the cutting space C.

Therefore, a smooth transport state of the continuous paper P is produced without causing a paper jam to occur.

When the continuous paper P is cut, the movable guide means 80 retracts from the cutting space C, so that the movable guide means 80 does not hinder the cutting means 50 from cutting the continuous paper P.

(3*b*): The movable guide means 80 retracts in the direction orthogonal to the length direction of the slit-like cutting space C, and thus can retract promptly.

The movable guide means can also be retracted in the length direction of the slit-like cutting space C (direction orthogonal to the paper face of FIG. 16, namely, the length direction of the slit).

However, if the movable guide means is retracted in the length direction of the cutting space, it takes time to retract the movable guide means so as to allow the cutting means 50 to pass through the cutting space C, namely, so as not to hinder the cutting means 50 from cutting the continuous paper P.

In contrast, according to the continuous paper cutting unit of the embodiment, the movable guide means 80 retracts in the direction orthogonal to the length direction of the slit-like cutting space C, and thus can retract promptly.

(3*c*): As shown in FIG. 11, the notches 36*a* and 37*a* are made like comb teeth in the end margins of a pair of the support means 36 and 37 facing the cutting space C, and the ribs 85 entering the notches 36*a* and 37*a* are formed in the movable guide means 80, forming the continuous paper guide face 85*a*. Thus, the continuous paper P can be guided more smoothly.

More particularly, the continuous paper P is guided first by the support means 36 positioned upstream in the continuous paper transport direction, next by the movable guide means 80, then by the support means 36 positioned downstream in the transport direction. The notches 36*a* and 37*a* like comb teeth are made in the end margins of a pair of the support means 36 and 37 facing the cutting space C, and the ribs 85 entering the notches 36*a* and 37*a* are formed in the movable guide means 80, forming the continuous paper guide face. Thus, when the continuous paper P is transported from the upstream support means 36 to the movable guide means 80, it is guided in such a way that it is scooped up by the ribs 85 of the movable guide means 80. When the continuous paper P is transported from the movable guide means 80 to the downstream support means 37, it is guided in such a way that it is scooped up by the portion like comb teeth of the support means 37.

Therefore, the continuous paper P is guided more smoothly.

(3*d*): Since the cutting means 50 is moved by rotation of the drive shaft 61 placed in parallel with the slit-like cutting space C and the movable guide means 80 is attached to the drive shaft 61 and rotates together with the drive shaft 61, the retracting operation of the movable guide means 80 can be carried out in an extremely simple structure.

Various means, such as means using a cylinder mechanism, means using a link mechanism, and means using a cam, can be named as means for causing the movable guide means to perform the retracting operation. However, generally these means become complicated in structure.

In contrast, according to the continuous paper cutting unit, the drive shaft 61 for making the cutting means 50 operate is placed in parallel with the slit-like cutting space C and the movable guide means 80 is attached to the drive shaft 61, whereby the movable guide means 80 rotates together with the drive shaft 61 and retracts, thus the cylinder mechanism, etc., becomes unnecessary. Therefore, the retract operation of the movable guide means 80 can be carried out in an extremely simple structure.

Printer

Figure 24:
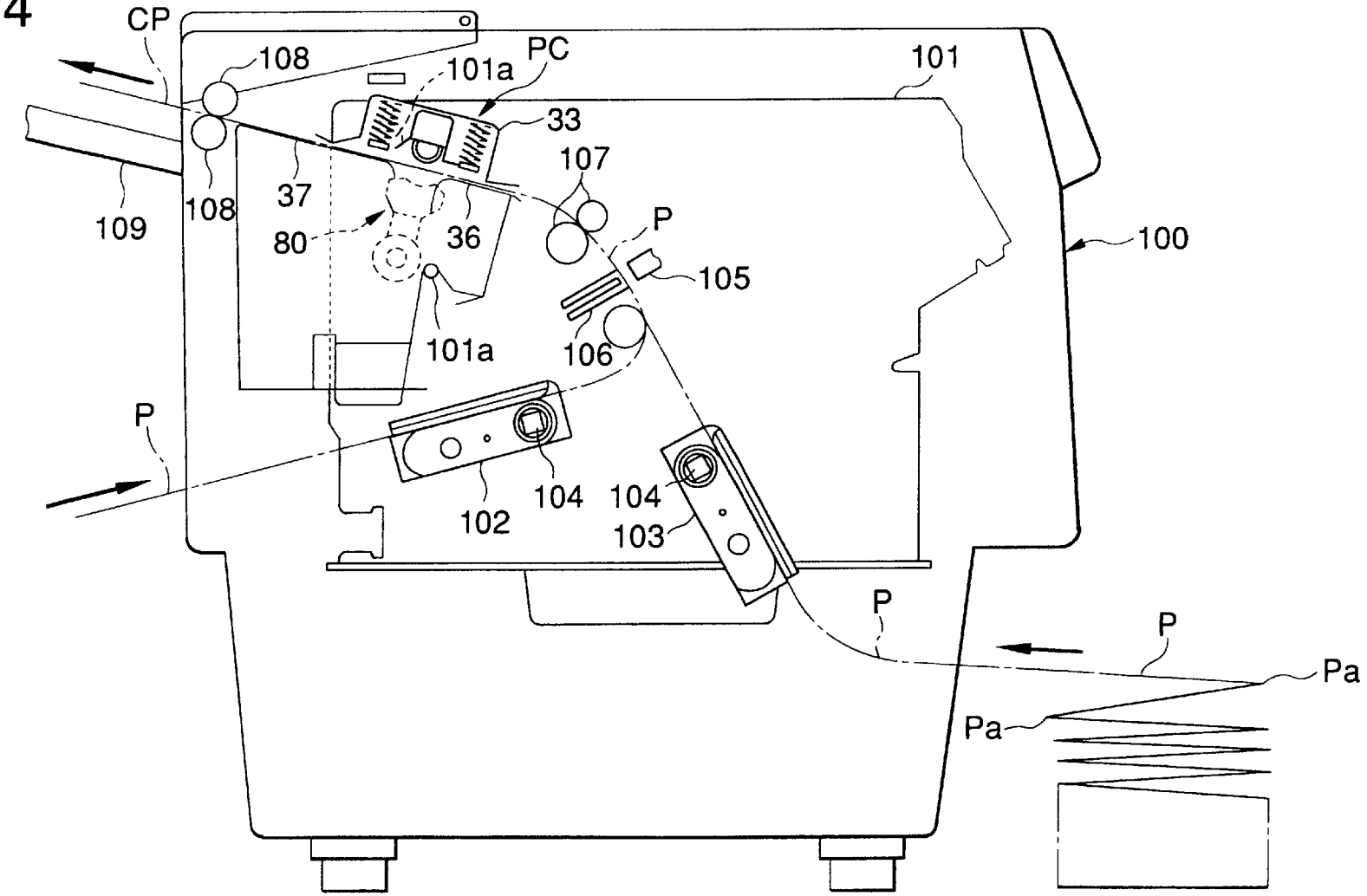
FIG. 24 is a schematic left sectional view of an example of a printer in which the continuous paper cutting unit is built.

FIG. 24 is a schematic left sectional view of a printer in which the continuous paper cutting unit is built.

The continuous paper cutting unit PC is attached detachably to the frame 101 of the printer case 100 using locking parts such as a pin 101*a* disposed in the printer frame 101.

Pin tractors 102, 103 attached to the frame 101 and a drive shaft 104 of the pin tractor is driven by a drive mechanism (not shown), thereby transporting continuous paper P having holes engaging pins of the pin tractor along both side margins. The printer has two paper feed passages and the continuous paper P is transported by means of the pin tractor 102 or 103. Normally, the continuous paper P is fed from the folded state in zigzags, as described above. A paper guide (not shown) is placed on the transport passage of continuous paper.

A print head 105 for printing continuous paper and a platen 106 are provided. Any head can be adopted as the print head 105; if the continuous paper P is multiple-part forms, an impact dot head is adopted.

A transport roller pair 107 is provided as a paper feed means for transporting printed continuous paper to the continuous paper cutting unit PC.

A paper discharge roller pair 108 is provided as paper discharge means for discharging paper CP cut by the continuous paper cutting unit PC to the outside of the machine.

The discharged paper is stacked and held on a paper discharge tray 109.

Thus, if the continuous paper cutting unit PC is built in the printer, at least the transport roller pair 107 of the printer can be used as the paper feed means of the continuous paper cutting unit PC, so that the continuous paper cutting unit PC itself can be furthermore miniaturized.

Although the first embodiment of the invention has been described above, the invention is not limited to the embodiment and different embodiments of the invention may be made without departing from the spirit and scope thereof.

For example, (1) Each of the cutting means link mechanism and the press means link mechanism may be able to be formed by a mechanism using a cam or a cylinder.

(2) The upper frame 33 may be able to be opened and closed.

(3) The projections 41*g*, 41*g*, 41'*g* and 41'*g* of the press plate 42, 42' on an attachment face 41*d*, 41'*d* of the press plate 42, 42' of the moving frame 41 are formed before and after the press plate 42 in the first embodiment, but may be formed only at least before the press plate 42 (upstream in the continuous paper transport direction).

(4) The cutting means link mechanism and the press means link mechanism may be driven by separate drive shafts in some cases.

(5) The abutment part of the cutting means which abuts against continuous paper may not be necessarily shaped like a circular arc in some cases. The cutting means may be any means capable of cutting continuous paper; for example, it may have a sharp blade in some cases.

(6) The abutment part of the cutting means which abuts against continuous paper may be shaped like a circular arc when viewed from the perforation direction; it may be not necessarily shaped like a circular arc as a whole in same cases.

(7) The long hole 72 may be made in the pin 45 side.

Second Embodiment:

A second embodiment of the invention will be discussed below with reference to the accompanying drawings.

Figure 25A:
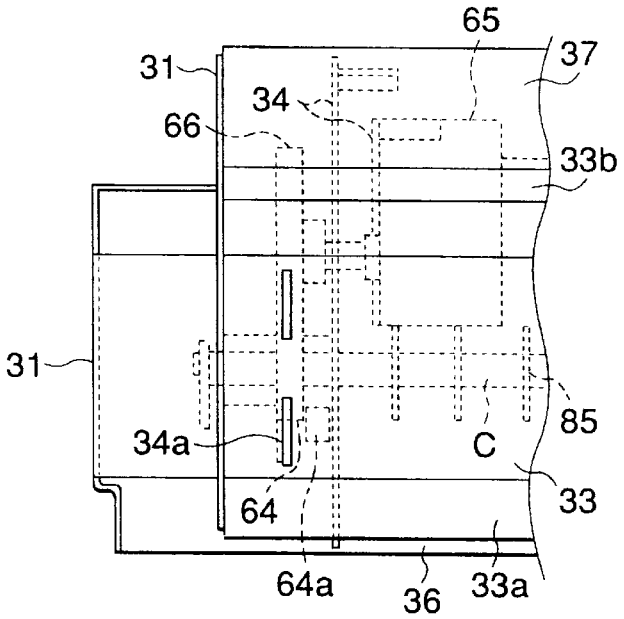
FIGS. 25(*a*)–(*c*) show an outline of a second embodiment of a continuous paper cutting unit according to the invention; (a) is a fragmentary plan view, (b) is a fragmentary front view, and (c) is a left side view.
Figure 25C:
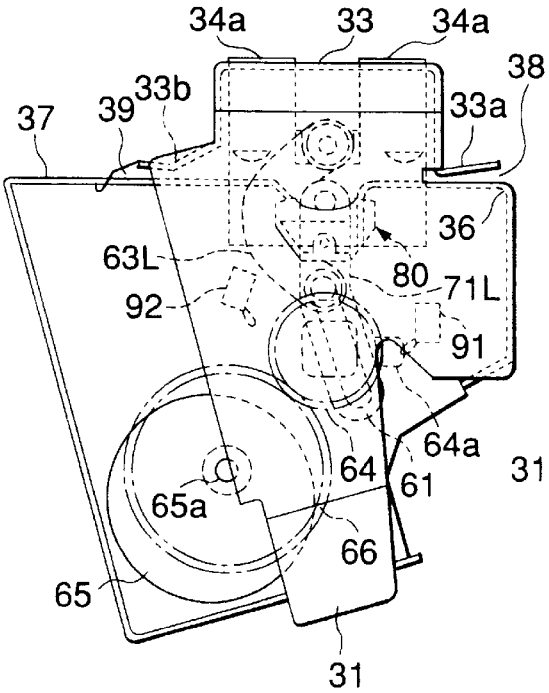
Figure 25B:
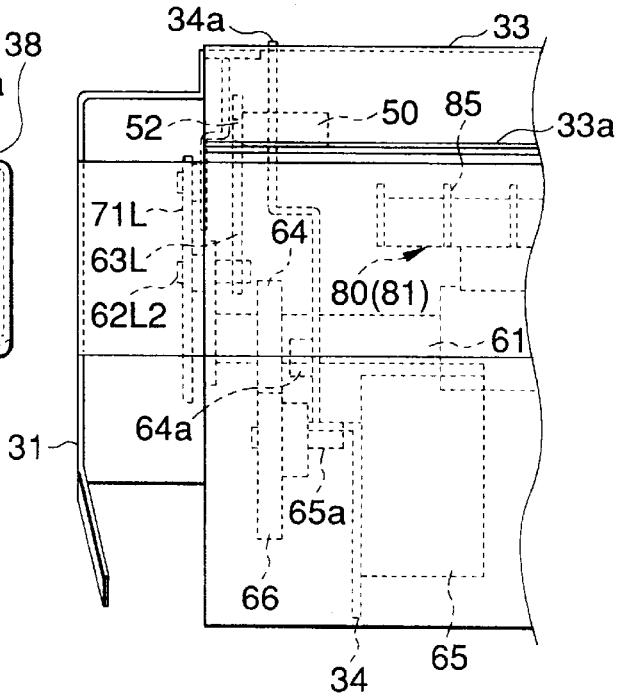
Figure 26A:
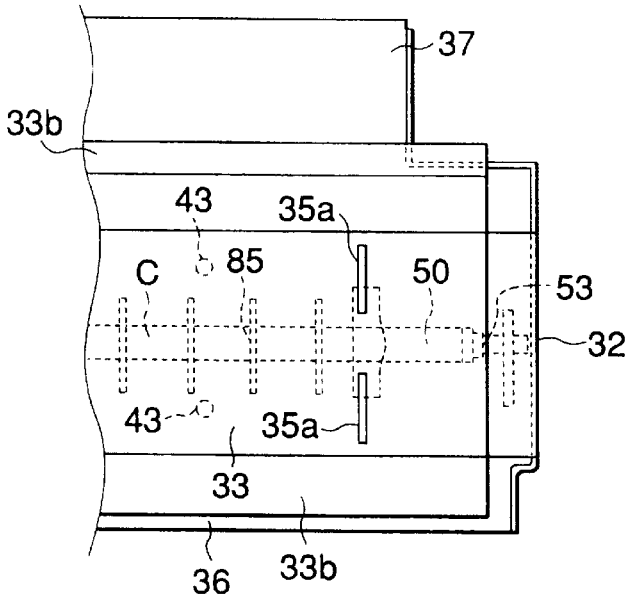
FIGS. 26(*a*)–(*c*) show an outline of the second embodiment of the continuous paper cutting unit according to the invention; (a) is a fragmentary plan view, (b) is a fragmentary front view, and (c) is a right side view.
Figure 26B:
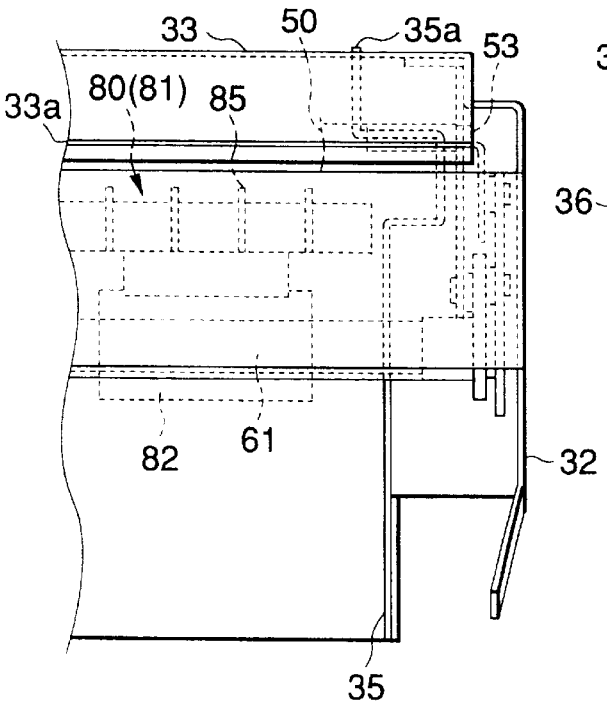
Figure 26C:
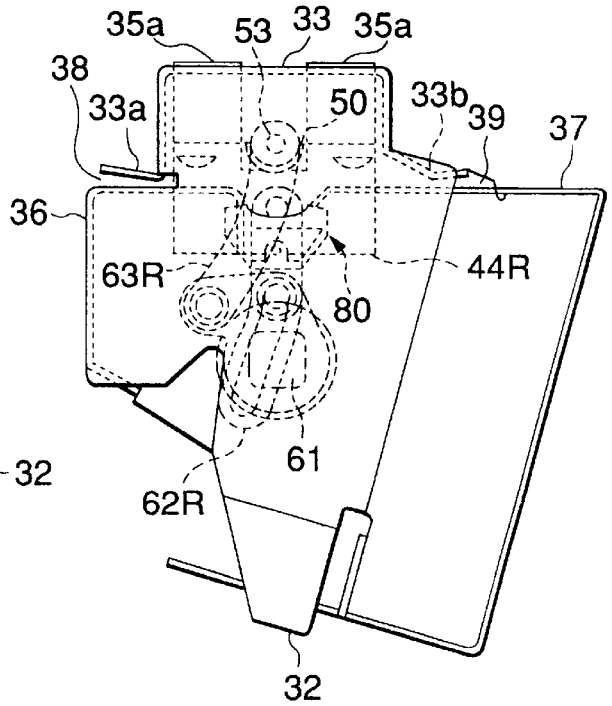
Figure 27:
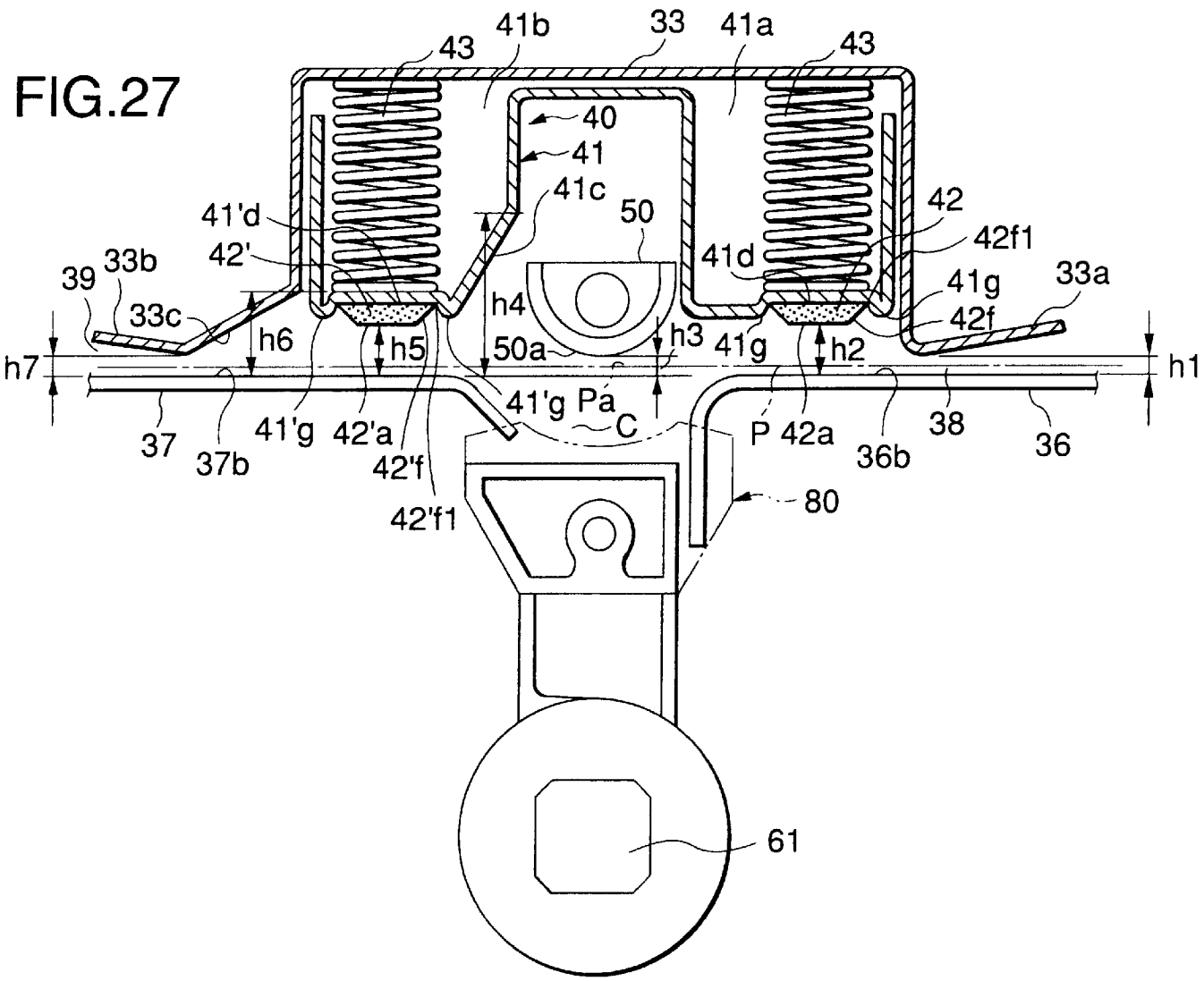
FIG. 27 is an enlarged left sectional view to mainly show an upper frame 33, a paper feed guide 36, a paper discharge guide 37, press means 40, and cutting means 50 of the second embodiment of the invention.
Figure 28A:
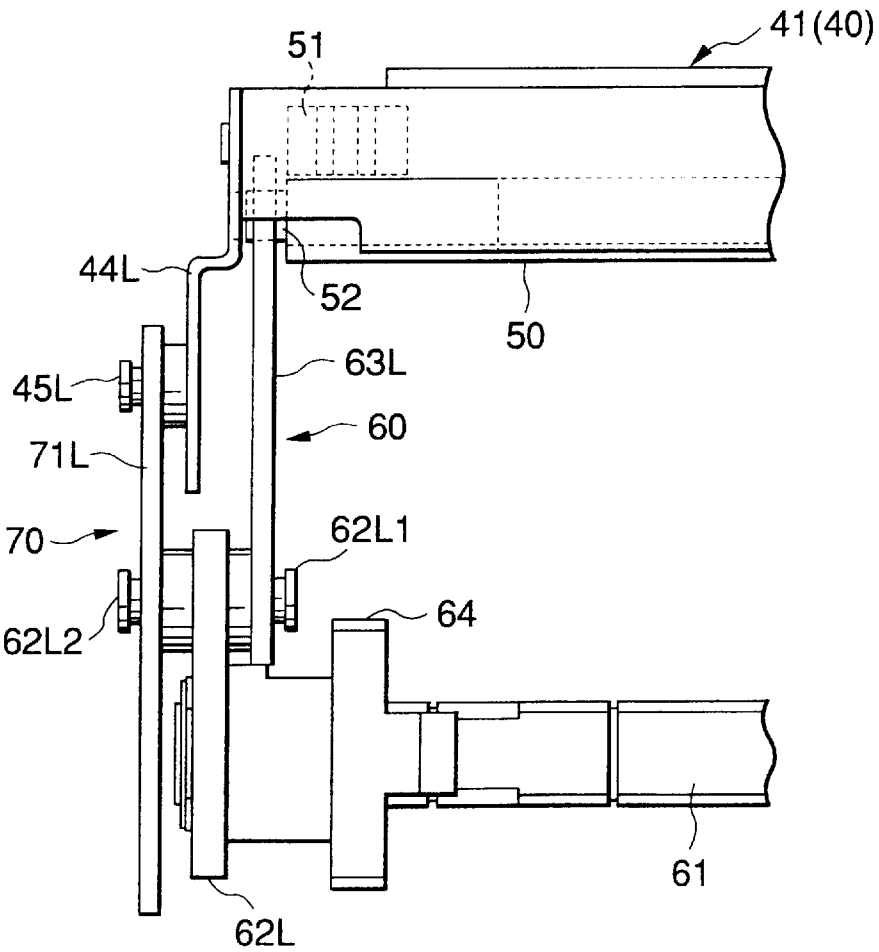
FIGS. 28(*a*) and (*b*) show a cutting means link mechanism 60 and a press means link mechanism 70 of the second embodiment of the invention; (a) is a front view of a left portion and (b) is a left side view.
Figure 28B:
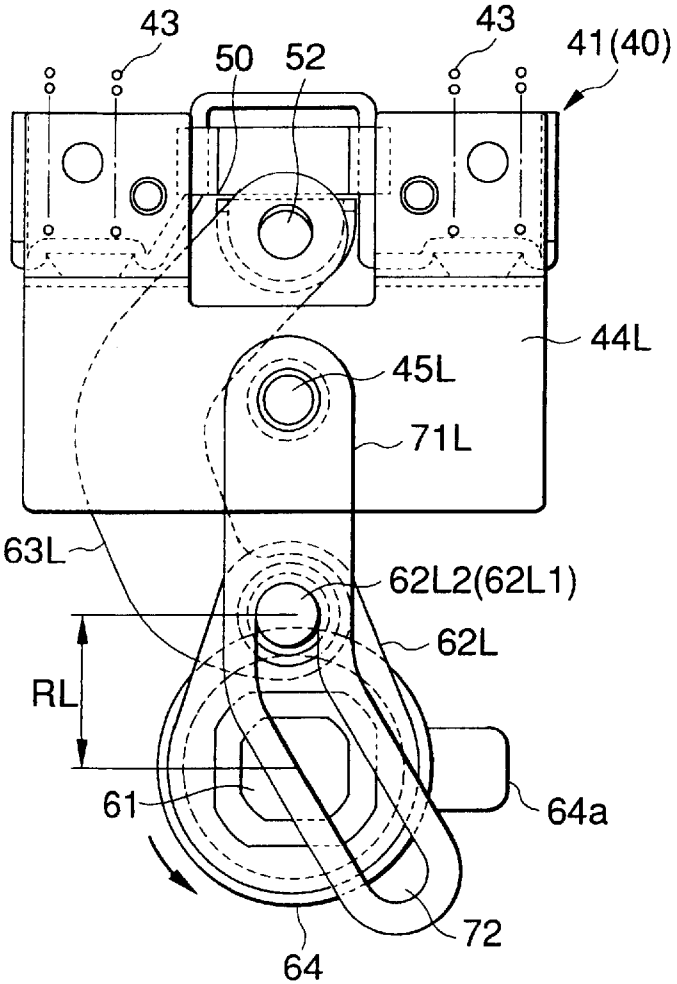

FIGS. 25(*a*)–(*c*) and 26(*a*)–(*c*) and 26 are drawings to show an outline of the second embodiment of a continuous paper cutting unit according to the invention; FIG. 25(*a*) is a fragmentary plan view, (b) is a fragmentary front view, and (c) is a left side view, and FIG. 26(*a*) is a fragmentary plan view, (b) is a fragmentary front view, and (c) is a right side view. FIG. 27 is an enlarged left sectional view to mainly show an upper frame 33, a paper feed guide 36, a paper discharge guide 37, press means 40, and cutting means 50. FIGS. 28(*a*) and (*b*) show a cutting means link mechanism 60 and a press means link mechanism 70; (a) is a front view of a left portion and (b) is a left side view.

As shown in the figures, the second embodiment differs from the first embodiment only in the position of the cutting means 50 when continuous paper P is transported.

When the continuous paper P is transported, the cutting means 50 in the second embodiment is held so that the lower face of an abutment part 50*a* becomes parallel with a continuous paper P support face 36*b*, 37*b* at a small distance (see h3) as compared with a distance between the support face 36*b*, 37*b* of the support means (paper feed guide 36, paper discharge guide 37) and a press part (press plate) 42, 42' (see h2, h5), mainly as shown in FIG. 27. (See also FIG. 30.) If the press part (press plate) 42 and 42' distances (see h2 and h5) differ, the cutting means 50 is held so that the lower face of the abutment part 50*a* becomes parallel with the support face 37*b* at the small distance h3, at least as compared with the distance h5 between the opposed face of the downstream press part 42' to the continuous paper (lower face 42'*a*) and the continuous paper support face 37*b* of the downstream support means 37.

Figure 29A:
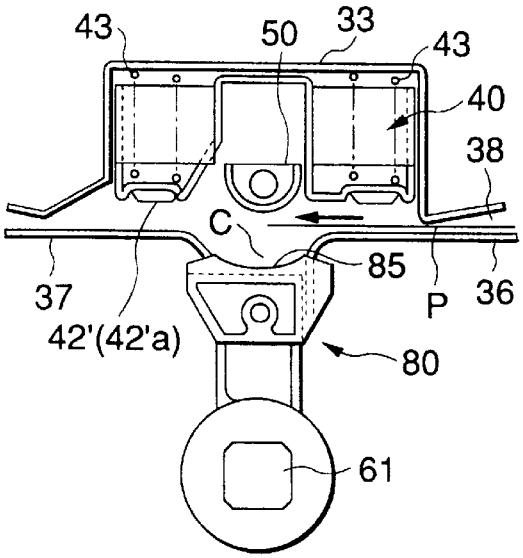
FIGS. 29(*a*), (*b*), and (*c*) are left side views to explain the operation of the second embodiment of the invention.
Figure 29B:
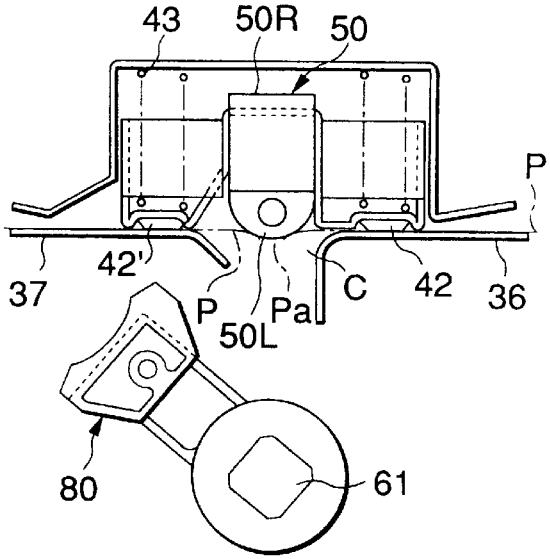
Figure 29C:
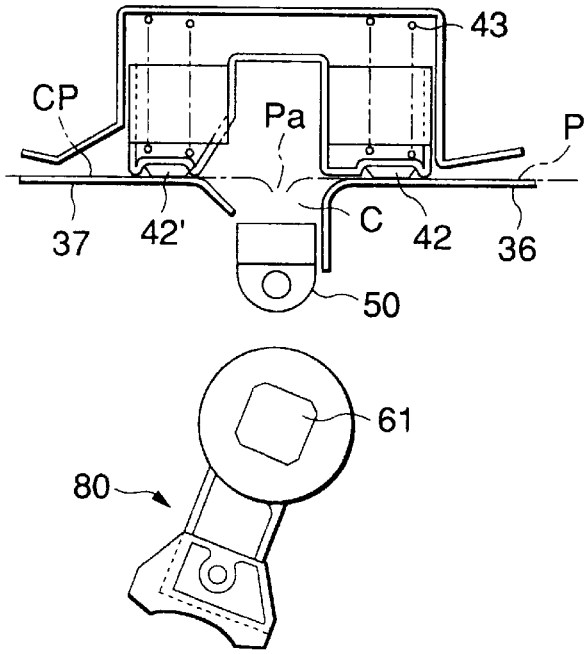

If such a structure is adopted, when the continuous paper P is transported, the cutting means 50 is held so that the lower face of the abutment part 50*a* becomes parallel with the support face 37*b* at the small distance h3, at least as compared with the distance h5 between the opposed face of the downstream press part 42' to the continuous paper (lower face 42'*a*) and the continuous paper support face 37*b* of the downstream support means 37, as shown in FIGS. 27 and 29(*a*). Thus, the abutment part 50*a* itself of the cutting means 50 which abuts against the continuous paper P serves as a guide for guiding the continuous paper P.

Moreover, when the continuous paper P is transported, the cutting means 50 is held so that the lower face of the circular arc abutment part 50*a* becomes parallel with the support face 36*b*, 37*b* at the small distance h3 as compared with the distance of the spacing h5 between the opposed face of the press part 42' to the continuous paper (lower face 42'*a*) and the continuous paper support face 37*b* of the support means 37. Thus, if the edge of the continuous paper P after cutting is turned up a little, it does not strike against the downstream press part 42' or becomes extremely hard to strike against the downstream press part 42'.

Therefore, according to the second embodiment, a still smoother feed or transport state of the continuous paper P can be produced as compared with the first embodiment.

In the second embodiment, resultantly $t<h1<h2$ $h3<h2$ $h3<h4$ $h3<h5<h6$ $t<h7<h5$ h3 is set substantially equal to h1.

According to the structure, as shown in FIG. 29 (a), when the continuous paper P is fed from a paper feed port 38 to a cutting space C, $t<h1<h2$, $h3<h4$, $h3<h5<h6$, $t<h7<h5$. Thus, the paper edge hardly comes in contact with the press plate 42, 42' which is made of a highly frictional material such as rubber, and is guided smoothly. Therefore, the smooth paper feed operation is enabled.

Third Embodiment

The continuous paper cutting unit of the first or second embodiment described above holds the continuous paper P by the energization means 43 pressing the paper press means 40 against a pair of the support means 36 and 37, and cuts the continuous paper P. Therefore, the continuous paper P needs to be held by a fairly large force to reliably cut the continuous paper P. Thus, it is desirable that the support means 36, 37 has a structure capable of resisting the large energization force of the energization means 43.

However, in the continuous paper cutting unit of the first or second embodiment, when the continuous paper P is cut by the cutting means 50, the moving guide 80 pivots and retracts from the cutting space C, as shown in FIG. 16(*a*)–(*c*); thus a pivot passage needs to be provided. As a result, it may not be necessarily easy to enhance the strength of the support means 36 and 37, particularly, the support means 37 on the pivot passage side.

The third embodiment is an improvement on the continuous paper cutting unit of the first or second embodiment.

Figure 31:
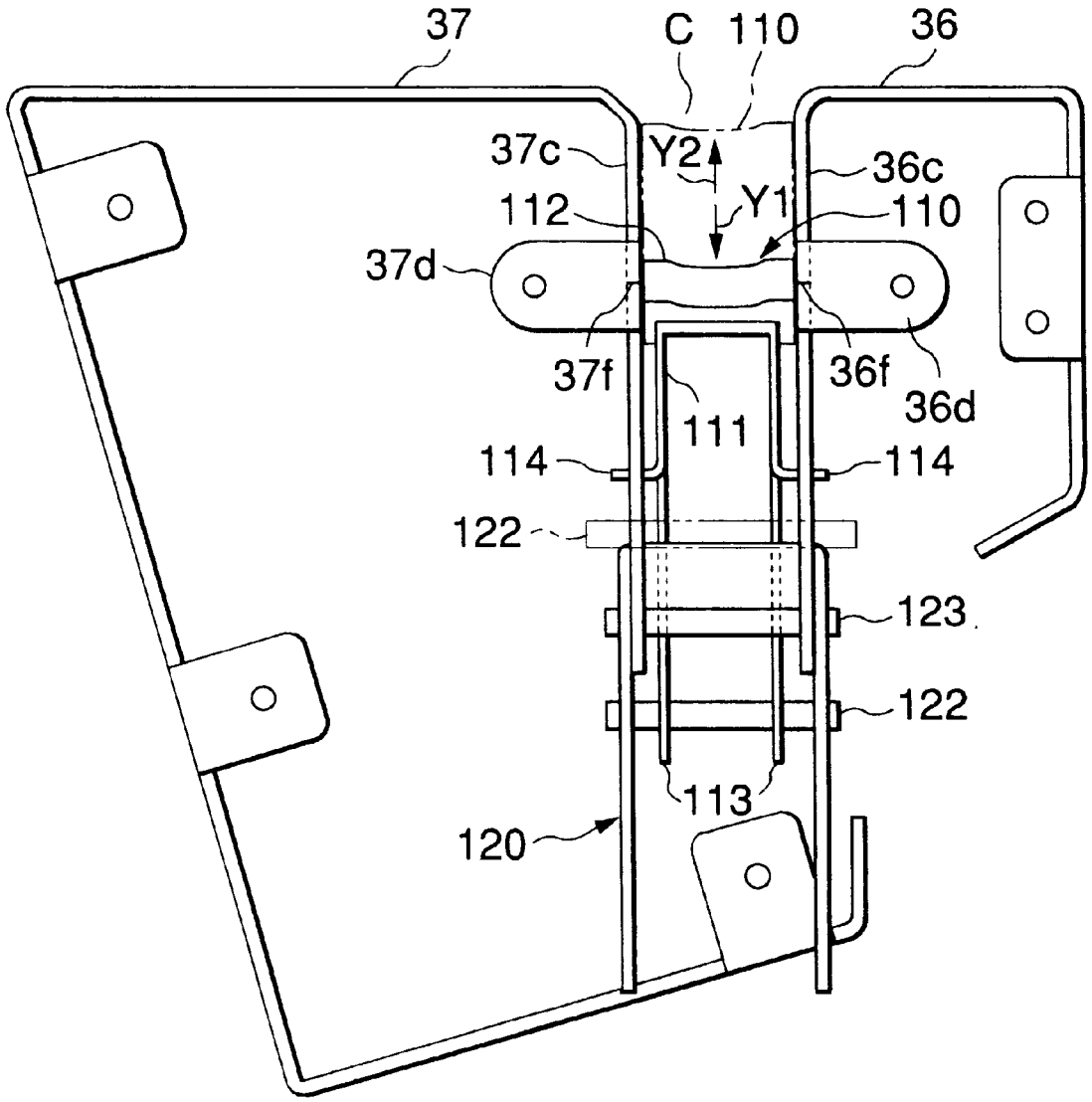
FIG. 31 is a left side view to show the main part of a third embodiment of a continuous paper cutting unit according to the invention.
Figure 32A:
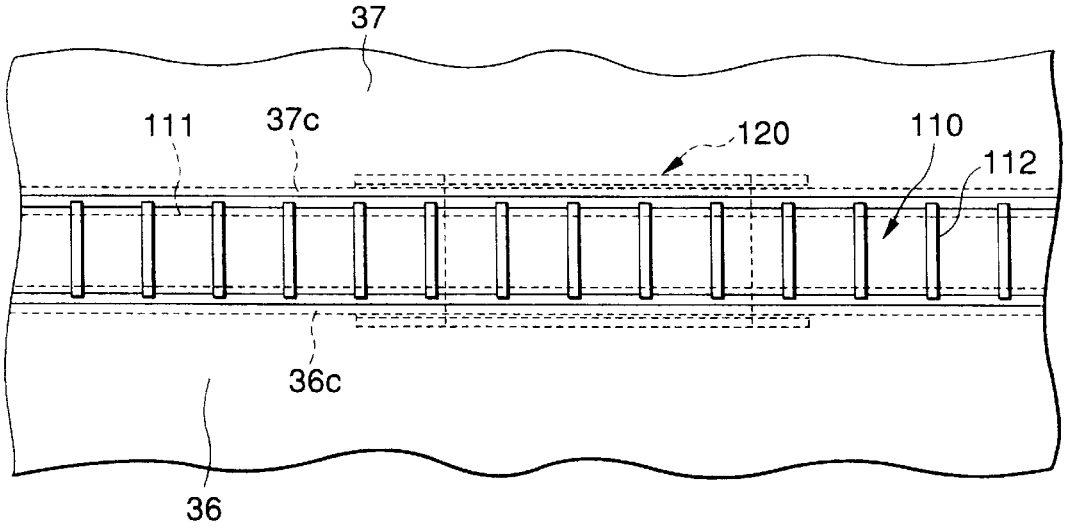
FIGS. 32(*a*) and (*b*) show the main part of the third embodiment; (a) is a fragmentary plan view and (b) is a fragmentary front view.
Figure 32B:
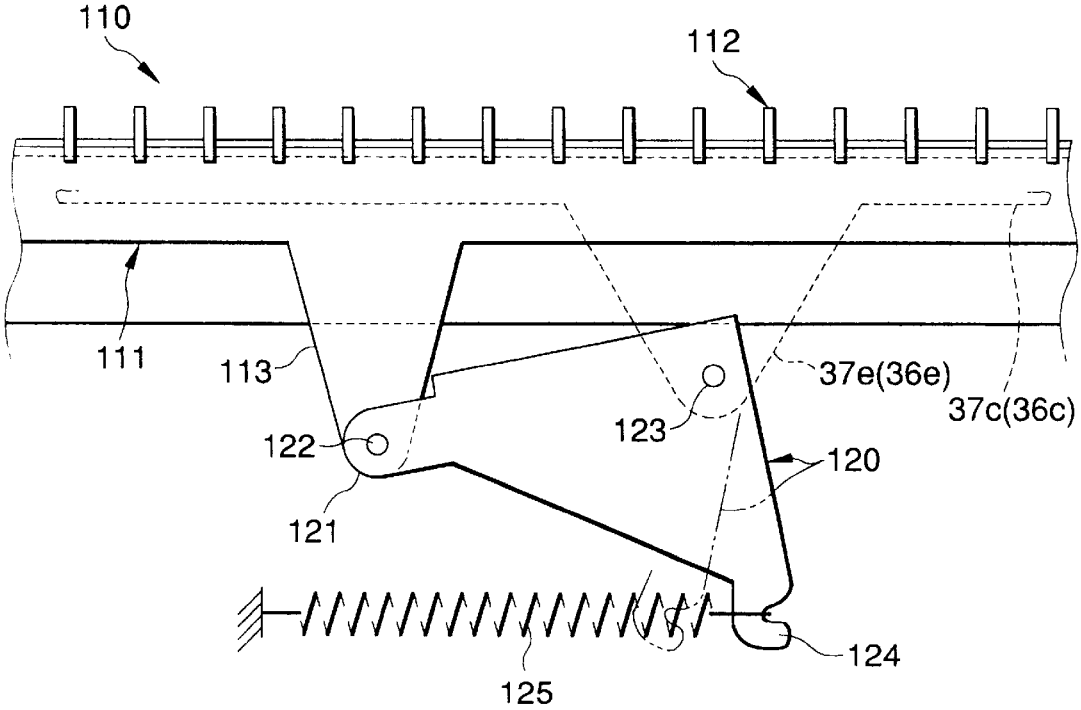
Figure 33A:
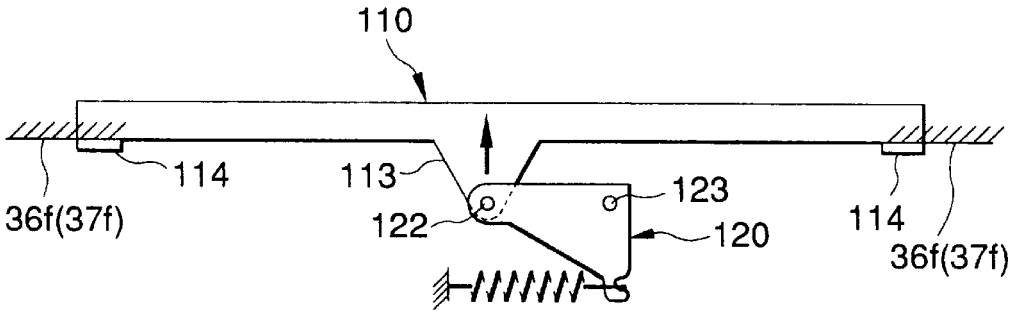
FIG. 33(*a*) and (*b*) are illustrations of the operation of the third embodiment.
Figure 33B:
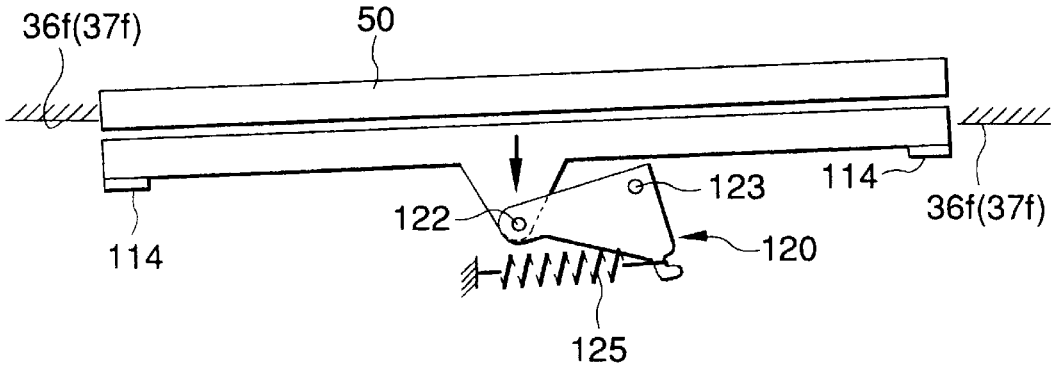
Figure 34A:
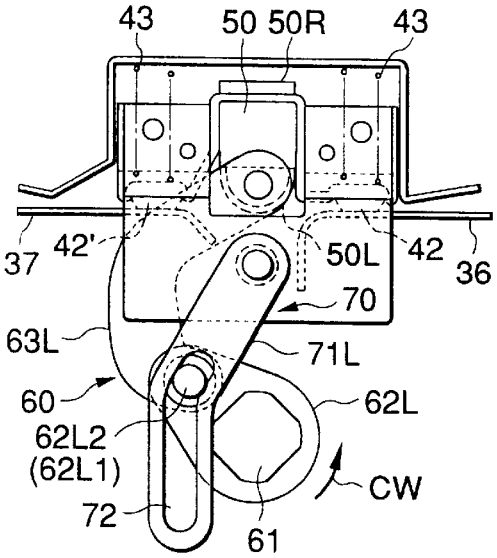
FIGS. 34(*a*)–(*c*) show the operation of a fourth embodiment of a continuous paper cutting unit according to the invention (top dead center state); (a) is a left side view, (b) is a right side view, (c) is a front view of cutting means 50, and (d) is a frontal sectional view to show the relationship between the cutting means 50 and a moving frame 41 of press means 40.
Figure 34B:
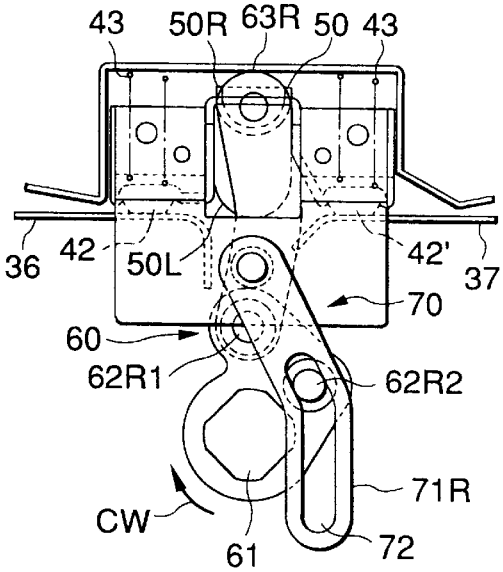
Figure 34C:
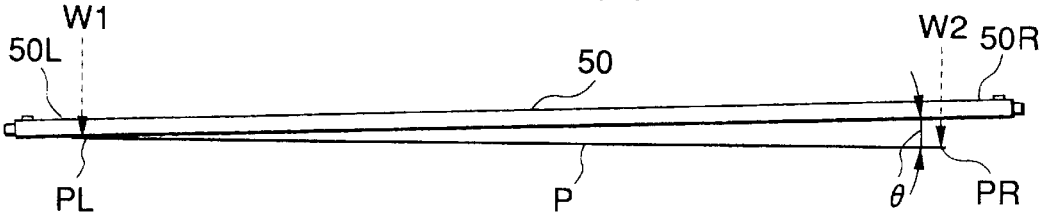
Figure 34D:
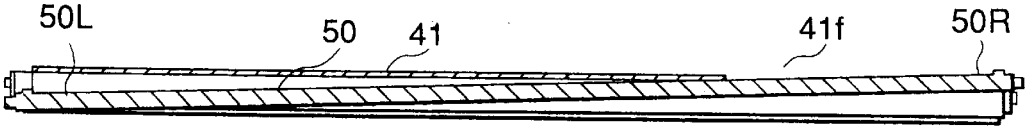

FIG. 31 is a left side view to show the main part of the third embodiment. FIG. 32(*a*) is a drawing to show the main part of the third embodiment; (a) is a fragmentary plan view and (b) is a fragmentary front view. FIGS. 33(*a*) and (*b*) are illustrations of the operation of the third embodiment. Parts similar to those previously described with reference to FIGS. 1–30 are denoted by the same reference numerals in FIGS. 31–33.

The third embodiment is characterized by the fact that a pair of support parts 36*c* and 37*c* for firmly supporting support means 36 and 37 are formed integrally with the support means 36 and 37 and that movable guide means 110 is disposed between the paired support parts 36*c* and 37*c*, as shown in FIG. 31.

The paired support parts 36*c* and 37*c* are placed along the direction of movement (arrow Y1, Y2 direction in FIG. 31) of cutting means 50 (see FIG. 4, etc.,), forming a guide part of the movable guide means 110.

The paired support parts 36*c* and 37*c* extend in the direction orthogonal to the paper face of FIG. 31 and are formed at both ends with fixed pieces 36*d* and 37*d*, which are firmly fixed to side frames 31 and 32 (see FIG. 1, etc.,). In FIG. 31, only the fixed pieces 36*d* and 37*d* fixed to the side frame 31 are drawn.

The movable guide means 110 has a base 111 shaped substantially like a rod and an inverse recess on a side view and a guide body 112 attached on the top of the base 111. As shown in FIGS. 32(*a*) and (*b*), the guide body 112 is shaped like ribs along the continuous paper transport direction.

Also as shown in FIGS. 32(*b*) and 33(*a*), droop parts 113 and 113 are formed at the center in the length direction of the base 111 and are connected pivotably to one end 121 of a swing body 120 by a pin 122.

The swing body 120 is shaped like an inverse recess on a side view and substantially like a triangle on a front view and is attached swingably to drooping parts 36*e* and 37*e* formed in the support parts 36*c* and 37*c* by pins 123.

A tension spring 125 is disposed between an opposite end 124 of the swing body 120 and a frame for always energizing the swing body 120 clockwise in FIG. 32(*b*).

Therefore, the movable guide means 110 is always energized in the arrow Y2 direction, but a projection piece (restricted part) 114 is formed at both ends of the base 111 and the projection pieces 114 abut stopper parts 36*f* and 37*f* disposed in the support parts 36*c* and 37*c*, thereby restricting upward motion of the movable guide means 110 (movement in the arrow Y direction) and positioning the movable guide means 110 at the continuous paper transport time. That is, as indicated by the phantom line in FIG. 31 and shown in FIGS.

32(*a*) and 33(*a*), at the continuous paper transport time, the movable guide means 110 faces a cutting space C in the horizontal state in the figures so as to substantially block the space between the support means 36 and 37 and guides the continuous paper on the top face of the guide body 112.

When the cutting means 50 falls at the continuous paper transport time, the movable guide means 110 abuts the cutting means 50 and is pressed down, as shown in FIG. 33(*b*), and is guided by a pair of the support parts 36*c* and 37*c* and retracts along the direction of movement of the cutting means 50 (arrow Y1 direction) in the cutting space. At this time, the swing body 120 swings about the pin 123 counterclockwise and the movable guide means 110 swings about the pin 122 counterclockwise. That is, the movable guide means 110 swings following the motion of the cutting means 50. The solid lines in FIGS. 31 and 32(*b*) draw the swinging state.

When the cutting means 50 rises, the movable guide means is restored to the state shown in FIG. 33(*a*) by the energization force of the tension spring 125.

The continuous paper cutting unit of the third embodiment produces the following effects in addition to the effects produced by the continuous paper cutting units of the first and second embodiments:

(a): Since the movable guide means 110 retracts along the direction of movement of the cutting means 50 in the cutting space C, the support means 36 and 37 can be formed firmly.

That is, the continuous paper cutting unit of the third embodiment comprises the movable guide means 110 for smoothly transporting continuous paper without causing a paper jam to occur and can also enhance the support means 36 and 37 in strength.

(b): A pair of the support parts 36*c* and 37*c* for supporting a pair of the support means 36 and 37 is disposed on the opposite side to the side where the press means (see FIG. 4, etc.,) is placed with respect to a pair of the support means 36 and 37. Thus, the support means 36 and 37 are enhanced in strength by the support parts 36*c* and 37*c*.

Moreover, the support parts 36*c* and 37*c* are disposed along the direction of movement of the cutting means 50 and form the guide part of the movable guide means 110, thus enabling the movable guide means 110 to move smoothly.

(c): Since the movable guide means 110 abuts the cutting means 50 and moves together with the cutting means 50 at the retraction time, the retracting operation of the movable guide means 110 can be carried out by using an extremely simple structure.

Various means, such as means using a cylinder mechanism, means using a link mechanism, and means using a cam, can be used as means for causing the movable guide means to perform the retracting operation. However, generally these means become complicated in structure.

In contrast, according to the continuous paper cutting unit of the third embodiment, the movable guide means 110 abuts the cutting means 50 and moves together with the cutting means 50 at the retracting time, thus eliminating the need for the cylinder mechanism, etc. Therefore, the retracting operation of the movable guide means 1–10 is carried out by an extremely simple structure.

Fourth Embodiment

A fourth embodiment of the invention is characterized in the press force of press means 40 against continuous paper P, namely, by the fact that the press force of cutting means 50 at the cutting start part is set large as compared with the press force at the cutting end part.

Specifically, with respect to compression springs 43 disposed in two recesses 41*a* and 41*b* of a moving frame 41 in FIG. 4, compression springs 43 (W1) and 43 (W1) nearest to the cutting start part (at the leftmost position in FIG. 1(*a*)) are made strong and other springs 43 are made comparatively weak.

Figure 58A:
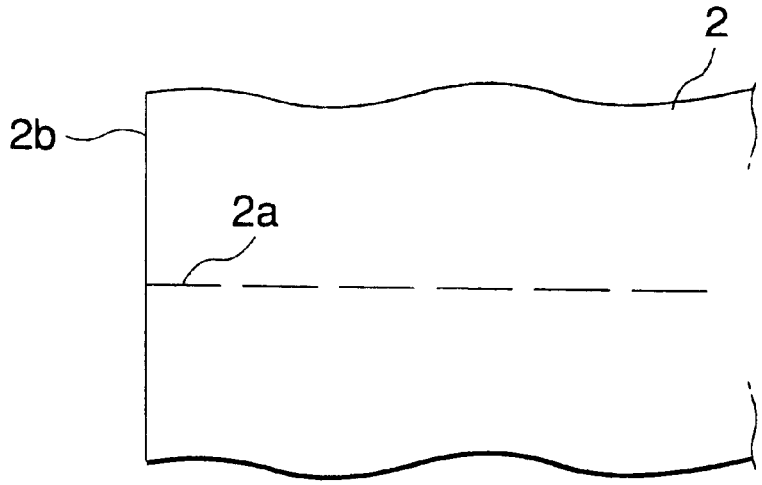
FIG.58(a) PRIOR ART
FIGS. 58(*a*) and (*b*) are partial plan views of continuous paper.
Figure 58B:
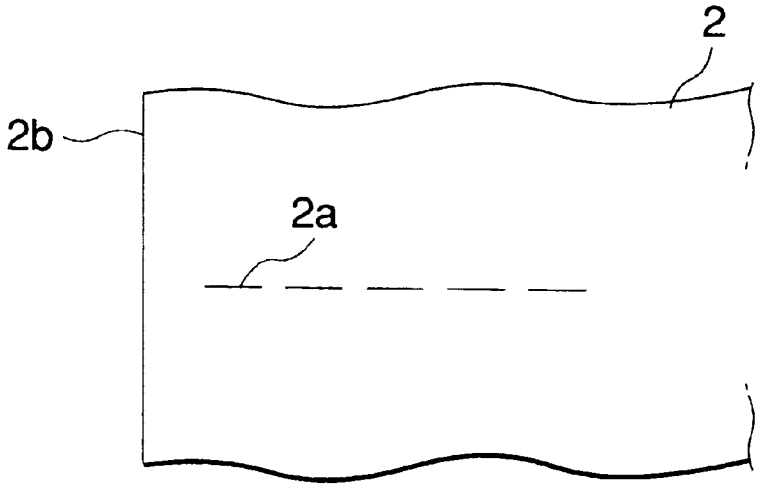
FIG.58(b) PRIOR ART

Alternatively, the compression springs 43 (W1) and 43 (W1) nearest to the cutting start part are made weaker than the compression springs 43 (W2) and 43 (W2) nearest to the cutting end part (at the rightmost position in FIG. 1(*a*)). Alternatively, six springs positioned at the left in FIG. 1(*a*) are made comparatively weak and six springs positioned at the right are made comparatively strong. The continuous paper press force W1 provided by the compression spring 43 (W1) nearest to the cutting start part (see FIG. 34(*c*)) is set to a magnitude capable of reliably cutting one end of the continuous paper having no perforations in side end margin 2*b*, as shown in FIG. 58(*b*). The continuous paper press force W2 provided by the compression spring 43 (W2) nearest to the cutting end part (see FIG. 34(*c*)) is set to a magnitude capable of reliably cutting the other end of the continuous paper having no perforations in the side end margin 2*b*, as shown in FIG. 58(*b*).

According to the structure, as shown in FIG. 34 (*c*), when the perforations of continuous paper P are cut from the left of the paper (cutting start part) PL, the cutting start part PL is pressed by the large force W1 and the cutting means 50 starts cutting the continuous paper P in an inclined state, so that the cutting is executed smoothly and reliably.

The cutting unit can also be slimmed down and miniaturized as compared with the case where the press force is made uniformly large to cut the continuous paper P reliably.

Fifth Embodiment

A fifth embodiment of the invention will be discussed with reference to the accompanying drawings.

Figure 35A:
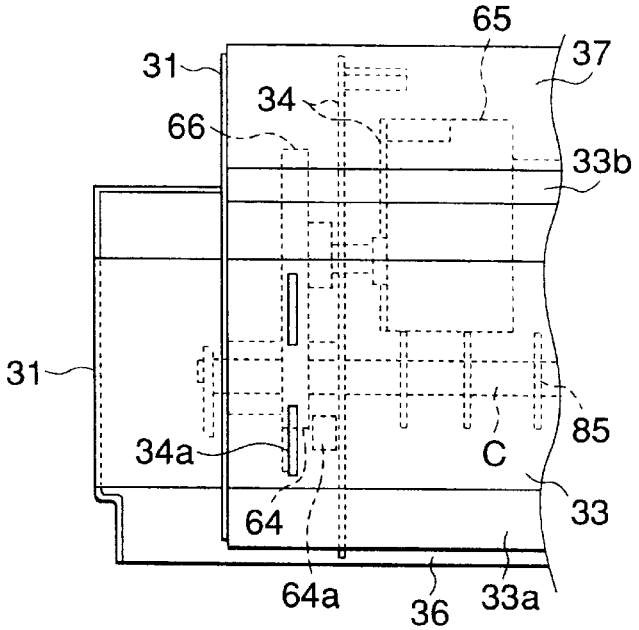
FIGS. 35(*a*)–(*c*) show an outline of a fifth embodiment of a continuous paper cutting unit according to the invention; (a) is a fragmentary plan view, (b) is a fragmentary front view, and (c) is a left side view.
Figure 35C:
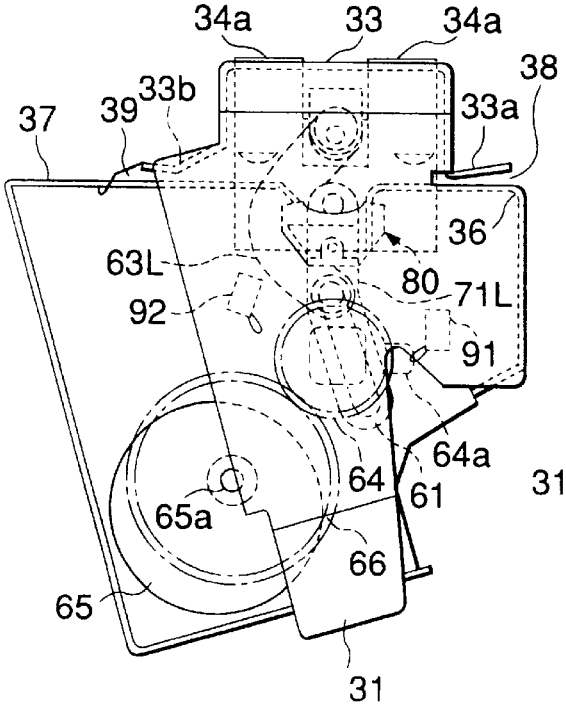
Figure 35B:
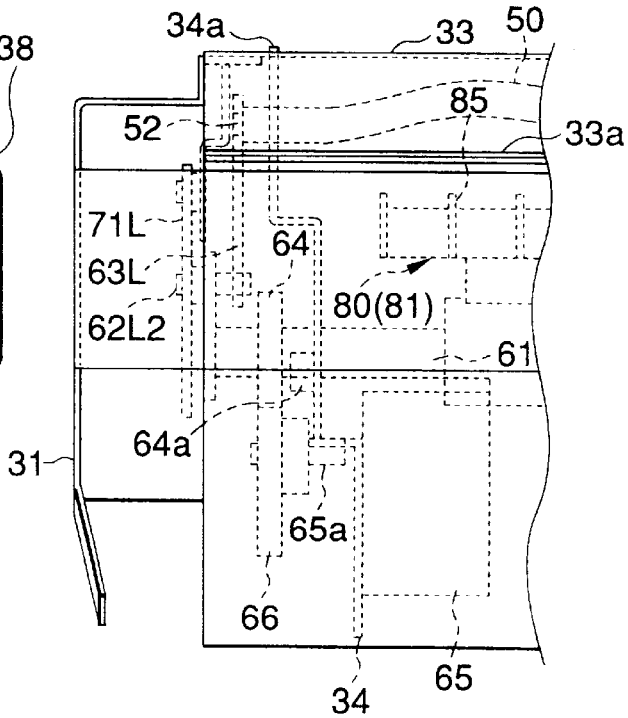
Figure 36A:
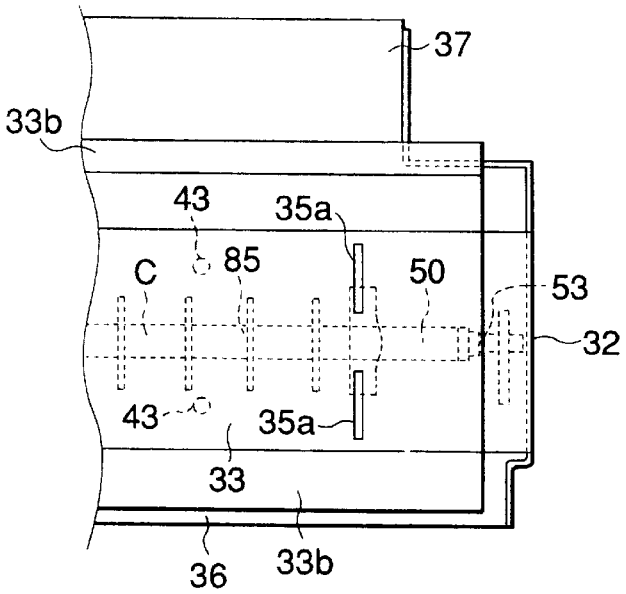
FIGS. 36(*a*)–(*c*) show an outline of the fifth embodiment of the continuous paper cutting unit according to the invention; (a) is a fragmentary plan view, (b) is a fragmentary front view, and (c) is a right side view.
Figure 36B:
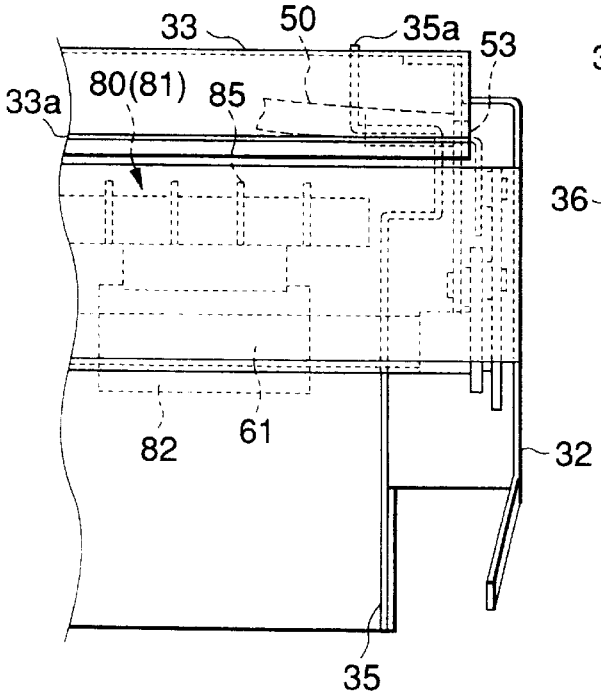
Figure 36C:
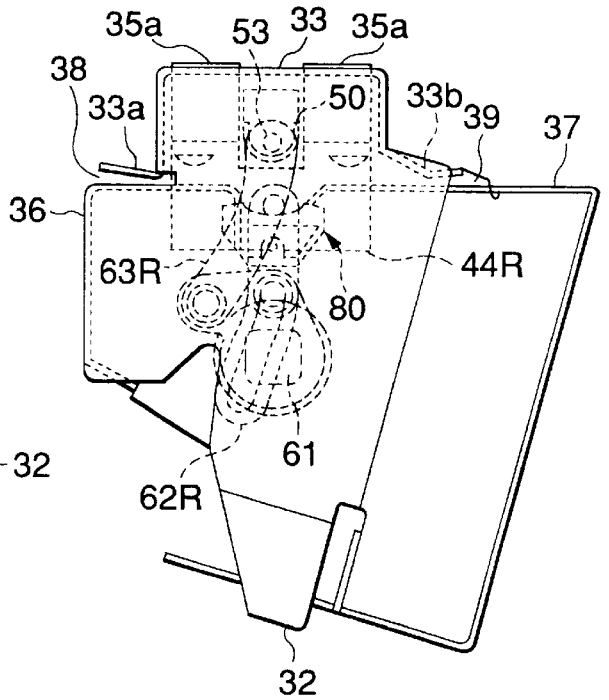
Figure 37:
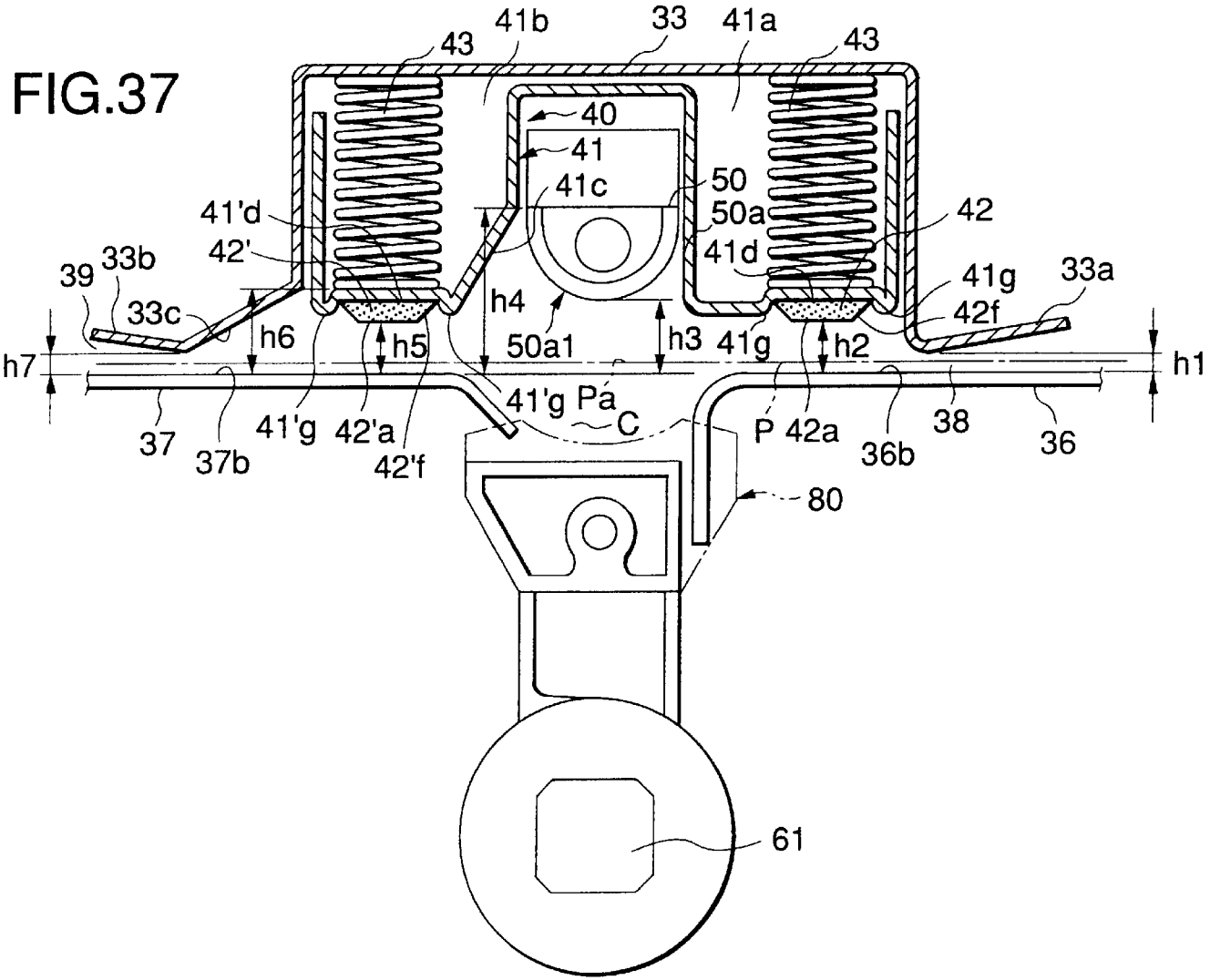
FIG. 37 is an enlarged left sectional view to mainly show an upper frame 33, a paper feed guide 36, a paper discharge guide 37, press means 40, and cutting means 50 of the fifth embodiment of the invention.
Figure 38A:
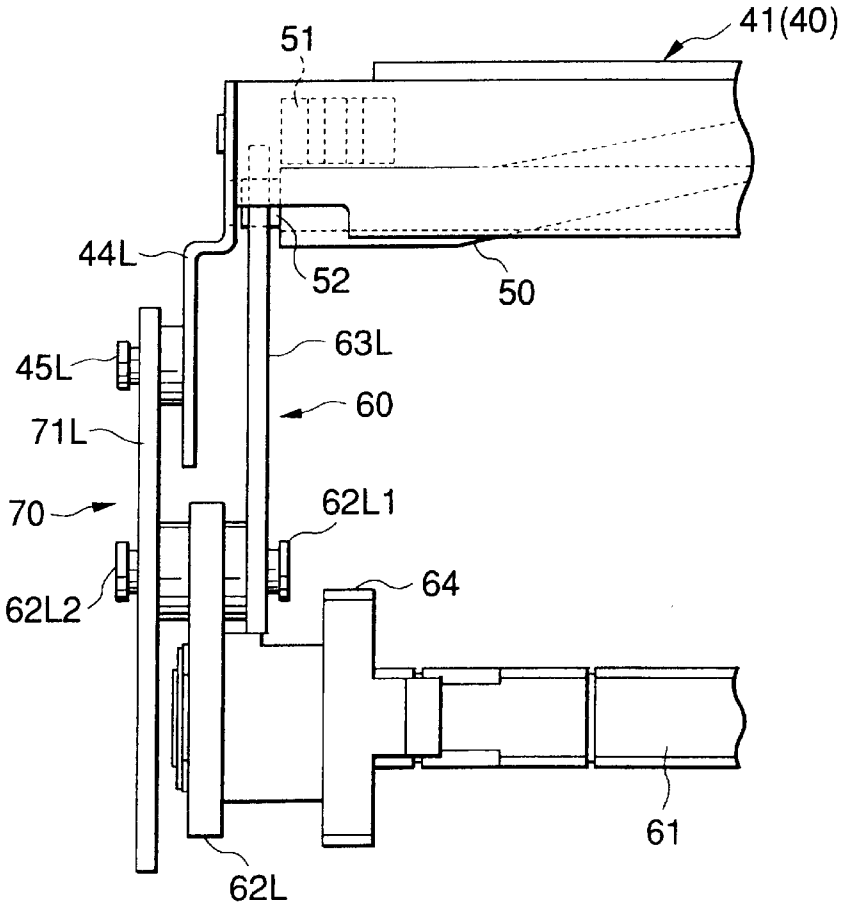
FIGS. 38(*a*) and (*b*) show a cutting means link mechanism 60 and a press means link mechanism 70 of the fifth embodiment of the invention; (a) is a front view of a left portion and (b) is a left side view.
Figure 38B:
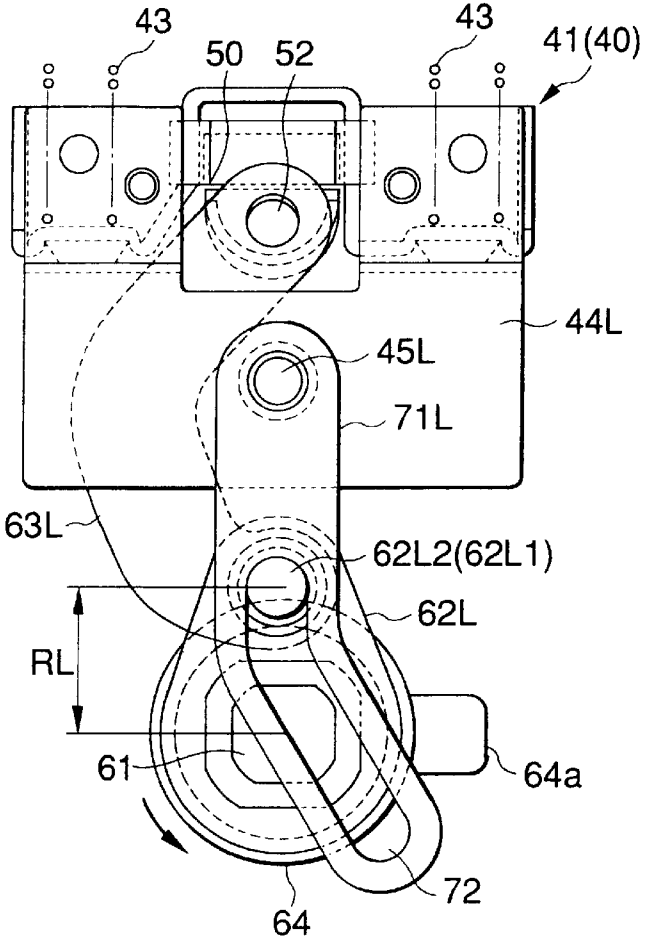
Figure 39B:
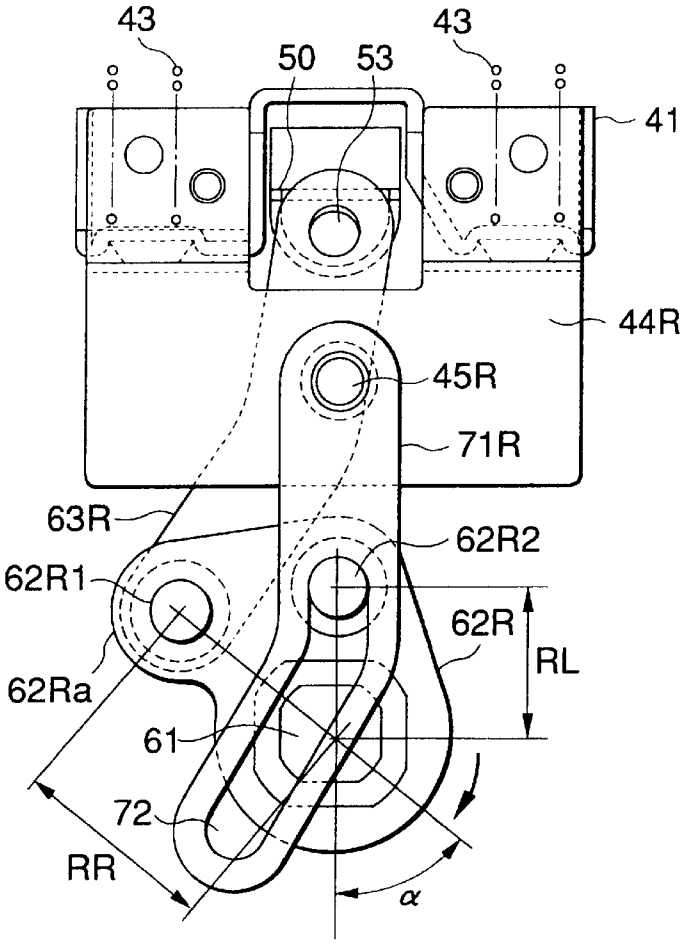
FIG. 39(*a*) is a front view of a right portion and (b) is a right side view.
Figure 39A:
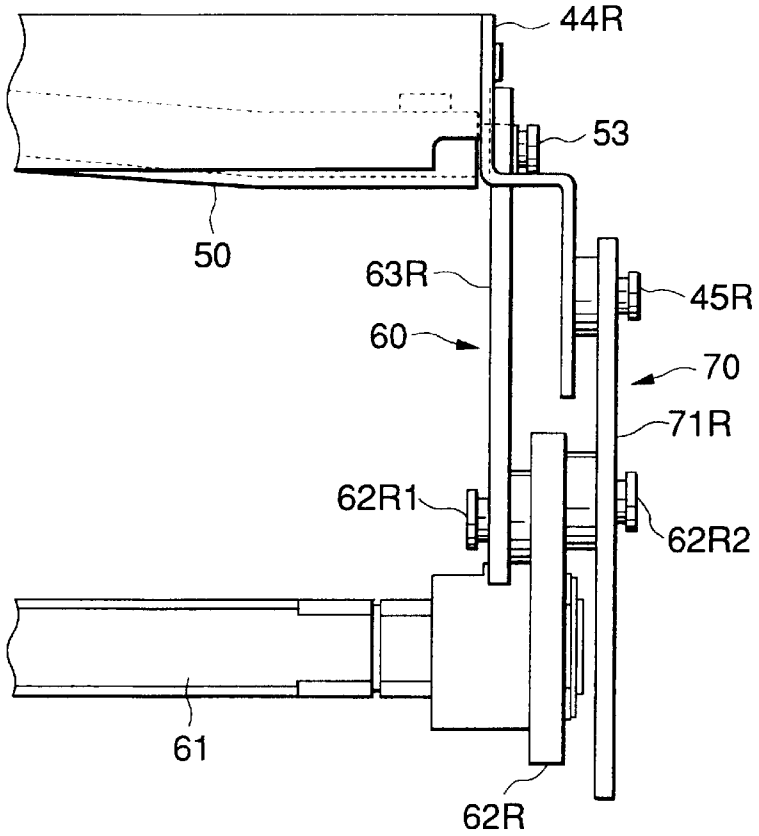

FIGS. 35(*a*)–(*c*) and 36(*a*)–(*c*) are drawings to show an outline of the fifth embodiment of a continuous paper cutting unit according to the invention; FIG. 35(*a*) is a fragmentary plan view, (b) is a fragmentary front view, and (c) is a left side view, and FIG. 36(*a*) is a fragmentary plan view, (b) is a fragmentary front view, and (c) is a right side view. FIG. 37 is an enlarged left sectional view to mainly show an upper frame 33, a paper feed guide 36, a paper discharge guide 37, press means 40, and cutting means 50. FIGS. 38(*a*) and 38(*b*) is a drawing to show a cutting means link mechanism 60 and a press means link mechanism 70; (a) is a front view of a left portion and (b) is a left side view. FIG. 39(*a*) is a front view of a right portion and (b) is a right side view;

As shown in the figures, the fifth embodiment differs from the first embodiment only in the shape of the cutting means 50.

In the cutting means 50 in the fifth embodiment, abutment angle 61 of an abutment part 50*a* against cutting start part PL of continuous paper P is set larger than abutment angle θ against cutting end part PR of continuous paper P, as described later with reference to FIGS. 42(*a*)–(*d*).

Also in the fifth embodiment, it is desirable to set the press force of the cutting means 50 at the cutting start part larger than the press force at the cutting end part as in the fourth embodiment.

Figure 41A:
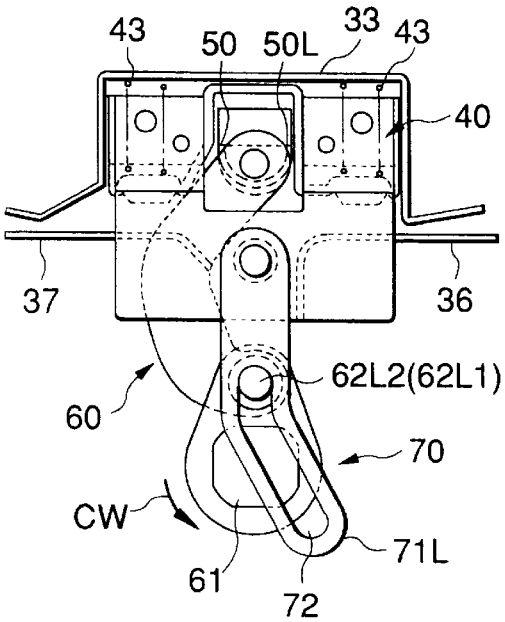
FIGS. 41(*a*)–(*c*) mainly show the operation of the cutting means 50, the cutting means link mechanism 60, and the press means link mechanism. 70 of the fifth embodiment of the invention (in the standby state); (a) is a left side view, (b) is a right side view, and (c) is a front view of the cutting means 50.
Figure 41B:
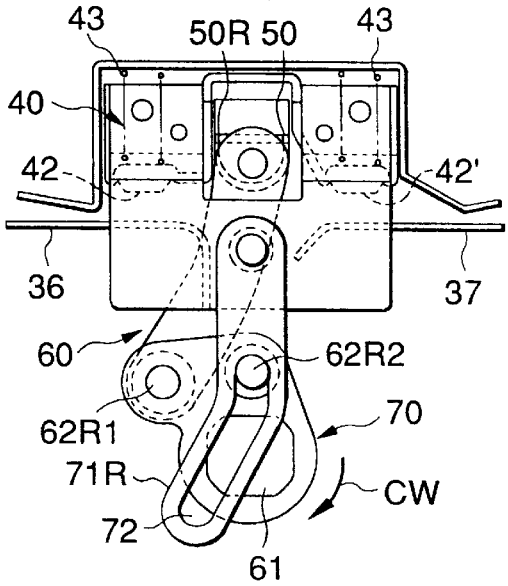
Figure 41C:
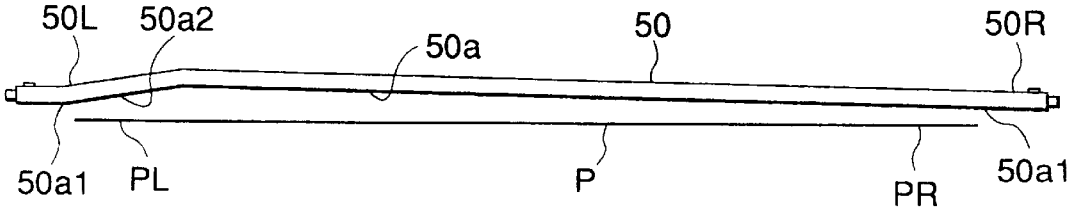
Figure 42A:
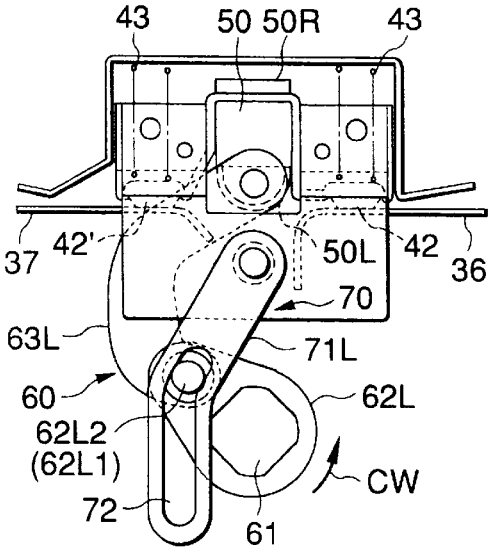
FIGS. 42(*a*)–(*d*) mainly show the operation of the cutting means 50, the cutting means link mechanism 60, and the press means link mechanism 70 (top dead center state); (a) is a left side view, (b) is a right side view, (c) is a front view of the cutting means 50, and (d) is a frontal sectional view to show the relationship between the cutting means 50 and a moving frame 41 of the press means 40.
Figure 42B:
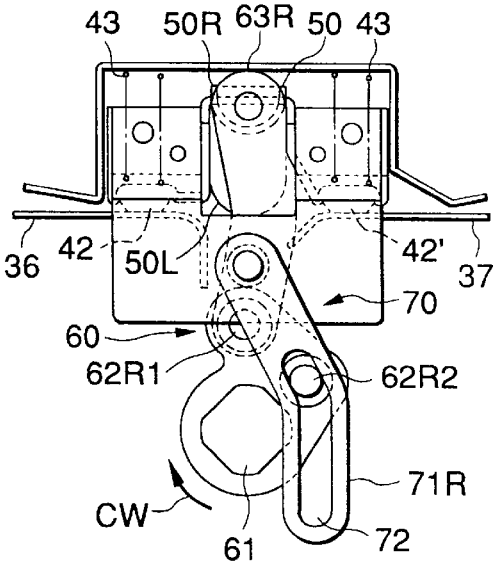
Figure 42C:
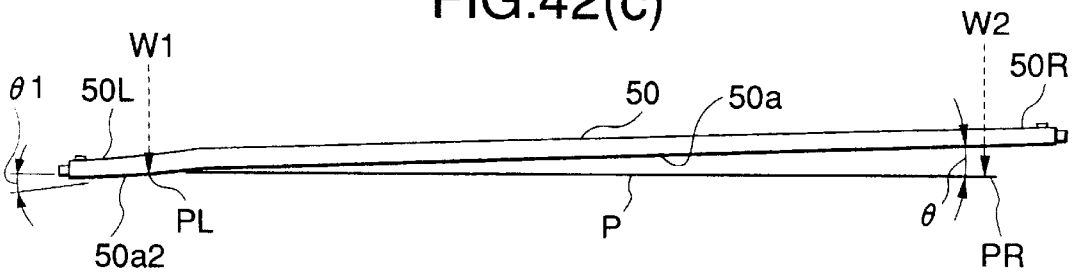
Figure 42D:
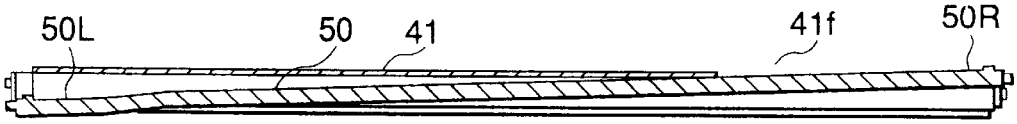

According to the fifth embodiment, in a standby state, in the cutting means 50, both ends 50*a*l and 50*a*1 of the abutment part 50*a* are positioned at a distance (see h3) substantially equal to the distance between continuous paper P support face 36*b*, 37*b* of the support means (paper feed guide 36, paper discharge guide 37) and a press part (press plate) 42, 42' (see h2, h5), as shown in FIGS. 37 and 41(*c*).

The cutting operation is performed by rotation of a drive shaft 61 as in the above-described embodiments.

Figure 40A:
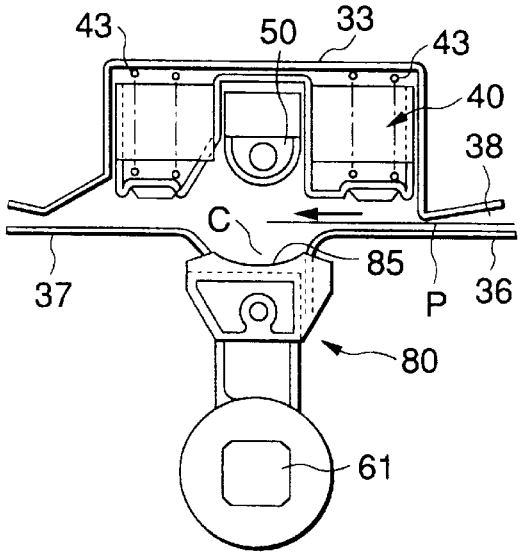
FIGS. 40(*a*), (*b*), and (*c*) are left side views to explain the operation of the fifth embodiment of the invention; (a) shows a standby state, (b) shows a state just before cutting, and (c) shows a state after cutting.
Figure 40B:
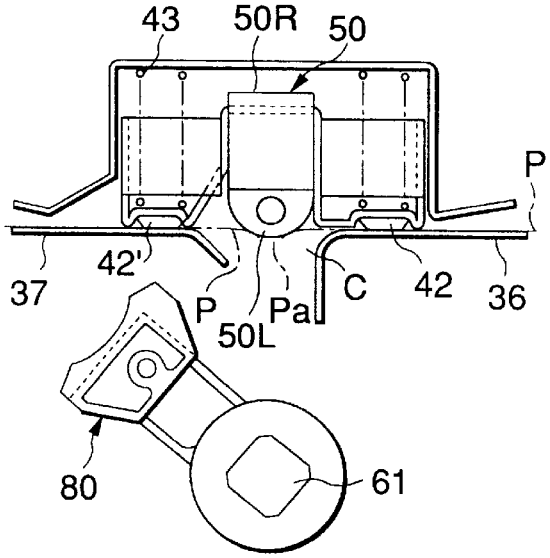
Figure 40C:
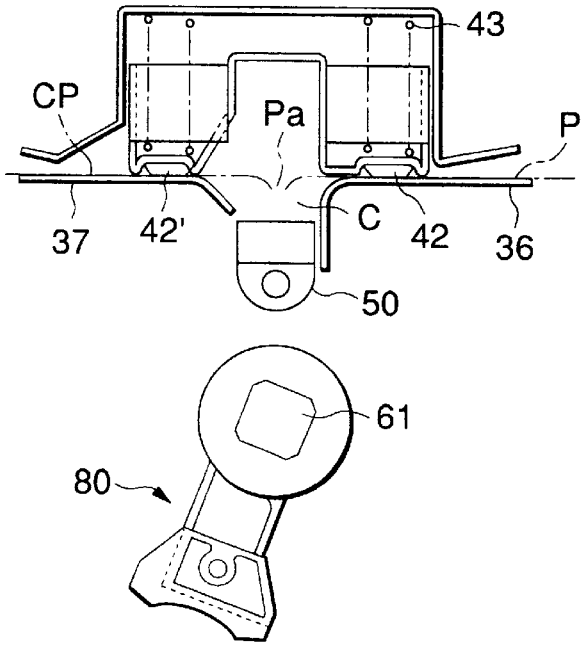

FIGS. 42(*a*)–(*d*) show a state in which right end 50R of the cutting means 50 rises completely and a state just before cutting of the continuous paper is started. At this time, left end 50L of the cutting means 50 approaches extremely close to or abuts the left end of the continuous paper P (cutting start part) PL as shown in FIGS. 40(*b*) and 42(*c*). As a result, the right part of the cutting means 50 is inclined by θ relative to the paper face of the continuous paper P, as seen in FIG. 42(*c*).

Figure 45:
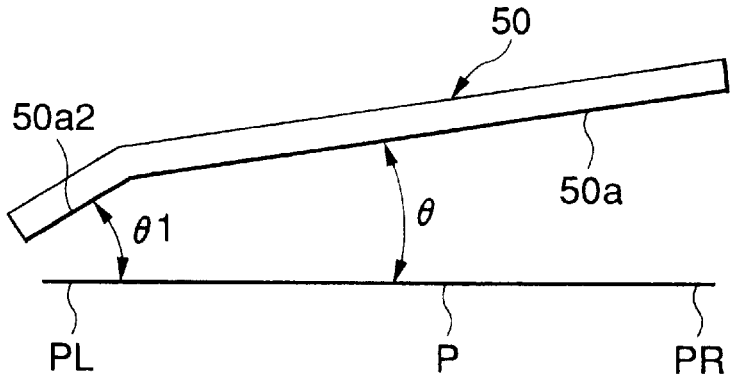
FIG. 45 is a schematic drawing to show the operation of the fifth embodiment of the invention.

Further, the abutment angle θ1 of a bend 50*a*2 of the abutment part 50*a* opposed to the continuous paper cutting start part PL (see FIG. 41(*c*)) against the continuous paper P becomes large as compared with the abutment angle θ against the-continuous paper cutting end part, as shown in FIG. 45 as a schematic drawing.

Figure 43A:
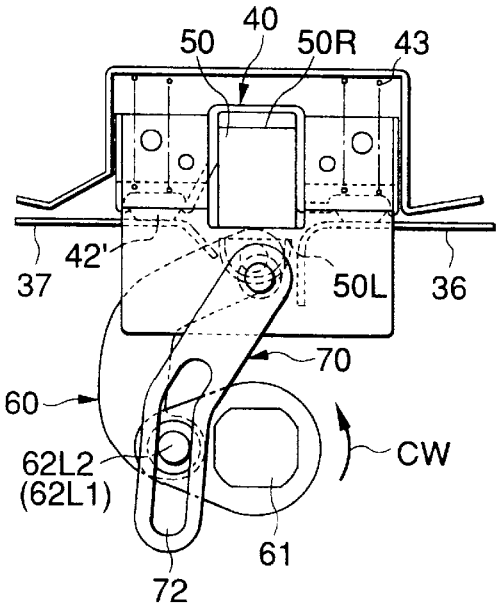
FIGS. 43(*a*)–(*c*) mainly show the operation of the cutting means 50, the cutting means link mechanism 60, and the press means link mechanism 70 (state during cutting); (a) is a left side view, (b) is a right side view, (c) is a front view of the cutting means 50.
Figure 43B:
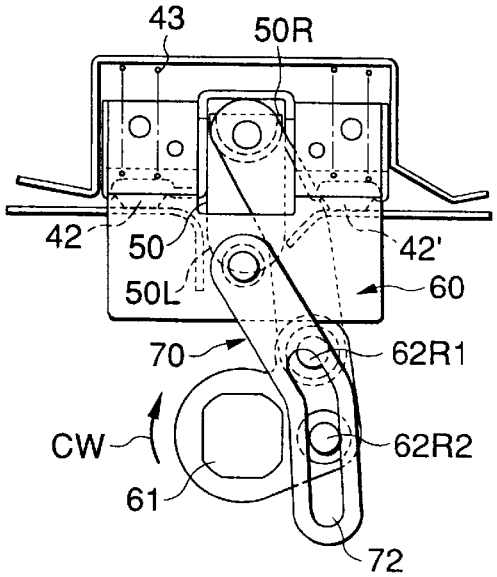
Figure 43C:
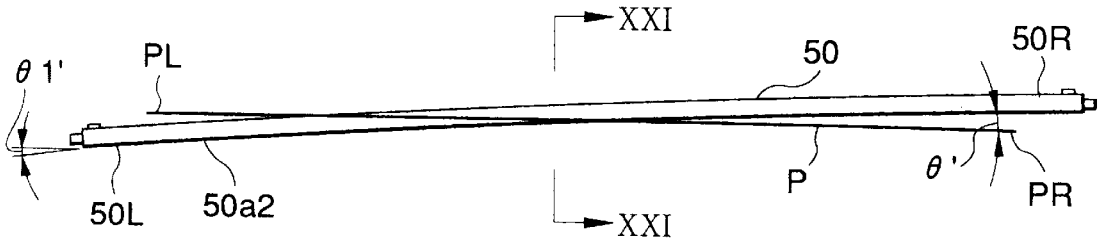

As the drive shaft 61 further continues to rotate from the state shown in FIGS. 42(*a*)–(*d*), the cutting means link mechanism 60 operates, causing the left end 50L and the right end 50R of the cutting means 50 to fall substantially at the same speed (for example, about 8 cm/s), as shown in FIGS. 43(*a*)–(*c*). As a result, the cutting means 50 cuts the perforations of the continuous paper P from the paper left (cutting start end) PL at the angle θ' substantially equal to the angle θ, as shown in FIG. 43(*c*). At this time, abutment angle θ1' of the bend 50*a*2 of the abutment part 50*a* against the cutting start part PL of the continuous paper P is set larger than abutment angle θ' against the cutting end part PR of the continuous paper P as described above, so that the cutting start part PL is cut smoothly and reliably. The reason why θ does not become equal to θ' and θ1 does not become equal to θ1' is as described above.

Figure 44A:
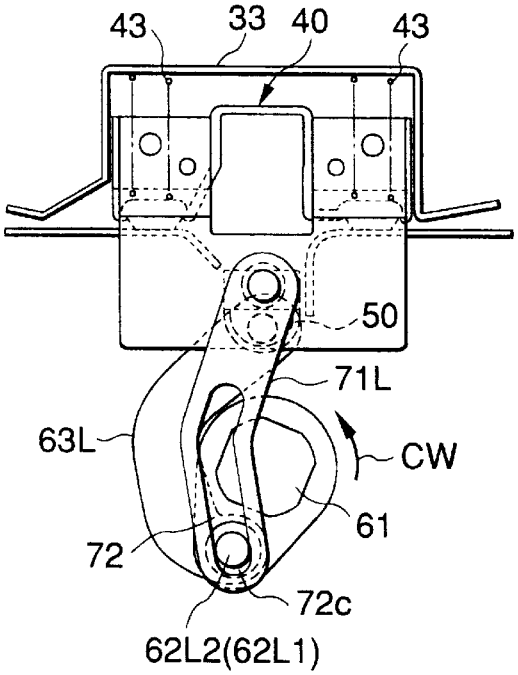
FIGS. 44(*a*)–(*c*) mainly show the operation of the cutting means 50, the cutting means link mechanism 60, and the press means link mechanism 70 (state after cutting); (a) is a left side view, (b) is a right side view, (c) is a front view of the cutting means 50.
Figure 44B:
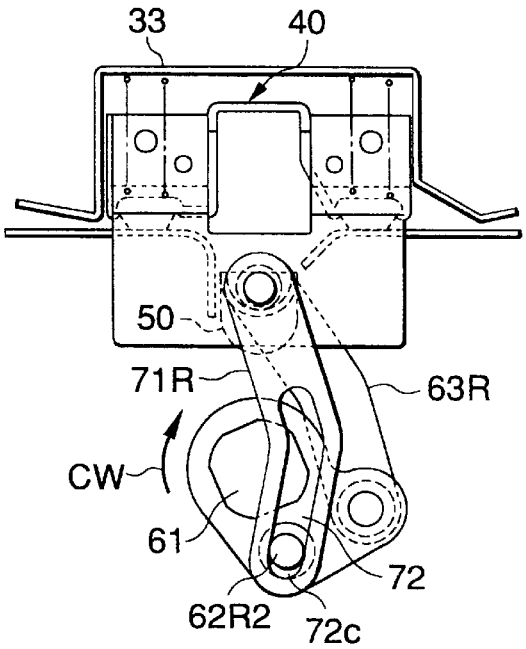
Figure 44C:
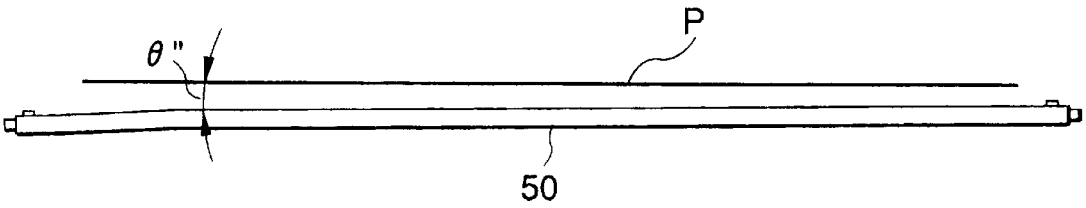

As the drive shaft 61 further continues to rotate, the left end 50L and the right end 50R of the cutting means 50 further fall, as shown in FIGS. 44(*a*) and (*b*), and the cutting means 50 passes through completely below the continuous paper P, as shown in FIG. 44(*c*). As a result, the continuous paper P is cut completely along the perforations Pa thereof.

The continuous paper cutting unit of the fifth embodiment produces the following effects in addition to the effects produced by the continuous paper cutting units of the first embodiment:

In the cutting means 50, the abutment angle θ1 of the abutment part 50*a* against the cutting start part PL of the continuous paper P is set larger than the abutment angle θ against the cutting end part PR of the continuous paper P, so that the cutting start part PL is cut comparatively easily.

Therefore, the continuous paper P can be cut smoothly.

Moreover, the cutting unit can be miniaturized and particularly can also be decreased in height.

More particularly, smooth cutting of the continuous paper can also be accomplished by setting the abutment angle of the abutment part 50*a* of the cutting means 50 against the continuous paper P large as a whole from the cutting start part PL to the cutting end part PR, for example, setting the abutment angle to θ.

However, if the abutment angle of the abutment part 50*a* is set large as a whole from the cutting start part to the cutting end part, the cutting means 50 increases in height accordingly; as a result, the cutting unit is upsized.

In contrast, according to the continuous paper cutting unit of the fifth embodiment, in the cutting means 50, the abutment angle θ1 of the abutment part 50*a* against the cutting start part PL of the continuous paper P is set larger than the abutment angle θ against the cutting end part PR of the continuous paper P. Conversely, the abutment angle θ against the cutting end part PR is set comparatively small. Thus the cutting means 50 can be decreased in height accordingly. As a result, the cutting unit can also be miniaturized.

That is, the continuous paper cutting unit of the fifth embodiment can cut the continuous paper P smoothly from the cutting start part PL to the cutting end part PR and can also be miniaturized.

For the press force of the press means 40 against the continuous paper P, if press force W1 of the cutting means 50 at the cutting start point PL is set larger than press force W2 at the cutting end part PR, the continuous paper P can be cut more smoothly and reliably from the cutting start part PL to the cutting end part PR.

Figure 46A:
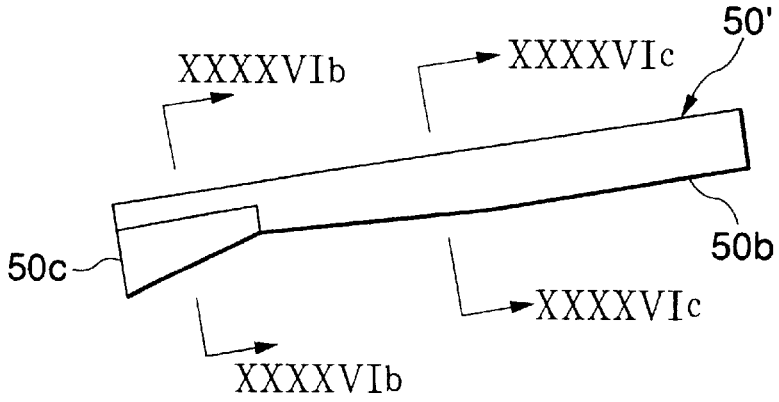
FIGS. 46(*a*)–(*c*) show a modified example of the cutting means; (a) is a front view, (b) is an end view taken on line XXXXVIb—XXXXVIb in FIG. 46(*a*), and (c) is an end view taken on line XXXXVIc-XXXXVIc in (a)
Figure 46B:
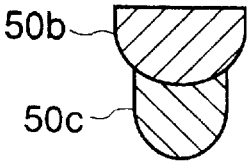
Figure 46C:
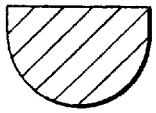

The cutting means may be made up of a main body 50*b* shaped like an almost semicolumnar rod and an angle giving member 50*c* shaped substantially like a triangle on a front view, fixed to the end of the main body 50*b* as cutting means 50' shown in FIGS. 46(*a*)–(*c*). FIG. 46(*b*) is an end view taken on line XXXXVIb—XXXXVIb in FIG. 46(*a*) and (*c*) is an end view taken on line XXXXVIc—XXXXVIc in (a).

Sixth Embodiment:

Each of the continuous paper cutting units of the first to fifth embodiments holds the continuous paper P by pressing the press means 40 against a pair of the support means 36 and 37 with the energization means and cuts the continuous paper P. Therefore, to reliably cut the paper, the press means 40 must reliably press and hold the continuous paper P.

However, in the cutting units of these embodiments, a pair of the press parts 42 and 42' is attached to the moving frame 41, mainly as shown in FIG. 4. Thus, if the parallelism between the lower face 42*a*, 42'*a* of the press part 42, 42' and the support face 36*b*, 37*b* of the support means 36, 37 is not held highly accurate due to a manufacturing error of the cutting unit, etc., the press parts 42 and 42' and the support means 36, 37 do not properly hold the continuous paper. Therefore, it is possible that the continuous paper cannot be cut reliably. For example, assuming that the support face 36*b* of the support means 36 is a little inclined relative to the lower face 42*a* of one press part 42, the lower face 42*a* of the press part 42 is not uniformly pressed against the support face 36*b* and a one-side touch (press) state is entered. Therefore, it is possible that the continuous paper is not reliably held. As a result, it is possible that the continuous paper cannot be cut reliably.

The sixth embodiment is an improvement on the continuous paper cutting units of the first to fifth embodiments. It can be made similar to any of the continuous paper cutting units of the above embodiments except for the following improvement.

Figure 47A:
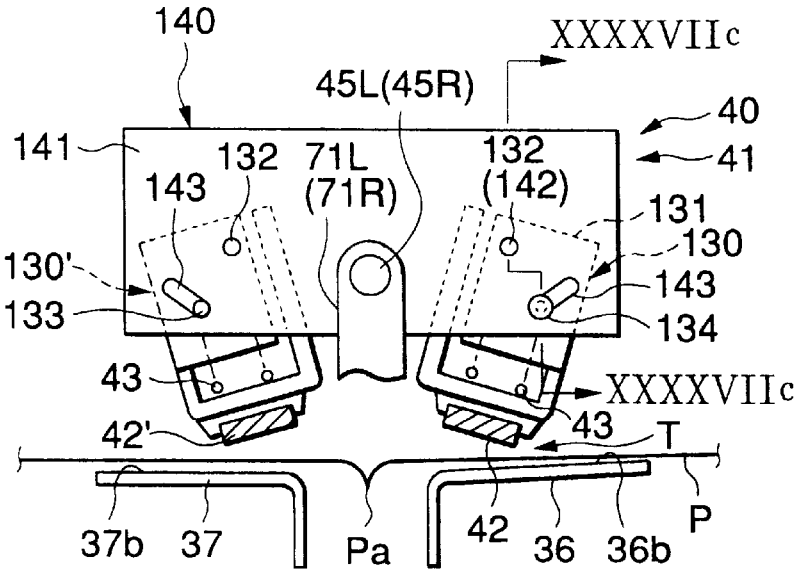
FIGS. 47(*a*) and (*b*) are left side views to show the main part of a sixth embodiment of a continuous paper cutting unit according to the invention and (c) is a sectional view taken on line XXXXVIIc—XXXXVIIc in FIG. 47(*a*)
Figure 47B:
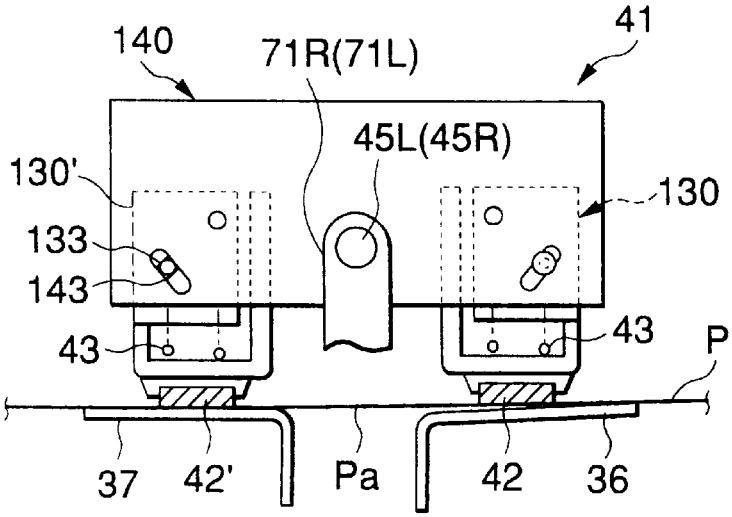
Figure 47C:
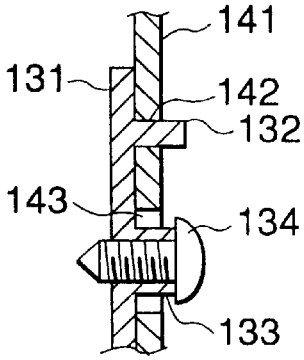

FIGS. 47(*a*) and (*b*) are left side views to show the main part of the sixth embodiment. FIG. 47 (*c*) is a sectional view taken on line XXXXVIIc—XXXXVIIc in FIG. 47(*a*). Parts similar to those previously described with reference to the accompanying drawings are denoted by the same reference numerals in FIGS. 47(*a*)–(*c*).

The sixth embodiment is characterized by the fact that a pair of press parts 42 and 42' is made swingable independently of each other with respect to support means 36 and 37.

More particularly, a moving frame 41 of the embodiment comprises a support body 140 connected to a connecting rod 71L (71R) of a press means link mechanism 70 by a pin 45L (45R) and swing bodies 130 and 130' are attached swingably to side plates 141 and 141 of the support body 140 (in FIG. 47(*a*), only the front side is shown). A pair of the press parts 42 and 42' is attached to the lower faces of the swing bodies 130 and 130'.

Since the swing bodies 130 and 130' are made symmetrical, only one swing body 130 will be discussed.

The swing body 130 is made concave in cross section and is bent at both ends at right angles, forming an attachment piece 131. The attachment piece 131 is provided with a pin 132 also shown in FIG. 47 (*c*), and the pin 132 is fitted pivotably into a hole 142, made in the side plate 141 of the support body 140, whereby the swing body 130 is attached swingably with respect to the side plate 141 of the support body 140. The side plate 141 is formed with a long hole 143 like a circular arc with the pin 132 as the center and the attachment piece 131 is provided with a tubular part 133 entering the long hole 143.

Therefore, the swing body 130 can swing in the range in which the tubular part 133 can move in the long hole 143, but is maintained at the standby time in a state in which the tubular part 133 abuts the lower end of the long hole 143, as shown in FIG. 47(*a*), because a compression spring 43 of energization means is disposed between the swing body 130 and an upper frame 33 (see FIG. 4, etc.,). As shown in FIG. 47(*c*), the tubular part 133 provides a female screw, in which a male screw 134 threadably engages, thereby preventing the tubular part 133 from being removed from the long hole 143. For easy understanding, the male screw 134 is taken off from the swing body 130' shown in FIGS. 47(*a*) and (*b*).

On the other hand, when the moving frame 41 moves to the support means 36 and 37 as the press means link mechanism 70 operates at the cutting time, the swing body 130 swings counterclockwise in FIG. 47(*b*) from the point in time at which the press part 42 abuts the support means 37. Resultantly, the press part 42 is pressed against the support means 36 via the continuous paper while it swings counterclockwise in FIG. 47(*b*). The press part 42 is pressed against the support means 37 via the continuous paper while it swings clockwise in FIG. 47(*b*).

That is, the press part 42, 42' is positioned near perforations Pa as shown in FIG. 47(*a*) when continuous paper P is transported when viewed from the perforation direction (direction orthogonal to the paper face of FIGS. 47(*a*) and (*b*)); the press part 42, 42' swings so as to go away from the perforations Pa as shown in FIG. 47(*b*) when the continuous paper P is pressed between the press part and the support means 36, 37.

As shown in FIG. 47(*b*), the long hole 143 is set to a length not to abut the tubular part 133 in a state in which the press part 42, 42' presses the continuous paper P.

The continuous paper cutting unit of the sixth embodiment produces the following effects in addition to the effects produced by the continuous paper cutting units of the first to fifth embodiments:

(a): A pair of the press parts 42 and 42' is made swingable independently of each other with respect to the support means 36 and 37. Thus, if the cutting unit contains a slight manufacturing error, etc., and the support means 36 is a little inclined from the position where it should exist (inclined so as to rise to the right in FIG. 47), for example, as shown in FIG. 47(*b*), the press part 42 swings in response to the inclination and reliably presses the continuous paper P together with the support means 36. Therefore, the continuous paper can be cut reliably.

(b): The paired press parts 42 and 42' are positioned near the perforations Pa as shown in FIG. 47(*a*) when the continuous paper P is transported when viewed from the perforation direction (direction orthogonal to the paper face of FIG. 47); the press parts 42 and 42' swing so as to go away from the perforations Pa as shown in FIG. 47(*b*) when the continuous paper P is pressed between the press parts and the support means 36 and 37. Thus, furthermore the following effect is produced:

Usually, the continuous paper P having perforations Pa is often folded in zigzags at the perforations (see FIG. 56(*a*)).

Thus, the folds may remain a little even after the continuous paper P is transported to the inside of the cutting unit, and the continuous paper P often becomes deformed in a convex or concave shape at the perforations Pa as shown in FIG. 47(*a*) wherein it becomes deformed in a concave shape.

Under such circumstances, if the continuous paper P is simply pressed and held on both sides of the perforations Pa, it still remains deformed; at the cutting time, the continuous paper P is loosened by as much as the deformation and becomes hard to cut.

In contrast, in the continuous paper cutting unit of the embodiment, the paired press parts 42 and 42' are positioned near the perforations Pa as shown in FIG. 47(*a*) when the continuous paper P is transported when viewed from the perforation direction; the press parts 42 and 42' swing so as to go away from the perforations Pa as shown in FIG. 47(*b*) when the continuous paper P is pressed between the press parts and the support means 36 and 37. Thus, the continuous paper P is pressed while it is spread with the perforations Pa at the center.

Therefore, even if the perforations Pa of the continuous paper P remain deformed as shown in FIG. 47(*a*), the deformed portion is corrected and the continuous paper P is stretched tight as shown in FIG. 47(*b*), then is pressed and held. As a result, the continuous paper P can be cut reliably and smoothly.

Seventh Embodiment

Like the sixth embodiment, a seventh embodiment of the invention is also an improvement on the continuous paper cutting units of the first to fifth embodiments. It can be made similar to any of the continuous paper cutting units of the first to fifth embodiments except for the improvement.

Figure 48:
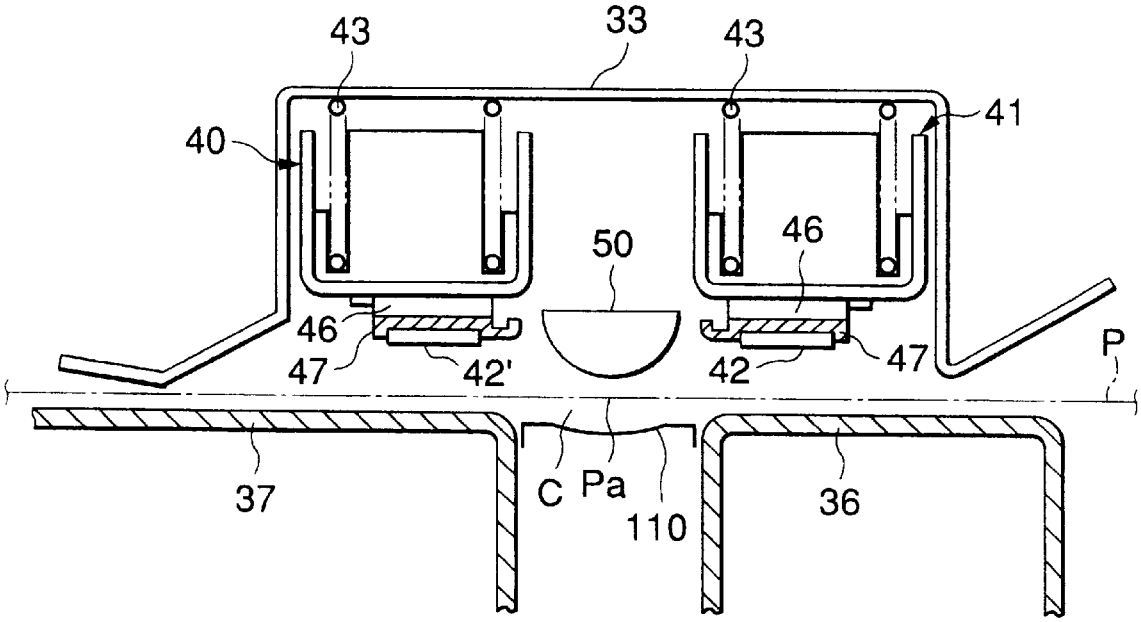
FIG. 48 is a left side view to show the main part of a seventh embodiment of a continuous paper cutting unit according to the invention.

FIG. 48 is a left side view to show the main part of the seventh embodiment. Parts similar to those previously described with reference to the accompanying drawings are denoted by the same reference numerals in FIG. 48.

The seventh embodiment is characterized by the fact that press means 40 comprises a pair of press parts 42 and 42' coming in contact with continuous paper P, a moving frame 41 to which the press parts 42 and 42' are attached, and extremely elastic members 46 and 46 which are placed between the moving frame 41 and the press parts 42 and 42'.

The press parts 42, 42' are fixedly secured to an attachment plate 47, which is then fixedly secured to the elastic member 46, which is then fixedly secured to the lower face of the moving frame 41.

The moving frame 41 may be of a one-piece structure as shown in FIG. 4 or of a swingable structure as in the sixth embodiment (FIG. 47).

A moving guide 110 faces cutting space C for guiding continuous paper P when the continuous paper is transported and retracting from the cutting space C along the direction of movement of cutting means 50 when the continuous paper is cut by the cutting means 50.

Figure 49:
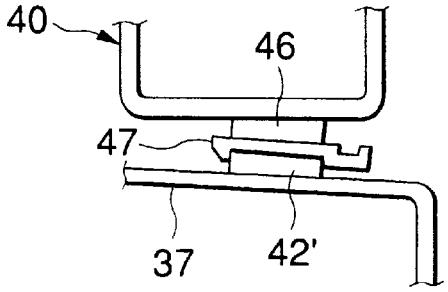
FIG. 49 is an illustration to show the operation of the seventh embodiment of the invention.

According to the continuous paper cutting unit of the seventh embodiment, the press means 40 comprises a pair of the press parts 42 and 42' which come into contact with the continuous paper P, the moving frame 41 to which the press parts 42 and 42' are attached, and the extremely elastic members 46 and 46 placed between the moving frame 41 and the press parts 42 and 42'. Thus, if the cutting unit contains a slight manufacturing error, etc., and support means 37 is a little inclined from the position where it should exist (inclined so as to rise to the left in FIG. 49), for example, as shown in FIG. 49, the elastic member 46 shrinks as shown in the figure in response to the inclination, whereby the press part 42' is also inclined, reliably pressing the continuous paper P together with the support means 36, 37.

Therefore, the continuous paper can be cut reliably.

If the moving frame 41 is of a swingable structure as in the sixth embodiment (FIG. 47), the effect of the sixth embodiment and the effect of the elastic members 46 in the seventh embodiment can be produced at the same time, so that the continuous paper P can be cut still more reliably.

A material excellent in elasticity, such as expanded urethane or normal rubber (f or example, EPDM), can be used as the elastic member 46. A material having a large frictional coefficient and excellent wear resistance can be used as the press part 42, 42'. The attachment plate 47 can be made of a synthetic resin, etc.

Eighth Embodiment

Usually, the continuous paper having perforations is often folded in zigzags at the perforations (see FIG. 56(*a*)), as described above.

Thus, the folds may remain a little even after the continuous paper is transported to the inside of the cutting unit, and the continuous paper may become deformed in a convex or concave shape at the perforations.

Under such circumstances, if the continuous paper is simply pressed and held on both sides of the perforations, it still remains deformed. At the cutting time, the continuous paper is loosened by as much as the deformation and becomes hard to cut.

An eighth embodiment of the invention is provided to solve such a problem.

The eighth embodiment is also an improvement on the continuous paper cutting units of the first to fifth embodiments. It can be made similar to any of the continuous paper cutting units of the first to fifth embodiments except for the improvement.

Figure 50A:
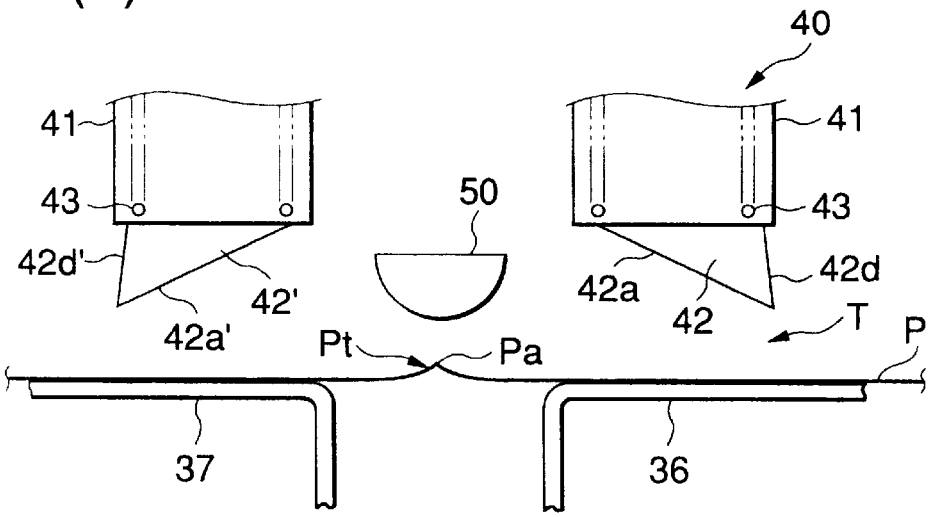
FIGS. 50(*a*), (*b*), and (*c*) are left side views to show the main part of an eighth embodiment of a continuous paper cutting unit according to the invention and also illustrations to show the operation of the eighth embodiment of the invention.
Figure 50B:
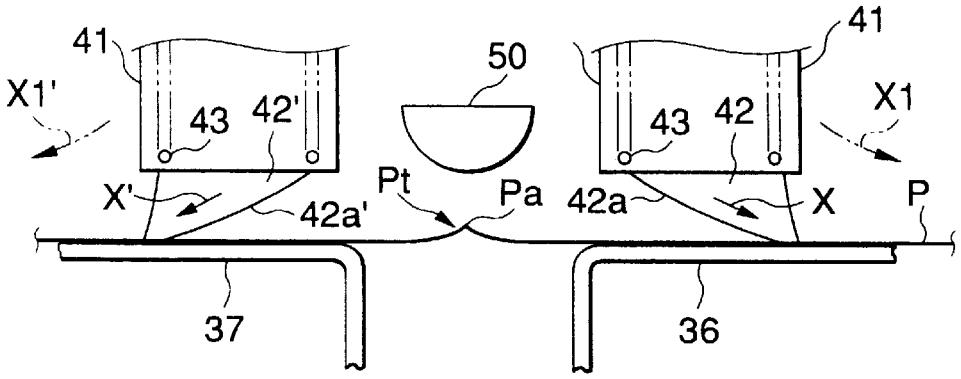
Figure 50C:
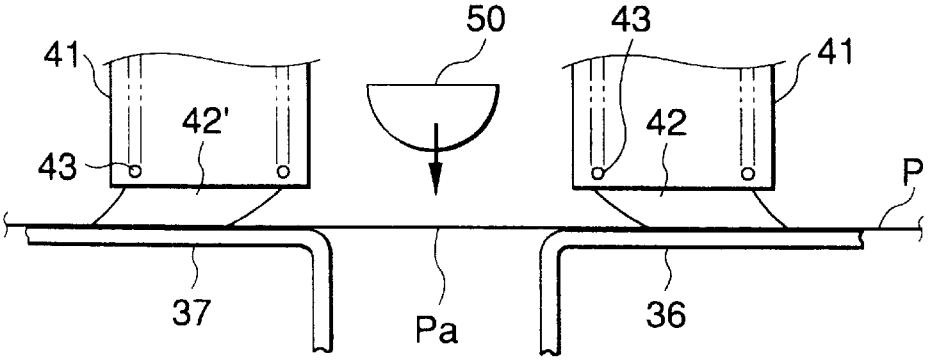

FIGS. 50(*a*), (*b*), and (*c*) are left side views to show the main part of the eighth embodiment and are also illustrations to show the operation of the embodiment. Parts similar to those previously described with reference to the accompanying drawings are denoted by the same reference numerals in FIGS. 50(*a*)–(*c*).

The eighth embodiment is characterized by the fact that a pair of press parts 42 and 42' is made of elastic members each like a taper becoming thicker as it goes away from perforations Pa.

When continuous paper P is transported, a passage T through which the continuous paper P passes is defined between support means 36 and 37 and the paired press parts 42 and 42' of press means 40, as shown in FIG. 50(*a*), and the continuous paper P having the perforations Pa is transported in the direction orthogonal to the perforations Pa.

On the other hand, when a moving frame 41 moves to the support means 36 and 37 as a press means link mechanism 70 (see FIGS. 9(*a*) and 9(*b*), etc.,) at the cutting time, the press parts 42 and 42' press the continuous paper P while they become deformed so as to spread the continuous paper P with the perforations Pa as the center as indicated by arrows X and X' in FIG. 50(*b*) from the point in time at which the press parts 42 and 42' abut the support means 36 and 37 via the continuous paper P, as shown in FIG. 50 (b). Finally, the press parts 42 and 42' become deformed so as to spread the continuous paper P, and press the continuous paper P.

Therefore, the continuous paper cutting unit of the eighth embodiment produces the following effects in addition to the effects produced by the continuous paper cutting units of the first to fifth embodiments:

The paired press parts 42 and 42' are made of taper-like elastic members becoming thicker as they go away from the perforations Pa. Thus, when the paired press parts 42 and 42' press the continuous paper P, they become deformed so as to spread the continuous paper P with the perforations Pa as the center, and press the continuous paper P, as shown in FIGS. 50(*b*) and (*c*).

Therefore, even if the perforations Pa of the continuous paper P remain deformed as Pt as shown in FIG. 50(*a*), the deformation Pt is corrected and the continuous paper P is stretched tight as shown in FIG. 50(*c*), then is pressed and held. Resultantly, the continuous paper P can be cut smoothly.

The paired press parts 42 and 42' are positioned near the perforations Pa when the continuous paper P is transported when viewed from the perforation direction (direction orthogonal to the paper face of FIG. 50) and the press parts 42 and 42' are moved so as to go away from the perforations Pa as indicated by phantom arrows X1 and X1' in FIG. 50(*b*) when the continuous paper P is pressed between the press parts and the support means 36 and 37, whereby the deformation Pt of the continuous paper P can be corrected still more reliably for stretching the continuous paper P tight. Resultantly, the continuous paper P can be cut more smoothly.

In the embodiment, the lower faces 42*a* and 42*a'* of the paired press parts 42 and 42' become linear as shown in FIG. 50(*a*), but may be bent. Side faces 42*d* and 42*d'* of the paired press parts 42 and 42' are inclined so as to aid in deforming the press parts 42 and 42', but may be uninclined.

Ninth Embodiment

When continuous paper 2 is cut as shown in FIG. 57(*d*) in the conventional continuous paper cutting unit, a fold 2*c* may be left on the continuous paper 2, as described above. Such a fold easily remains largely particularly when the perforations shift largely from the center as indicated by 2*a'* in FIG. 57(*a*).

If an attempt is made to transport the continuous paper after cutting to the right in FIG. 57(*d*), for example, with the fold 2*c* remaining large, the continuous paper strikes at the edge (2*a*) against the side face 22*a* of the paper reception bed 22 downstream in the paper transport direction, so that a paper jam may occur.

A ninth embodiment of the invention is provided to solve such a problem.

FIGS. 51 to 55 are partially cutaway side views to show the main part of the ninth embodiment and are also illustrations to show the operation of the embodiment. Parts similar to those previously described with reference to the accompanying drawings are denoted by the same reference numerals in FIGS. 51–55.

In the embodiment, continuous paper is transported from left to right in the figures as seen from the description to follow, but it may be transported from right to left as in the above-described embodiments.

Therefore, in the ninth embodiment, the paper feed guide 37 and the frame serving as a paper discharge guide 36 are support members for guiding continuous paper P when the continuous paper P is transported and supporting the continuous paper P on both sides of perforations Pa thereof when the continuous paper P is cut, as in the above-described embodiments. The paper feed guide 37 is positioned upstream in the continuous paper transport direction (direction of arrow a in FIG. 51) and the paper discharge guide 36 is positioned downstream in the continuous paper transport direction.

An upstream lower end part 33*a* of an upper frame 33 is bent, and a slit-like paper feed port 38 is formed between the upstream lower end part 33*a* and the paper feed guide 37. A downstream lower end part 33*b* of the upper frame 33 is also bent, and a slit-like paper discharge port 39 is formed between the downstream lower end part 33*b* and the paper discharge guide 36.

The continuous paper P is transported from the paper feed port 38 to the paper discharge port 39 by paper feed means (not shown).

C denotes a slit-like cutting space formed between the paper feed guide 37 and the paper discharge guide 36, and numeral 50 is a cutting member. The continuous paper P normally is transported so that the perforations Pa are positioned at the center of the cutting space C.

Numeral 40 is press means 40; similar means to that shown in FIG. 48 is used.

A cutting member 50 is a blunt instrument (in the embodiment, like a round rod).

Numeral 110 is a moving guide similar to that shown in FIG. 31.

Figure 51:
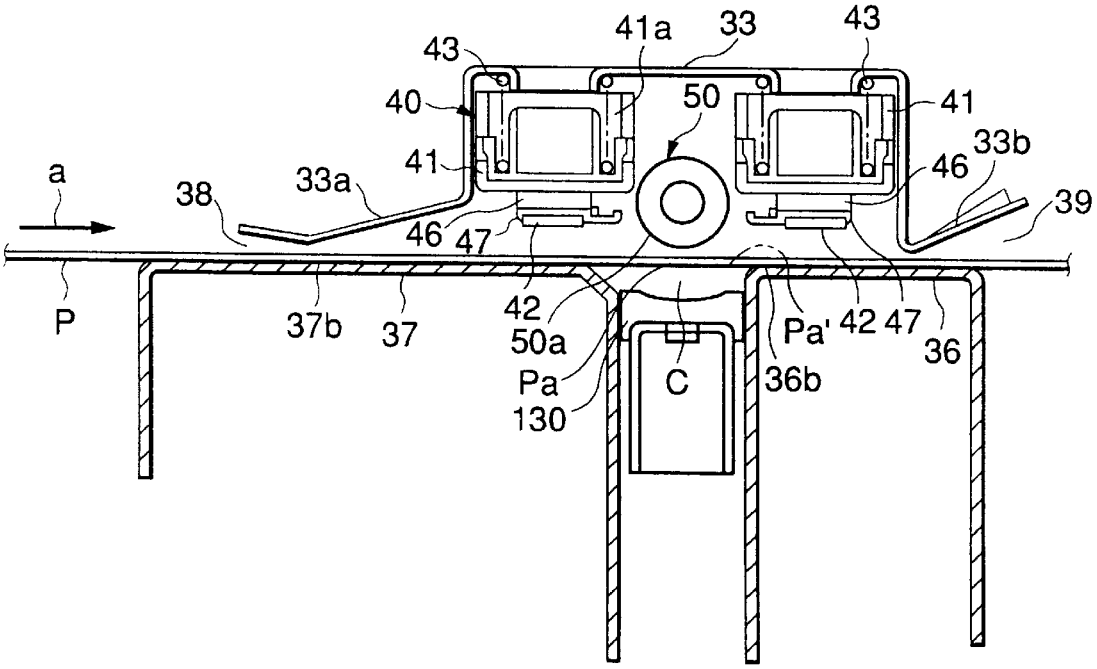
FIGS. 51 to 55 are partially cutaway side views to show the main part of a ninth embodiment of a continuous paper cutting unit according to the invention and also illustrations to show the operation of the eighth embodiment of the invention.

The operation of the continuous paper cutting unit of the embodiment is as follows:

In a standby state, the cutting member 50 has an abutment part 50*a* which abuts against the continuous paper P, positioned above continuous paper P support faces 37*b* and 36*b* of the paper feed guide 37 and the paper discharge guide 36, as shown in FIG. 51.

The press means 40 is restricted in movement by a press means link mechanism 70 (see FIGS. 9(*a*) and (*b*), etc.,) receiving the energization force of energization means 43, and is placed at a position shown in FIG. 51.

The moving guide 110 is positioned near the continuous paper P support faces 37*b* and 36*b* of the paper feed guide 37 and the paper discharge guide 36.

In such a state, the paper feed means (not shown) is driven for feeding the continuous paper P from the paper feed port 38 to the cutting space C as indicated by arrow a in FIG. 51.

At this time, the continuous paper P normally is fed so that the perforations Pa are positioned substantially at the center of the cutting space C, as described above.

In fact, however, continuous paper may be fed exceeding a predetermined amount for some reason (for example, a transport error, etc.,). In this case, the perforations Pa shift from the center of the cutting space C as indicated by phantom line Pa'.

Even if such a position shift of the perforations Pa occurs, the embodiment enables the continuous paper P to be cut reliably along the perforations Pa and to be transported without causing a paper jam to occur. In the description that follows, a case where a position shift of the perforations Pa occurs is taken as an example.

The cutting operation is performed by operating the press means link mechanism 70 and a cutting means link mechanism 60 for moving the press means 40 and the cutting member 50 downward.

Figure 52:
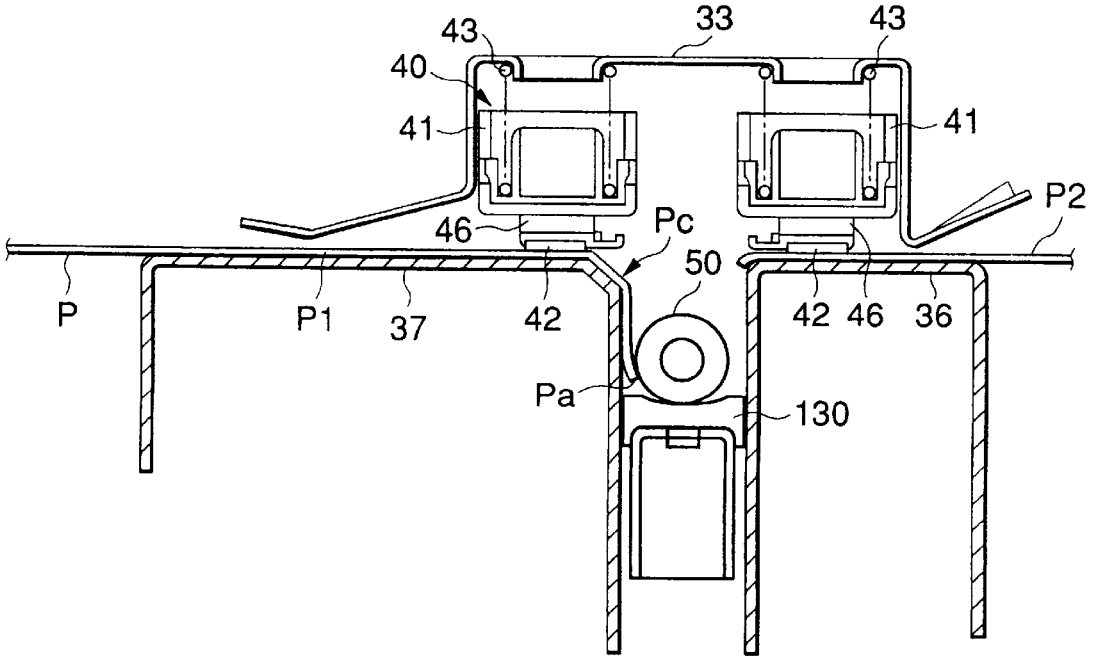

That is, first the energization force of the energization means 43 causes the press means 40 to drop, as shown in FIG. 52. When plate plates 42 and 42 of the press means 40 abut the paper feed guide 37 and the paper discharge guide 36 via the continuous paper P and the continuous paper is sandwiched between the press plates and the guides, the energization force of the energization means 43 is received by the paper feed guide 37 and the paper discharge guide 36. Therefore, the continuous paper is sandwiched and held between the press plates 42 and 42 and the paper feed guide 37 and the paper discharge guide 36 on both sides of the perforations Pa.

Next, the cutting member 50 drops and the continuous paper P is cut (torn) along the perforations Pa, as shown in FIG. 52.

The cutting means 50 has a contact part (cutting part) 50*a* which contacts the continuous paper, shaped like a circular arc. The continuous paper is wound partially around the contact part and the perforations Pa are cut. Thus, if the perforations Pa shift from the center of the cutting space C, the continuous paper P is cut reliably along the perforations Pa.

The moving guide 130 is pressed down by the cutting means 50.

A fold remains in the continuous paper P thus cut. Particularly, if the perforations Pa shift downstream as indicated by phantom line Pa' in FIG. 51, a large fold Pc remains in upward continuous paper P1 as shown in FIG. 52.

Figure 53:
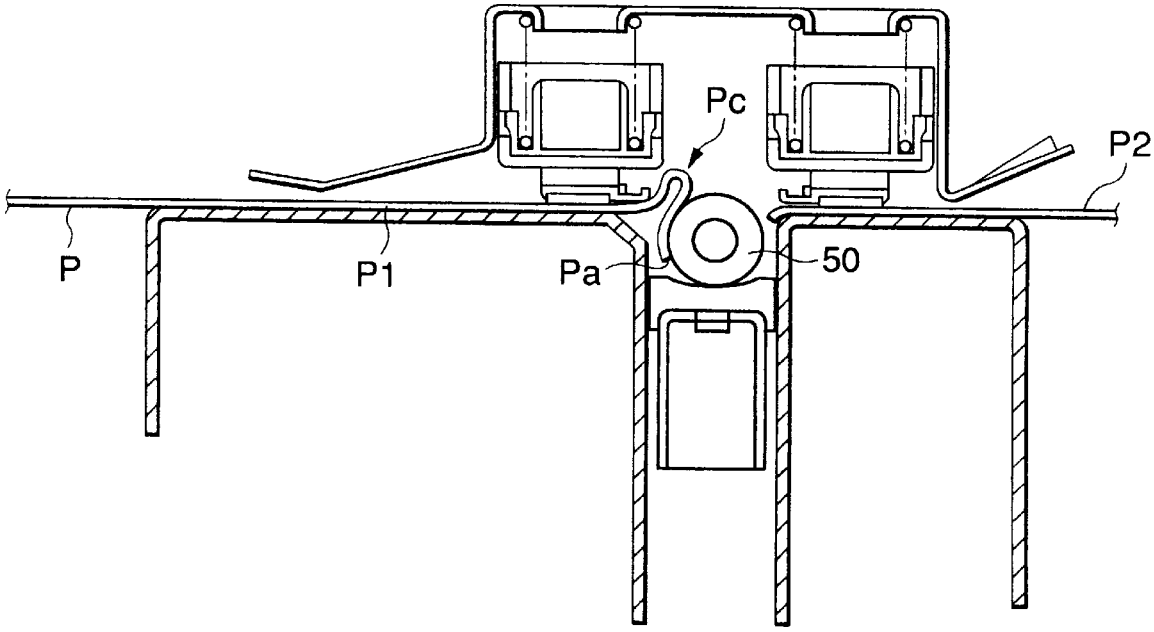
Figure 54:
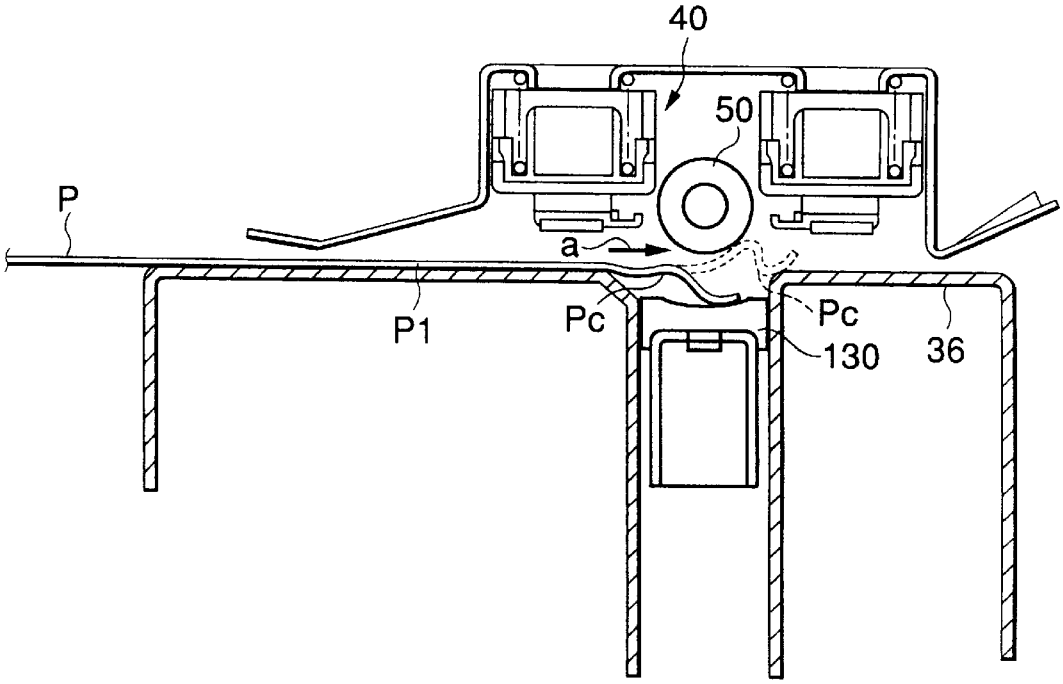

Then, the cutting member 50 moves up and returns to the original position, as shown in FIGS. 53 and 54. At this time, the fold Pc remains in the upward continuous paper P1. Thus, as shown in FIG. 53, while the cutting member 50 moves up, the tip of the continuous paper P1 (Pa) moves up together with the cutting member 50, whereby the bend (Pc) is bent even more.

While the cutting member 50 moves up and returns to the original position as shown in FIGS. 53 and 54, the press means 40 also returns to the original position as shown in FIG. 54. Therefore, the sandwich pressure of the continuous paper P (upstream continuous paper P1 and downstream continuous paper P2) is released, but the fold Pc may still remain as shown in FIG. 54.

Then, if an attempt is made to operate the paper feed means (not shown) placed upstream (left in the figure) and paper discharge means placed downstream (right in the figure) for again feeding the upstream continuous paper P1 (transporting the paper so that the next perforations are positioned substantially at the center of the cutting space C) and discharging the downstream paper P2 already cut, the downstream paper P2 already cut is discharged without difficulty. However, if the fold Pc is left largely in the upstream continuous paper P1, it is feared that the edge may strike against the paper discharge guide 36, causing a paper jam to occur (see the phantom line Pc in FIG. 54).

Then, in the embodiment, the paper feed means is once rotated in reverse for once transporting the continuous paper P1 after being cut in the arrow b direction (upstream direction), then the paper is transported in the downstream direction (arrow a direction). The paper is then transported in the downstream direction so that the next perforations are positioned substantially at the center of the cutting space C.

Figure 55:
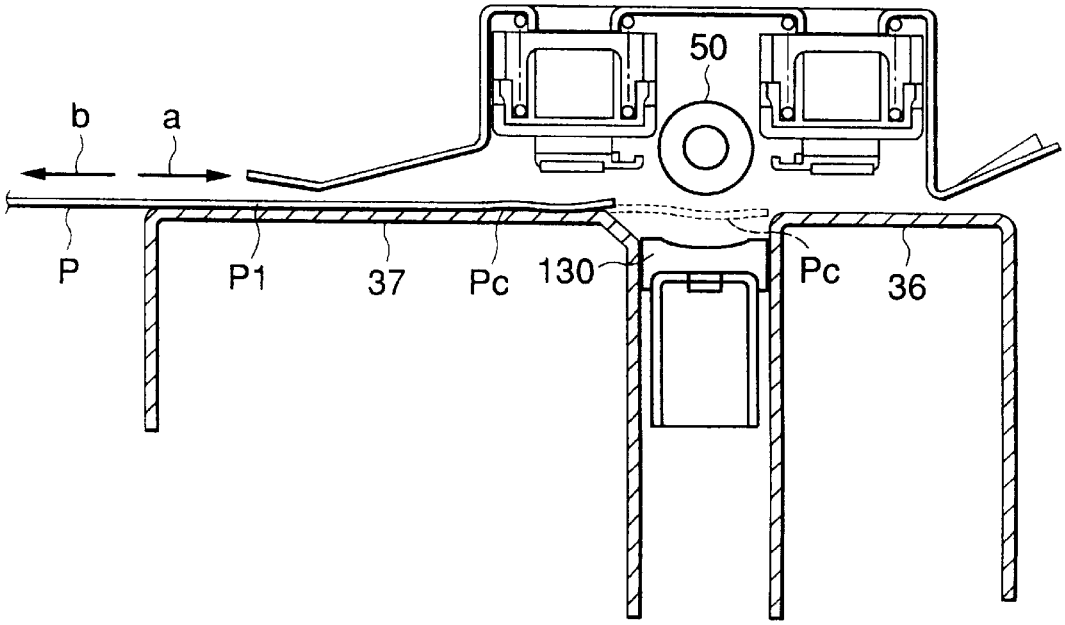

In doing so, when the continuous paper P1 is once transported in the upstream direction, the fold Pc abuts the paper feed guide 37, so that it is corrected as indicated by the solid line in FIG. 55.

Thus, when the continuous paper P1 is again transported downstream, if the fold Pc remains, it becomes small as indicated by the phantom line in FIG. 55.

Therefore, a paper jam becomes hard to occur.

The already cut paper P2 may be discharged by rotating forward the paper discharge means regardless of the reverse rotation operation of the paper feed means, or may be once fed reversely and be discharged by operating the paper discharge means in association with the paper feed means.

What is claimed is:

1. A continuous paper cutting unit for cutting continuous paper having perforations along a line of the perforations, said cutting unit comprising:

a paper support for supporting the continuous paper on both sides of the perforation;

a press for pressing the continuous paper on both sides of the perforations against the paper support;

an actuator for actuating the press;

a paper cutter for cutting the continuous paper, said paper cutter extending in the same direction as the perforations of the continuous paper and being longer than a length of the perforations;

a cutter link mechanism for holding the paper cutter at a standby position, moving the paper cutter toward the perforations at a cutting operation time, and returning the paper cutter to the standby position after the perforations are cut; and a press link mechanism for holding the press at a standby position against a force created by the actuator, allowing the force created by the actuator to move the press to the paper support at the cutting time, and returning the press to the standby position after the continuous paper is cut by the paper cutter;

wherein the press comprises a pair of press parts which swing independently relative to the paper support.

2. A continuous paper cutting unit for cutting continuous paper having perforations along a line of the perforations, said cutting unit comprising:

a paper support for supporting the continuous paper on both sides of the perforation;

a press for pressing the continuous paper on both sides of the perforations against the paper support, the press being attached to a moving frame;

an actuator for actuating the press;

a paper cutter for cutting the continuous paper, said paper cutter extending in the same direction as the perforations of the continuous paper and being longer than a length of the perforations;

a cutter link mechanism for holding the paper cutter at a standby position, moving the paper cutter toward the perforations at a cutting operation time, and returning the paper cutter to the standby position after the perforations are cut; and a press link mechanism for holding the press at a standby position against a force created by the actuator, allowing the force created by the actuator to move the press to the paper support at the cutting time, and returning the press to the standby position after the continuous paper is cut by the paper cutter;

wherein the press comprises a pair of press parts, and elastic members are placed between the press parts and the moving frame.

3. The continuous paper cutting unit as claimed in claim 2, wherein the elastic members are tapered in a direction away from the perforations.

* * * * *